US011761295B2

(12) United States Patent
Watson et al.

(10) Patent No.: US 11,761,295 B2
(45) Date of Patent: Sep. 19, 2023

(54) PLUGGING DEVICE DEPLOYMENT

(71) Applicant: THRU TUBING SOLUTIONS, INC., Oklahoma City, OK (US)

(72) Inventors: Brock W. Watson, Sadler, TX (US); Gary P. Funkhouser, Moore, OK (US); Roger L. Schultz, Newcastle, OK (US); Gregory A. Kliewer, Edmond, OK (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 0 days.

(21) Appl. No.: 16/402,396

(22) Filed: May 3, 2019

(65) Prior Publication Data

US 2019/0257172 A1 Aug. 22, 2019

Related U.S. Application Data

(63) Continuation-in-part of application No. 15/745,608, filed on Jan. 17, 2018, now Pat. No. 10,753,174, and a continuation of application No. PCT/US2017/059644, filed as application No. PCT/US2016/029357 on Apr. 26, 2016.

(60) Provisional application No. 62/419,109, provisional application No. 62/195,078, filed on Jul. 21, 2015.

(51) Int. Cl.
*E21B 33/13* (2006.01)
*E21B 33/068* (2006.01)

(52) U.S. Cl.
CPC ..... *E21B 33/13* (2013.01); *E21B 33/068* (2013.01)

(58) Field of Classification Search
None
See application file for complete search history.

(56) References Cited

U.S. PATENT DOCUMENTS

| | | | |
|---|---|---|---|
| 2,157,493 | A | 5/1939 | Miller et al. |
| 2,754,910 | A | 7/1956 | Derrick et al. |
| 2,788,072 | A | 4/1957 | Goodwin |

(Continued)

FOREIGN PATENT DOCUMENTS

| | | | |
|---|---|---|---|
| EP | 0787889 | A2 | 8/1997 |
| WO | 2013184238 | A1 | 12/2013 |
| WO | 2014042552 | A1 | 3/2014 |

OTHER PUBLICATIONS

Australian Examination Report dated May 3, 2019 for AU Patent Application No. 2017219089, 4 pages.

(Continued)

*Primary Examiner* — Charles R Nold
(74) *Attorney, Agent, or Firm* — Smith IP Services, P.C.

(57) ABSTRACT

A system for use with a subterranean well can include a deployment apparatus configured to deploy one or more plugging devices into a fluid flow. The plugging devices are conveyed into the well by the fluid flow. The deployment apparatus can include multiple queues, different numbers of the plugging devices being contained in respective different ones of the queues. A method of deploying plugging devices can include connecting multiple queues of the plugging devices to a conduit, and deploying the plugging devices from a selected combination of the queues into the conduit. In another system, each of the plugging devices may include a body, and lines or fibers extending outwardly from the body.

9 Claims, 42 Drawing Sheets

(56) References Cited

U.S. PATENT DOCUMENTS 2,838,117 A 6/1958 Clark, Jr. et al.
2,970,645 A 2/1961 Glass et al.
3,011,548 A 12/1961 Holt
3,170,517 A 2/1965 Graham et al.
3,174,546 A 3/1965 Flickiner
2,768,693 A 10/1965 Hughes, Jr.
3,292,700 A 12/1966 Berry
3,376,934 A 4/1968 Willman et al.
3,399,726 A 9/1968 Harris et al.
3,434,539 A 3/1969 Merritt
3,437,147 A 4/1969 Davies
3,480,079 A 11/1969 Guinn et al.
3,595,314 A 7/1971 Garner
3,707,194 A 12/1972 Svaldi
3,814,187 A 6/1974 Holman
3,895,678 A 7/1975 Wright et al.
4,187,909 A 2/1980 Erbstoesser
4,194,561 A 3/1980 Stokley et al.
4,505,334 A 3/1985 Doner et al.
4,716,964 A 1/1988 Erbstoesser et al.
4,921,577 A 5/1990 Eubank
5,004,048 A 4/1991 Bode
5,507,345 A 4/1996 Wehunt, Jr. et al.
5,890,536 A 4/1999 Nierode et al.
5,908,073 A 6/1999 Nguyen et al.
6,394,184 B2 5/2002 Tolman et al.
6,427,776 B1 8/2002 Hoffman et al.
7,451,823 B2 11/2008 Wilson
7,527,095 B2 5/2009 Bloess et al.
7,565,929 B2 * 7/2009 Bustos ..... C09K 8/74 166/279
7,571,773 B1 8/2009 West et al.
7,891,424 B2 2/2011 Creel et al.
8,256,515 B2 9/2012 Barbee
8,307,916 B1 11/2012 Wald
8,596,362 B2 12/2013 Nelson
8,757,260 B2 6/2014 Luo et al.
8,851,172 B1 10/2014 Dudzinski
8,950,438 B2 2/2015 Ryan
8,950,491 B2 2/2015 Frost
9,187,975 B2 11/2015 Rochen
9,284,798 B2 3/2016 Jamison et al.
9,334,704 B2 5/2016 Mineo et al.
9,745,820 B2 8/2017 Watson et al.
9,816,341 B2 11/2017 Funkhouser et al.
10,233,719 B2 3/2019 Schultz et al.
10,513,653 B2 12/2019 Schultz et al.
10,513,902 B2 12/2019 Funkhouser et al.
10,641,057 B2 5/2020 Schultz et al.
10,641,069 B2 5/2020 Schultz et al.
10,641,070 B2 5/2020 Schultz et al.
10,655,427 B2 5/2020 Schultz et al.
10,738,564 B2 8/2020 Watson et al.
2005/0184083 A1 8/2005 Diaz et al.
2006/0113077 A1 6/2006 Willberg et al.
2006/0169449 A1 8/2006 Mang et al.
2006/0213662 A1 9/2006 Creel et al.
2007/0169935 A1 7/2007 Akbar et al.
2008/0000639 A1 1/2008 Clark et al.
2008/0148994 A1 6/2008 Magnin
2008/0196896 A1 8/2008 Bustos et al.
2008/0200352 A1 8/2008 Willberg et al.
2008/0209243 A1 8/2008 Ghiasi et al.
2010/0122813 A1 5/2010 Trummer et al.
2010/0147886 A1 6/2010 Witkowski et al.
2010/0152070 A1 6/2010 Ghassemzadeh
2011/0048712 A1 3/2011 Barbee
2011/0226479 A1 9/2011 Tippel et al.
2011/0278011 A1 * 11/2011 Crainich, Jr. ..... C08L 69/00 166/310
2011/0297396 A1 12/2011 Hendel et al.
2012/0085548 A1 4/2012 Fleckenstein et al.
2012/0181032 A1 7/2012 Naedler et al.
2012/0211219 A1 * 8/2012 McGuire ..... E21B 33/05 166/75.15
2012/0285695 A1 11/2012 Lafferty et al.
2013/0098600 A1 4/2013 Roberts
2013/0199800 A1 * 8/2013 Kellner ..... E21B 34/102 166/386
2013/0233553 A1 9/2013 Burgrin et al.
2014/0022364 A1 1/2014 Rodriguez et al.
2014/0022537 A1 1/2014 Samson et al.
2014/0116712 A1 5/2014 Bansal et al.
2014/0274815 A1 9/2014 Lovett et al.
2014/0299334 A1 10/2014 Hallundbaek et al.
2015/0060072 A1 3/2015 Busby et al.
2015/0075793 A1 3/2015 Dotson et al.
2015/0083423 A1 3/2015 Brannon et al.
2015/0090453 A1 4/2015 Tolman et al.
2015/0122364 A1 5/2015 Cheatham, III et al.
2016/0251930 A1 9/2016 Jacob et al.
2016/0319630 A1 11/2016 Watson et al.
2017/0030169 A1 2/2017 Funkhouser et al.
2017/0107784 A1 4/2017 Watson et al.
2017/0107785 A1 4/2017 Schultz et al.
2017/0107786 A1 4/2017 Schultz et al.
2017/0253788 A1 * 9/2017 Ivanov ..... C09K 8/03
2017/0260828 A1 9/2017 Watson et al.
2017/0275961 A1 9/2017 Schultz et al.
2017/0275965 A1 9/2017 Watson et al.
2017/0292343 A1 10/2017 Watson et al.
2017/0292344 A1 10/2017 Watson et al.
2017/0335651 A1 11/2017 Watson et al.
2018/0128133 A1 5/2018 Rehm
2018/0135394 A1 5/2018 Tolman
2018/0245439 A1 8/2018 Entchev et al.

OTHER PUBLICATIONS

Australian Examination Report dated Nov. 2, 2018 for AU Patent Application No. 2017219089, 5 pages.
Canadian Office Action dated Nov. 23, 2018 for CA Patent Application No. 2,995,533, 4 pages.
GCC Examination Report dated Feb. 4, 2019 for GCC Patent Application No. 2016-31243, 4 pages.
Australian Examination Report dated Jul. 11, 2018 for AU Patent Application No. 2015393421, 3 pages.
Canadian Office Action dated Nov. 30, 2018 for CA Patent Application No. 2,957,681, 3 pages.
Canadian Office Action dated Dec. 13, 2017 for CA Patent Application No. 2,957,681, 3 pages.
Office Action dated Nov. 15, 2017 for U.S. Appl. No. 15/347,535, 14 pages.
GCC Examination Report dated Feb. 3, 2019 for GCC Patent Application No. 2016-31242, 4 pages.
Australian Examination Report dated Nov. 14, 2018 for AU Patent Application No. 2017218948, 5 pages.
Office Action dated Dec. 13, 2018 for U.S. Appl. No. 15/390,941, 11 pages.
GCC Examination Report dated Jul. 18, 2018 for GCC Patent Application No. 2016-31224, 4 pages.
Australian Examination Report dated Feb. 18, 2019 for AU Patent Application No. 2017219082, 3 pages.
Office Action dated Mar. 28, 2018 for U.S. Appl. No. 15/390,976, 10 pages.
GCC Examination Report dated Jul. 18, 2018 for GCC Patent Application No. 2016-31223, 4 pages.
GCC Examination Report dated Dec. 24, 2018 for GCC Patent Application No. 2016-31223, 4 pages.
Office Action dated Mar. 28, 2018 for U.S. Appl. No. 15/391,014, 14 pages.
GCC Examination Report dated May 28, 2018 for GCC Patent Application No. 2016-31218, 4 pages.
Australian Examination Report dated Feb. 18, 2019 for AU Patent Application No. 2017279758, 3 pages.
Office Action dated Jan. 29, 2019 for U.S. Appl. No. 15/622,016, 22 pages.
Office Action dated Mar. 29, 2018 for U.S. Appl. No. 15/622,016, 28 pages.

(56) References Cited

OTHER PUBLICATIONS

Office Action dated Nov. 13, 2017 for U.S. Appl. No. 15/622,016, 44 pages.
GCC Examination Report dated May 28, 2018 for GCC Patent Application No. 2016-31220, 4 pages.
Office Action dated Feb. 11, 2019 for U.S. Appl. No. 16/214,174, 17 pages.
Office Action dated Feb. 4, 2019 for U.S. Appl. No. 15/567,779, 58 pages.
Office Action dated Feb. 11, 2019 for U.S. Appl. No. 16/238,838, 25 pages.
Australian Examination Report dated Feb. 26, 2019 for AU Patent Application No. 2017276220, 4 pages.
GCC Examination Report dated May 27, 2018 for GCC Patent Application No. 2016-31217, 4 pages.
Office Action dated Apr. 20, 2018 for U.S. Appl. No. 15/138,685, 27 pages.
Office Action dated Nov. 3, 2017 for U.S. Appl. No. 15/138,685, 15 pages.
Office Action dated Mar. 18, 2019 for U.S. Appl. No. 15/658,697, 34 pages.
Office Action dated Jun. 11, 2018 for U.S. Appl. No. 15/658,697, 52 pages.
Office Action dated Oct. 9, 2018 for U.S. Appl. No. 15/658,697, 24 pages.
International Search Report with Written Opinion dated Aug. 1, 2018 for PCT Patent Application No. PCT/US2018/029395, 20 pages.
GCC Examination Report dated Apr. 28, 2018 for GCC Patent Application No. 2016-31216, 4 pages.
Office Action dated Mar. 18, 2019 for U.S. Appl. No. 15/726,160, 62 pages.
Office Action dated Mar. 30, 2018 for U.S. Appl. No. 15/615,136, 28 pages.
International Search Report with Written Opinion dated Aug. 2, 2018 for PCT Patent Application No. PCT/US2018/029383, 20 pages.
Canadian Office Action dated Apr. 11, 2019 for CA Patent Application No. 2,992,712, 4 pages.
Canadian Office Action dated Oct. 16, 2018 for CA Patent Application No. 2,992,712, 5 pages.
Office Action dated Nov. 13, 2017 for U.S. Appl. No. 15/615,136, 34 pages.
GCC Examination Report dated Jun. 3, 2018 for GCC Patent Application No. 2016-31222, 4 pages.
GCC Examination Report dated Dec. 23, 2018 for GCC Patent Application No. 2016-31222, 4 pages.
International Search Report with Written Opinion dated Dec. 3, 2018 for PCT Patent Application No. PCT/US2017/059644, 20 pages.
International Search Report with Written Opinion dated Feb. 1, 2018 for PCT Patent Application No. PCT/US2016/029357, 15 pages.
GCC Examination Report dated Dec. 24, 2018 for GCC Patent Application No. 2016-31224, 4 pages.
Office Action dated Mar. 20, 2019 for U.S. Appl. No. 15/432,041, 39 pages.
Office Action dated Apr. 30, 2018 for U.S. Appl. No. 15/432,041, 51 pages.
Office Action dated Nov. 7, 2017 for U.S. Appl. No. 15/162,334, 16 pages.
Perf Sealers; "History of Perforation Ball Sealers in the Oil and Gas Industry", Web article via https://www.perfsealers.com/history-of-perforation-ball-sealers/ (year: 2014), dated 2014-2019, 4 pages.
Australian Examination Report dated Jun. 9, 2020 for AU Patent Application No. 2016297438, 5 pages.
Canadian Examination Report dated May 28, 2020 for CA Patent Application No. 2016297438, 5 pages.
U.S. Notice Of Allowance dated Jun. 17, 2020 for U.S. Appl. No. 15/745,608, 16 pages.
Examiner's Report dated Jan. 14, 2021 for CA Patent Application No. 3,064,076, 4 pages.
Canadian Office Action dated Dec. 9, 2019 for CA Patent Application No. 3,019,772, 4 pages.
Office Action dated Sep. 16, 2019 for U.S. Appl. No. 15/609,671, 39 pages.
Office Action dated Oct. 23, 2019 for U.S. Appl. No. 15/745,608, 69 pages.
Lexico Dictionary; "body", Definition of body in English, dated Sep. 17, 2019, 7 pages.
Lexico Dictionary; "knot", Main definitions of knot in English, dated Sep. 17, 2019, 8 pages.
Examiner's Answer dated Sep. 25, 2019 for U.S. Appl. No. 15/658,697, 26 pages.
Office Action dated Oct. 11, 2019 for U.S. Appl. No. 15/567,779, 33 pages.
Argentina Office Action dated Aug. 13, 2020 for AR Patent Application No. 20160101168, 5 pages.
Canadian Office Action dated Aug. 2, 2019 for CA Patent Application No. 3,019,772, 5 pages.
GCC Examination Report dated Jun. 17, 2019 for GCC Patent Application No. 2016-36182, 3 pages.
GCC Examination Report dated Mar. 6, 2019 for GCC Patent Application No. 2017-34211, 4 pages.
Office Action dated May 29, 2019 for U.S. Appl. No. 16/214,174, 26 pages.
Office Action dated May 29, 2019 for U.S. Appl. No. 15/567,779, 18 pages.
Oxford Dictionaries; "Definition of Body in English", dated May 23, 2019, 7 pages.
Merriam Webster; "Definition of Bundle", dated Nov. 7, 2017, 13 pages.
The Free Dictionary; "Definition of Bundle", dated Nov. 7, 2017, 10 pages.
Office Action dated Sep. 21, 2020 for U.S. Appl. No. 16/987,094, 60 pages.
Office Action dated Oct. 2, 2020 for U.S. Appl. No. 16/264,758, 9 pages.
Office Action dated Sep. 1, 2021 for U.S. Appl. No. 16/931,322, 11 pages.

* cited by examiner

PLUGGING DEVICE DEPLOYMENT

CROSS-REFERENCE TO RELATED APPLICATIONS

This application is 1) a continuation of International Application No. PCT/US17/59644, filed on 2 Nov. 2017, which claims the benefit of the filing date of U.S. provisional application No. 62/419,109 filed 8 Nov. 2016, and 2) a continuation-in-part of U.S. application Ser. No. 15/745,608 filed 17 Jan. 2018, which is a national stage of International Application No. PCT/US16/29357 filed 26 Apr. 2016, which claims the benefit of the filing date of U.S. provisional application No. 62/195,078 filed 21 Jul. 2015. The entire disclosures of these prior applications are incorporated herein by this reference.

BACKGROUND

This disclosure relates generally to equipment utilized and operations performed in conjunction with a subterranean well and, in examples described below, more particularly provides for deployment of plugging devices into wells.

It can be beneficial to be able to control how and where fluid flows in a well. For example, it may be desirable in some circumstances to be able to prevent fluid from flowing into a particular formation zone. As another example, it may be desirable in some circumstances to cause fluid to flow into a particular formation zone, instead of into another formation zone. Therefore, it will be readily appreciated that improvements are continually needed in the art of controlling fluid flow in wells.

DETAILED DESCRIPTION

Figure 1:
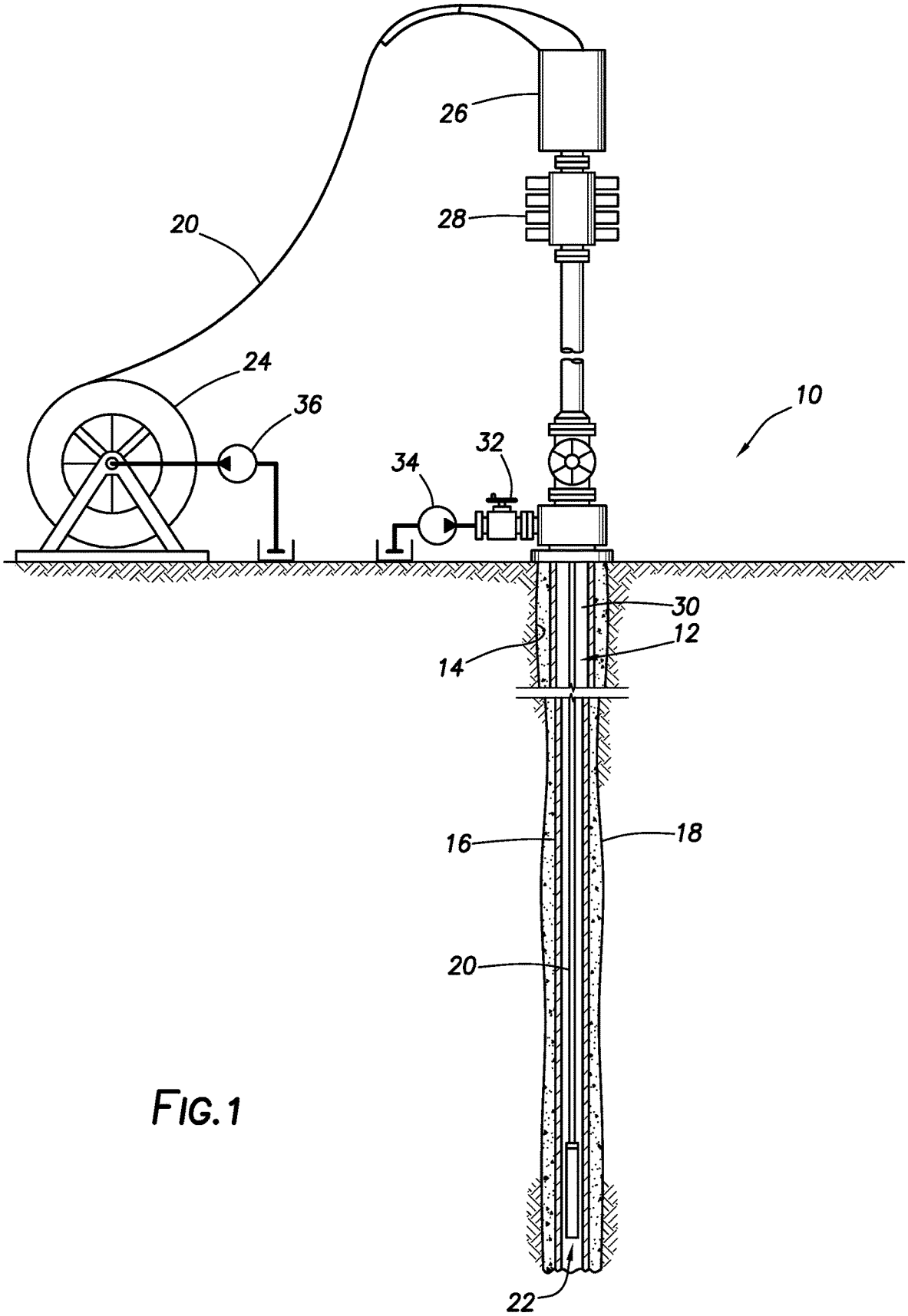
FIG. 1 is a representative partially cross-sectional view of an example of a well system and associated method which can embody principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is conveyed into a wellbore 14 lined with casing 16 and cement 18. Although multiple casing strings would typically be used in actual practice, for clarity of illustration only one casing string 16 is depicted in the drawings.

Although the wellbore 14 is illustrated as being vertical, sections of the wellbore could instead be horizontal or otherwise inclined relative to vertical. Although the wellbore 14 is completely cased and cemented as depicted in FIG. 1, any sections of the wellbore in which operations described in more detail below are performed could be uncased or open hole. Thus, the scope of this disclosure is not limited to any particular details of the system 10 and method.

The tubular string 12 of FIG. 1 comprises coiled tubing 20 and a bottom hole assembly 22. As used herein, the term "coiled tubing" refers to a substantially continuous tubing that is stored on a spool or reel 24. The reel 24 could be mounted, for example, on a skid, a trailer, a floating vessel, a vehicle, etc., for transport to a wellsite. Although not shown in FIG. 1, a control room or cab would typically be provided with instrumentation, computers, controllers, recorders, etc., for controlling equipment such as an injector 26 and a blowout preventer stack 28.

As used herein, the term "bottom hole assembly" refers to an assembly connected at a distal end of a tubular string in a well. It is not necessary for a bottom hole assembly to be positioned or used at a "bottom" of a hole or well.

When the tubular string 12 is positioned in the wellbore 14, an annulus 30 is formed radially between them. Fluid, slurries, etc., can be flowed from surface into the annulus 30 via, for example, a casing valve 32. One or more pumps 34 may be used for this purpose. Fluid can also be flowed to surface from the wellbore 14 via the annulus 30 and valve 32.

Fluid, slurries, etc., can also be flowed from surface into the wellbore 14 via the tubing 20, for example, using one or more pumps 36. Fluid can also be flowed to surface from the wellbore 14 via the tubing 20.

In the further description below of the examples of FIGS. 2A-9, one or more flow conveyed plugging devices are used to block or plug openings in the system 10 of FIG. 1. However, it should be clearly understood that these methods and the flow conveyed plugging device may be used with other systems, and the flow conveyed plugging device may be used in other methods in keeping with the principles of this disclosure.

The example methods described below allow existing fluid passageways to be blocked permanently or temporarily in a variety of different applications. Certain flow conveyed plugging device examples described below are made of a fibrous material and comprise a "knot" or other enlarged geometry.

The devices are conveyed into leak paths using pumped fluid. The fibrous material "finds" and follows the fluid flow, pulling the enlarged geometry into a restricted portion of a flow path, causing the enlarged geometry and additional strands or fibers to become tightly wedged into the flow path, thereby sealing off fluid communication.

The devices can be made of degradable or non-degradable materials. The degradable materials can be either self-degrading, or can require degrading treatments, such as, by exposing the materials to certain acids, certain base compositions, certain chemicals, certain types of radiation (e.g., electromagnetic or "nuclear"), or elevated temperature. The exposure can be performed at a desired time using a form of well intervention, such as, by spotting or circulating a fluid in the well so that the material is exposed to the fluid.

In some examples, the material can be an acid degradable material (e.g., nylon, etc.), a mix of acid degradable material (for example, nylon fibers mixed with particulate such as calcium carbonate), self-degrading material (e.g., poly-lactic acid (PLA), poly-glycolic acid (PGA), etc.), material that degrades by galvanic action (such as, magnesium alloys, aluminum alloys, etc.), a combination of different self-degrading materials, or a combination of self-degrading and non-self-degrading materials.

Multiple materials can be pumped together or separately. For example, nylon and calcium carbonate could be pumped as a mixture, or the nylon could be pumped first to initiate a seal, followed by calcium carbonate to enhance the seal.

In certain examples described below, the device can be made of knotted fibrous materials. Multiple knots can be used with any number of loose ends. The ends can be frayed or un-frayed. The fibrous material can be rope, fabric, cloth or another woven or braided structure.

The device can be used to block open sleeve valves, perforations or any leak paths in a well (such as, leaking connections in casing, corrosion holes, etc.). Any opening through which fluid flows can be blocked with a suitably configured device.

In one example method described below, a well with an existing perforated zone can be re-completed. Devices (either degradable or non-degradable) are conveyed by flow to plug all existing perforations.

The well can then be re-completed using any desired completion technique. If the devices are degradable, a degrading treatment can then be placed in the well to open up the plugged perforations (if desired).

In another example method described below, multiple formation zones can be perforated and fractured (or otherwise stimulated, such as, by acidizing) in a single trip of the bottom hole assembly 22 into the well. In the method, one zone is perforated, the zone is fractured or otherwise stimulated, and then the perforated zone is plugged using one or more devices.

These steps are repeated for each additional zone, except that a last zone may not be plugged. All of the plugged zones are eventually unplugged by waiting a certain period of time (if the devices are self-degrading), by applying an appropriate degrading treatment, or by mechanically removing the devices.

Referring specifically now to FIGS. 2A-D, steps in an example of a method in which the bottom hole assembly 22 of FIG. 1 can be used in re-completing a well are representatively illustrated. In this method (see FIG. 2A), the well has existing perforations 38 that provide for fluid communication between an earth formation zone 40 and an interior of the casing 16. However, it is desired to re-complete the zone 40, in order to enhance the fluid communication.

Figure 2A:
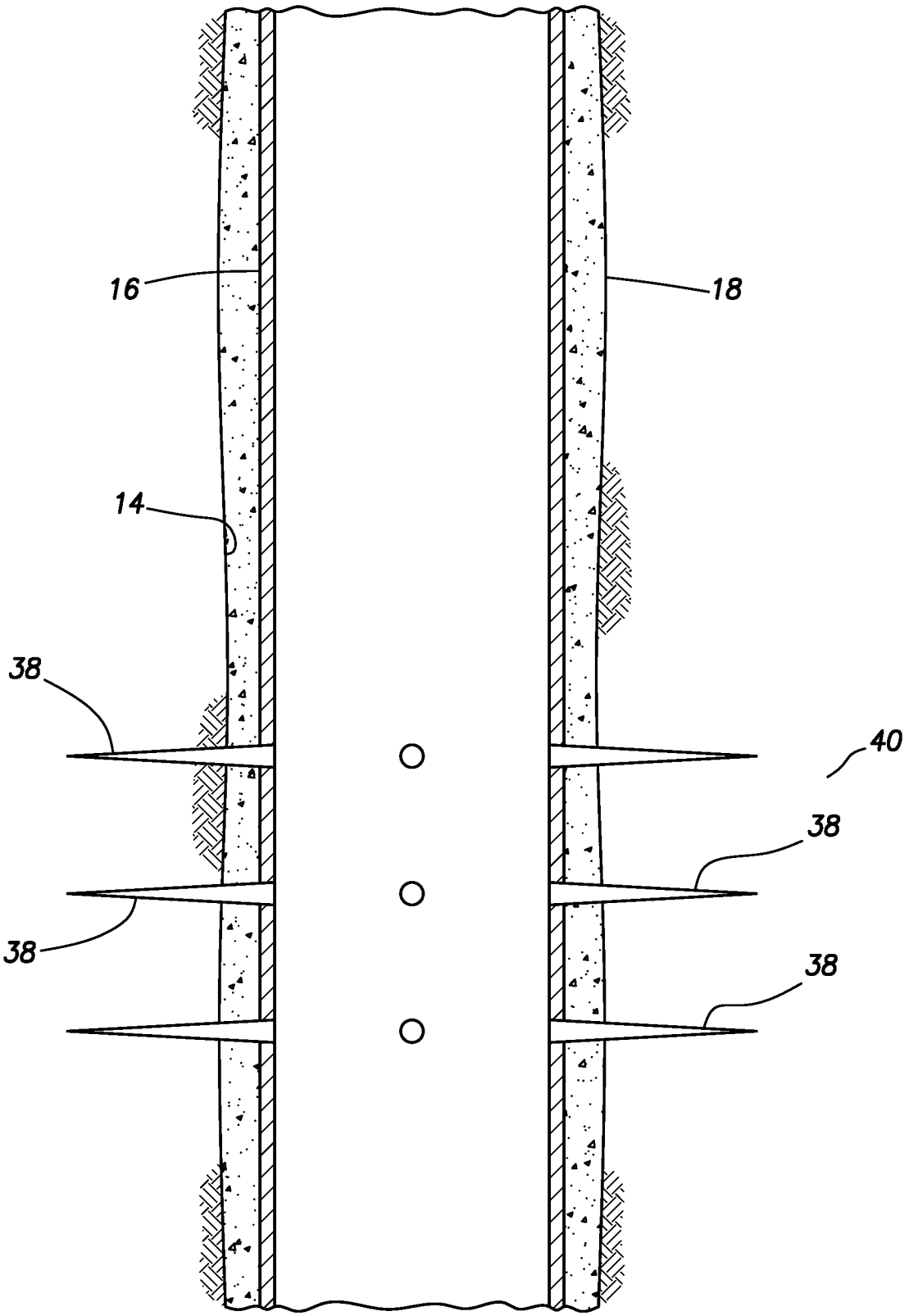
FIGS. 2A-D are enlarged scale representative partially cross-sectional views of steps in an example of a re-completion method that may be practiced with the system of FIG. 1.
Figure 2B:
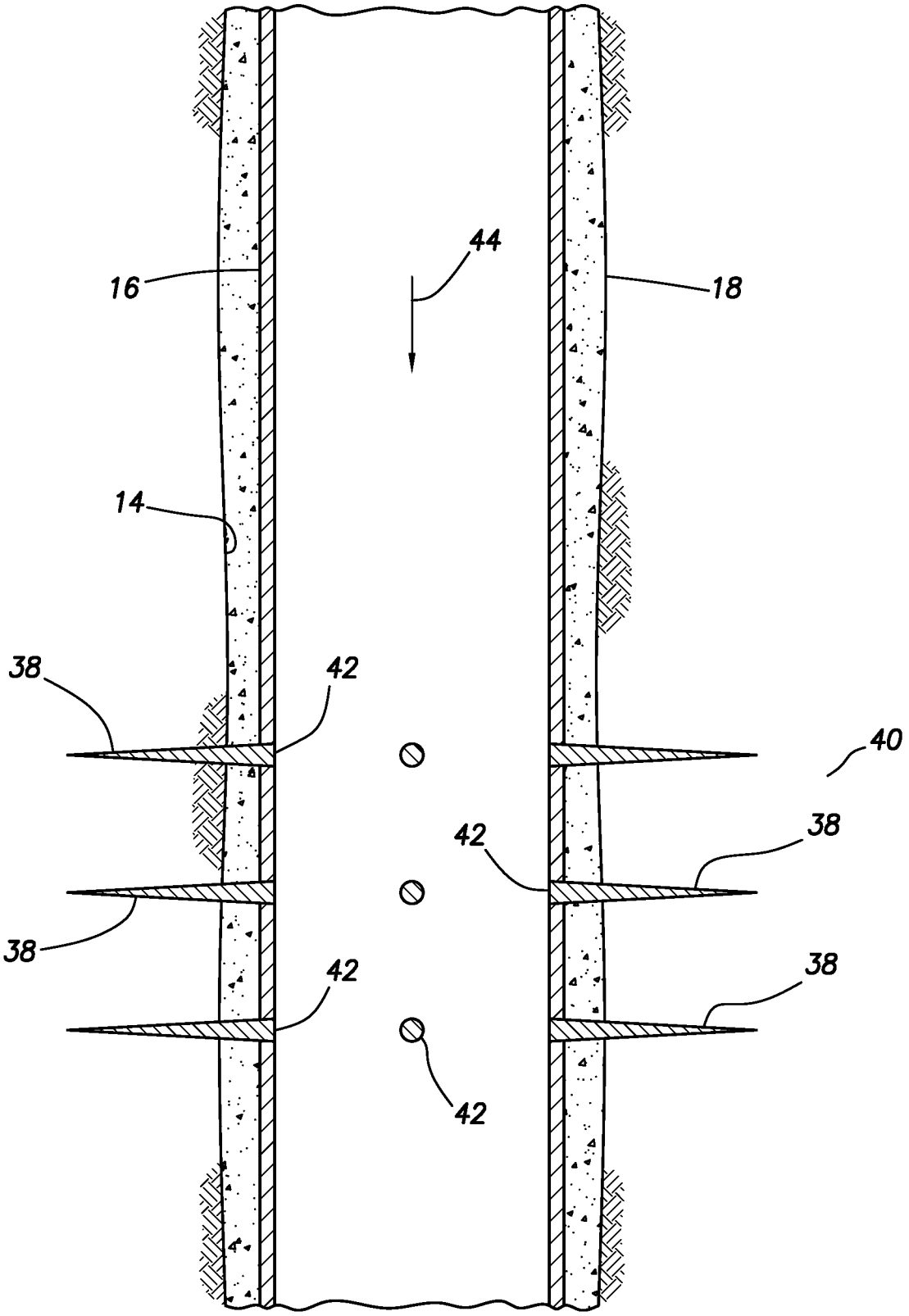

Referring additionally now to FIG. 2B, the perforations 38 are plugged, thereby preventing flow through the perforations into the zone 40. Plugs 42 in the perforations can be flow conveyed plugging devices, as described more fully below. In that case, the plugs 42 can be conveyed through the casing 16 and into engagement with the perforations 38 by fluid flow 44.

Figure 2C:
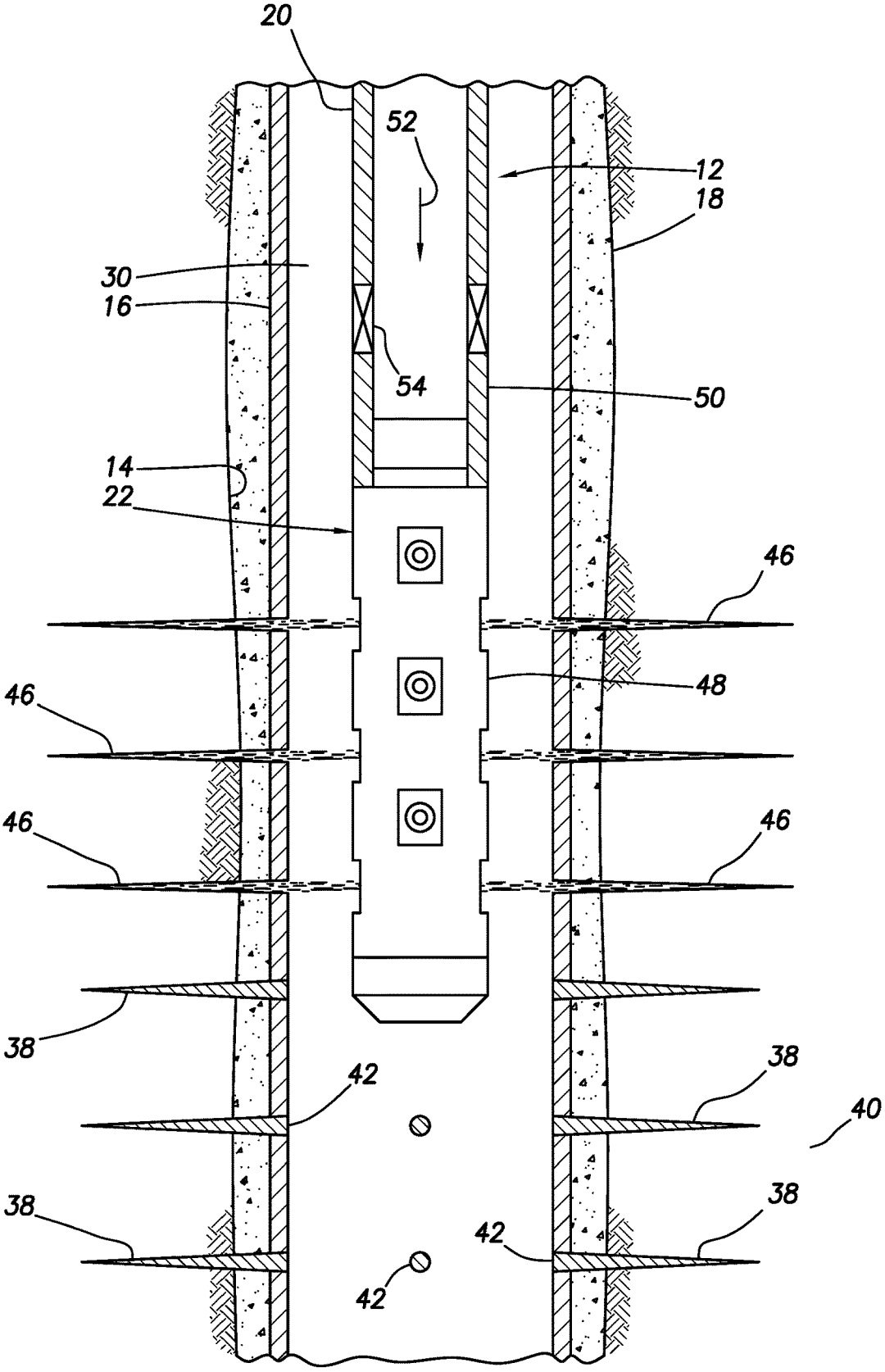

Referring additionally now to FIG. 2C, new perforations 46 are formed through the casing 16 and cement 18 by use of an abrasive jet perforator 48. In this example, the bottom hole assembly 22 includes the perforator 48 and a circulating valve assembly 50. Although the new perforations 46 are depicted as being formed above the existing perforations 38, the new perforations could be formed in any location in keeping with the principles of this disclosure.

Note that other means of providing perforations 46 may be used in other examples. Explosive perforators, drills, etc., may be used if desired. The scope of this disclosure is not limited to any particular perforating means, or to use with perforating at all.

The circulating valve assembly 50 controls flow between the coiled tubing 20 and the perforator 48, and controls flow between the annulus 30 and an interior of the tubular string 12. Instead of conveying the plugs 42 into the well via flow 44 through the interior of the casing 16 (see FIG. 2B), in other examples the plugs could be deployed into the tubular string 12 and conveyed by fluid flow 52 through the tubular string prior to the perforating operation. In that case, a valve 54 of the circulating valve assembly 50 could be opened to allow the plugs 42 to exit the tubular string 12 and flow into the interior of the casing 16 external to the tubular string.

Figure 2D:
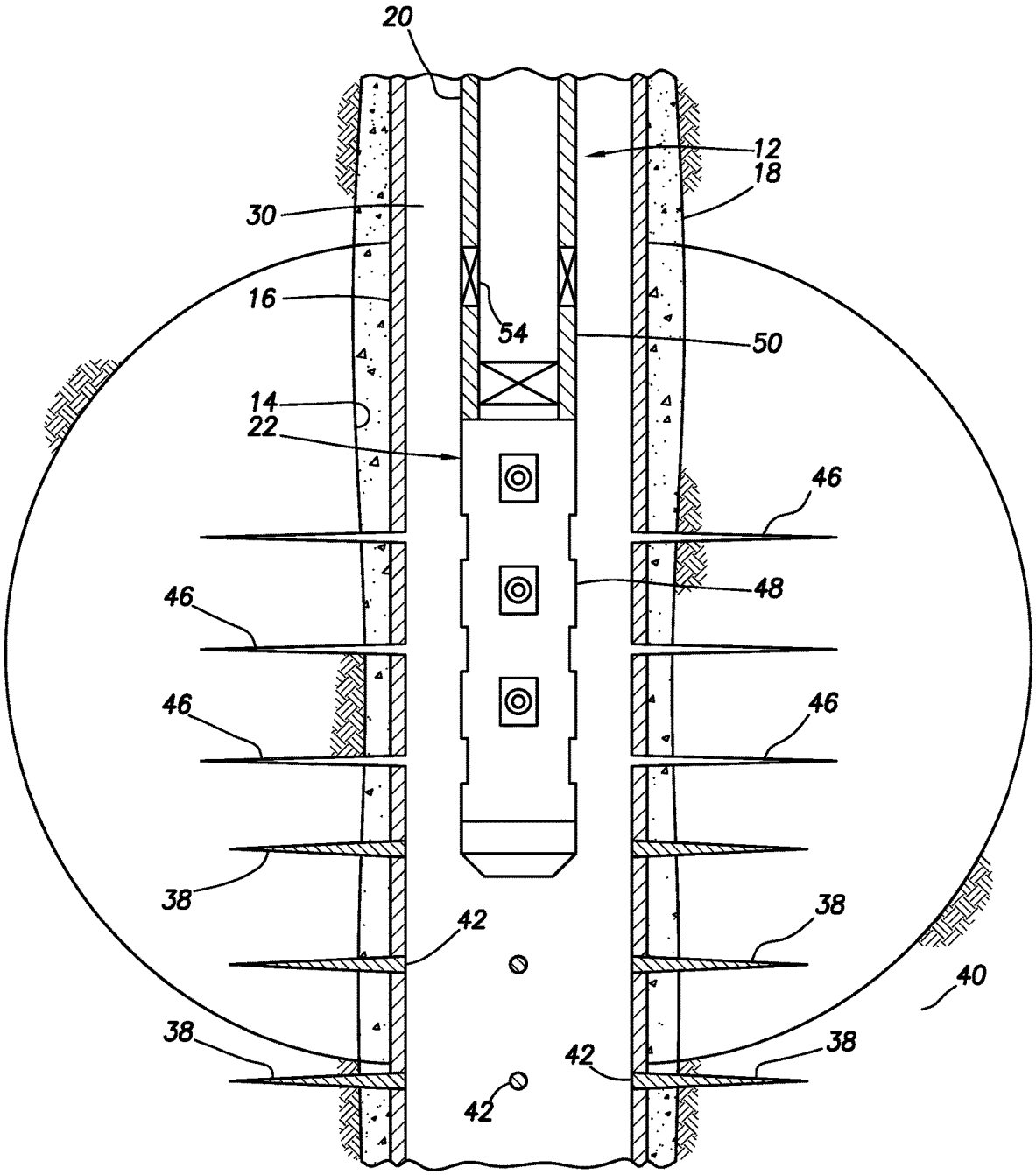

Referring additionally now to FIG. 2D, the zone 40 has been fractured or otherwise stimulated by applying increased pressure to the zone after the perforating operation. Enhanced fluid communication is now permitted between the zone 40 and the interior of the casing 16. Note that fracturing is not necessary in keeping with the principles of this disclosure.

In the FIG. 2D example, the plugs 42 prevent the pressure applied to stimulate the zone 40 via the perforations 46 from leaking into the zone via the perforations 38. The plugs 42 may remain in the perforations 38 and continue to prevent flow through the perforations, or the plugs may degrade, if desired, so that flow is eventually permitted through the perforations.

Referring additionally now to FIGS. 3A-D, steps in another example of a method in which the bottom hole assembly 22 of FIG. 1 can be used in completing multiple zones 40*a-c* of a well are representatively illustrated. The multiple zones 40*a-c* are each perforated and fractured during a single trip of the tubular string 12 into the well.

Figure 3A:
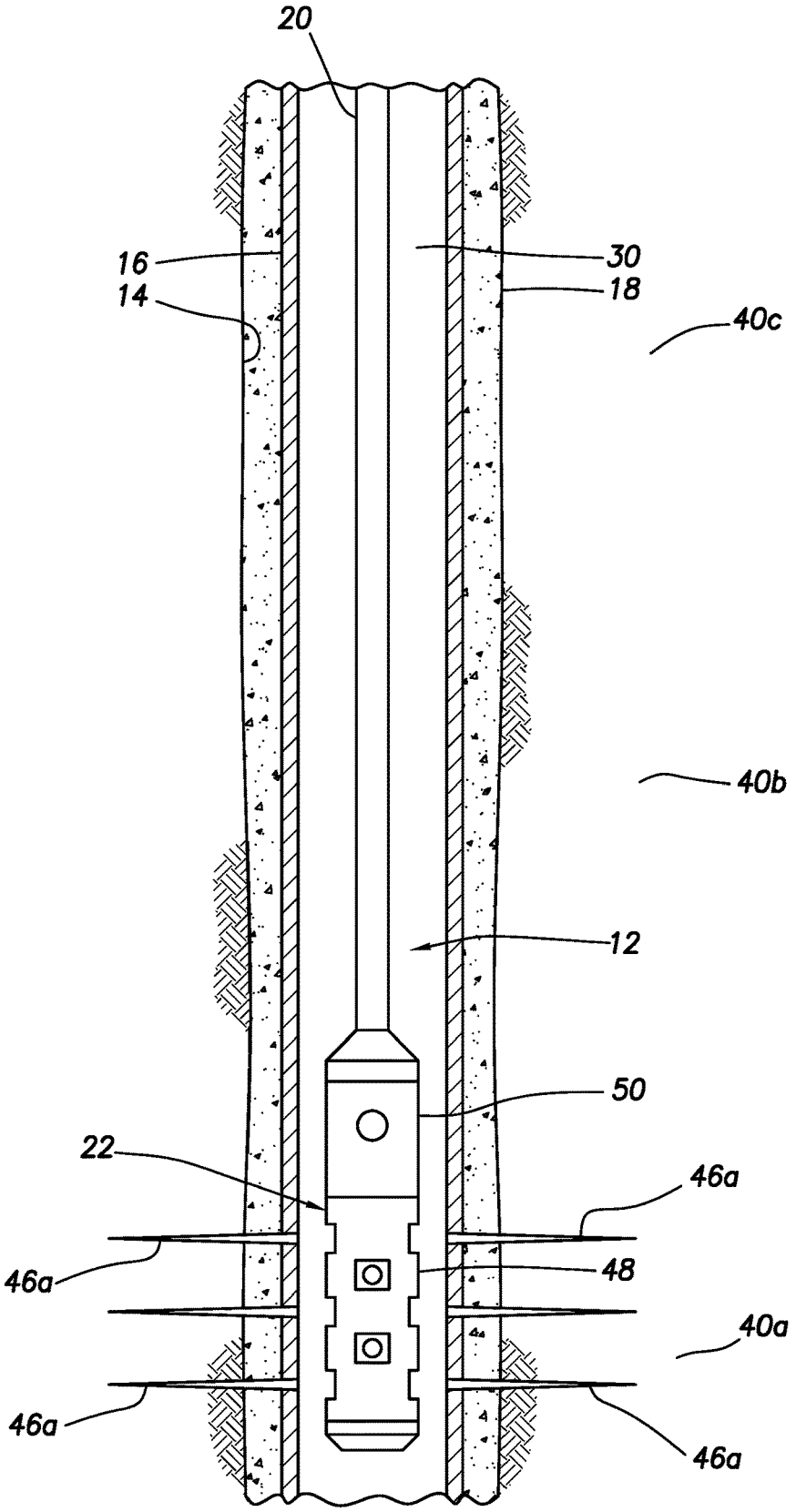
FIGS. 3A-D are representative partially cross-sectional views of steps in another example of a method that may be practiced with the system of FIG. 1.

In FIG. 3A, the tubular string 12 has been deployed into the casing 16, and has been positioned so that the perforator 48 is at the first zone 40*a* to be completed. The perforator 48 is then used to form perforations 46*a* through the casing 16 and cement 18, and into the zone 40*a*.

Figure 3B:
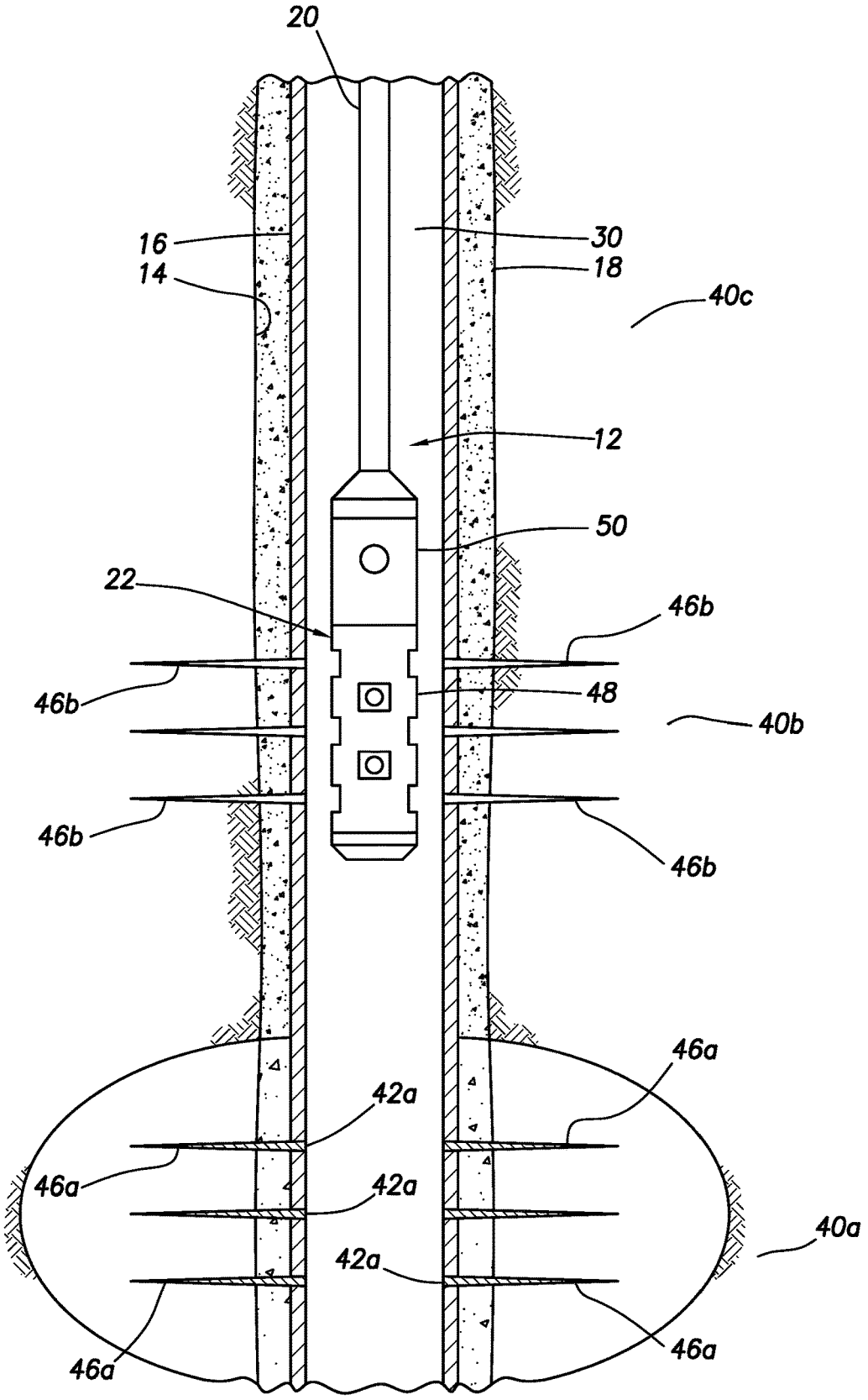

In FIG. 3B, the zone 40*a* has been fractured by applying increased pressure to the zone via the perforations 46*a*. The fracturing pressure may be applied, for example, via the annulus 30 from the surface (e.g., using the pump 34 of FIG. 1), or via the tubular string 12 (e.g., using the pump 36 of FIG. 1). The scope of this disclosure is not limited to any particular fracturing means or technique, or to the use of fracturing at all.

After fracturing of the zone 40*a*, the perforations 46*a* are plugged by deploying plugs 42*a* into the well and conveying them by fluid flow into sealing engagement with the perforations. The plugs 42*a* may be conveyed by flow 44 through the casing 16 (e.g., as in FIG. 2B), or by flow 52 through the tubular string 12 (e.g., as in FIG. 2C).

The tubular string 12 is repositioned in the casing 16, so that the perforator 48 is now located at the next zone 40*b* to be completed. The perforator 48 is then used to form perforations 46*b* through the casing 16 and cement 18, and into the zone 40*b*. The tubular string 12 may be repositioned before or after the plugs 42*a* are deployed into the well.

Figure 3C:
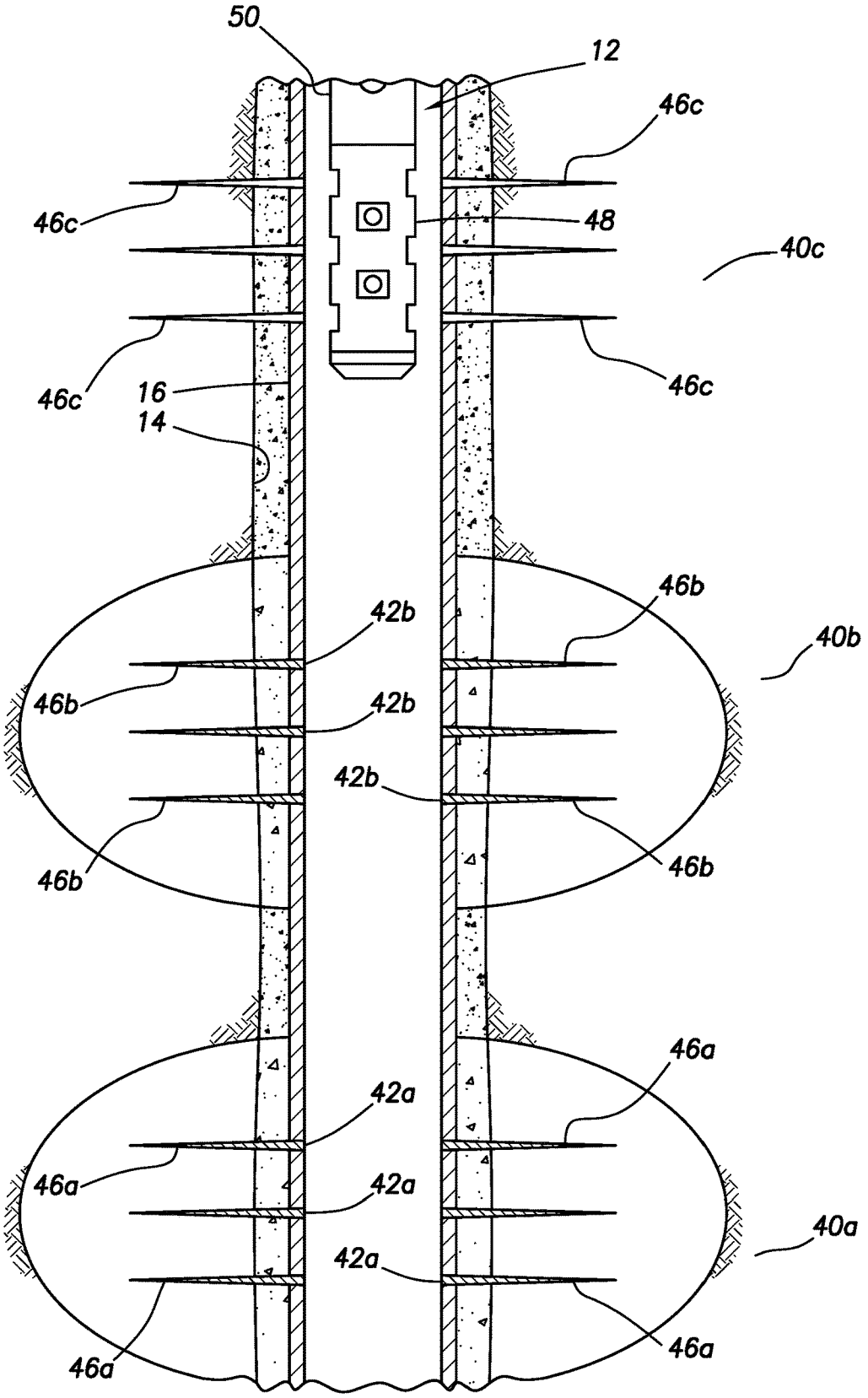

In FIG. 3C, the zone 40*b* has been fractured or otherwise stimulated by applying increased pressure to the zone via the perforations 46*b*. The pressure may be applied, for example, via the annulus 30 from the surface (e.g., using the pump 34 of FIG. 1), or via the tubular string 12 (e.g., using the pump 36 of FIG. 1).

After stimulation of the zone 40*b*, the perforations 46*b* are plugged by deploying plugs 42*b* into the well and conveying them by fluid flow into sealing engagement with the perforations. The plugs 42*b* may be conveyed by flow 44 through the casing 16, or by flow 52 through the tubular string 12.

The tubular string 12 is repositioned in the casing 16, so that the perforator 48 is now located at the next zone 40*c* to be completed. The perforator 48 is then used to form perforations 46*c* through the casing 16 and cement 18, and into the zone 40*c*. The tubular string 12 may be repositioned before or after the plugs 42*b* are deployed into the well.

Figure 3D:
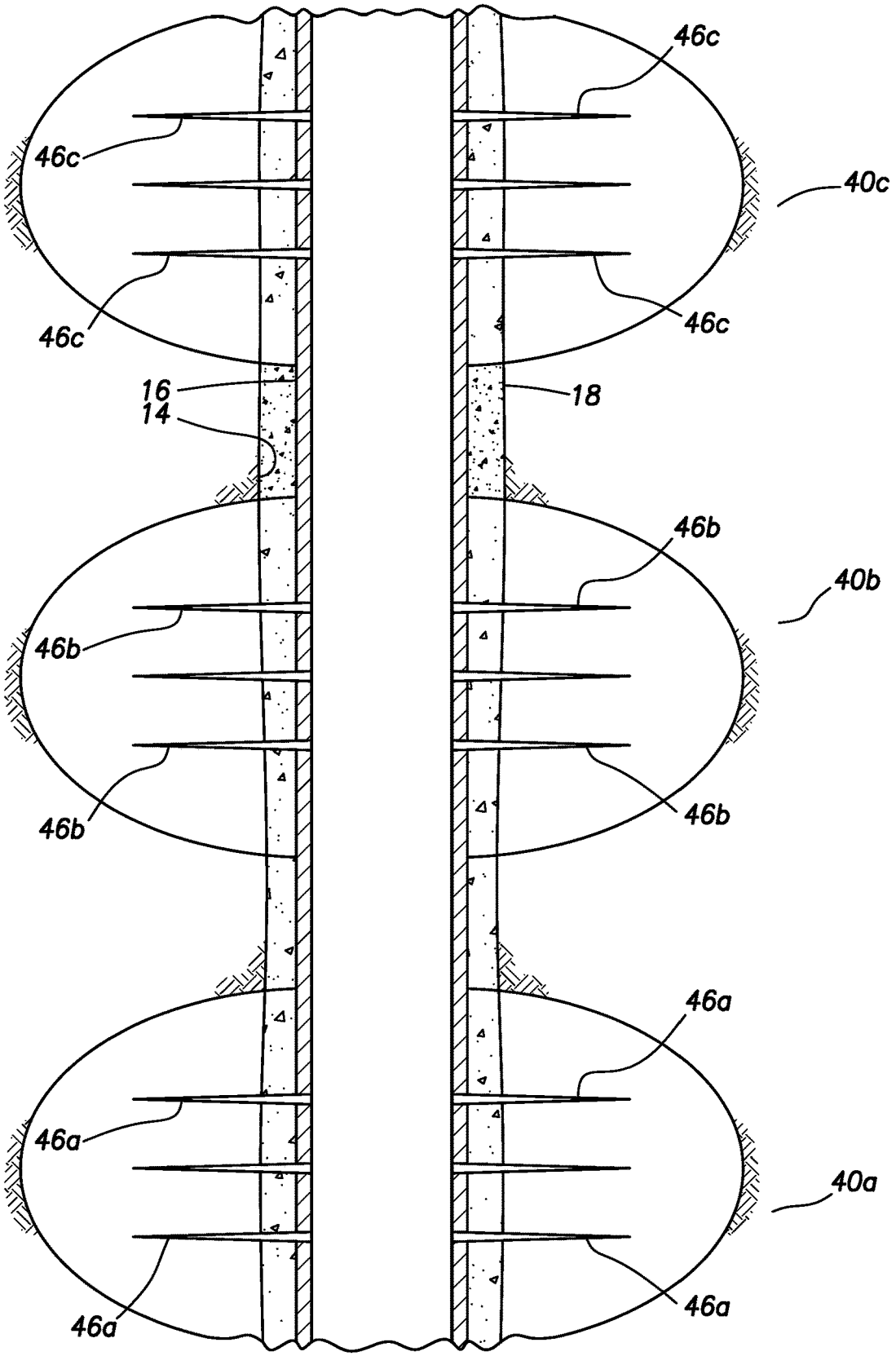

In FIG. 3D, the zone 40*c* has been fractured or otherwise stimulated by applying increased pressure to the zone via the perforations 46*c*. The pressure may be applied, for example, via the annulus 30 from the surface (e.g., using the pump 34 of FIG. 1), or via the tubular string 12 (e.g., using the pump 36 of FIG. 1).

After stimulation of the zone 40*c*, the perforations 46*c* could be plugged, if desired. For example, the perforations 46*c* could be plugged in order to verify that the plugs are properly blocking flow from the casing 16 to the zones 40*a-c*.

As depicted in FIG. 3D, the plugs 42*a,b* are degraded and no longer prevent flow through the perforations 46*a,b*. Thus, as depicted in FIG. 3D, flow is permitted between the interior of the casing 16 and each of the zones 40*a-c*.

The plugs 42*a,b* may be degraded in any manner. The plugs 42*a,b* may degrade in response to application of a degrading treatment, in response to passage of a certain period of time, or in response to exposure to elevated downhole temperature. The degrading treatment could include exposing the plugs 42*a,b* to a particular type of radiation, such as electromagnetic radiation (e.g., light having a certain wavelength or range of wavelengths, gamma rays, etc.) or "nuclear" particles (e.g., gamma, beta, alpha or neutron).

The plugs 42*a,b* may degrade by galvanic action or by dissolving. The plugs 42*a,b* may degrade in response to exposure to a particular fluid, either naturally occurring in the well (such as water or hydrocarbon fluid), or introduced therein.

The plugs 42*a,b* may be mechanically removed, instead of being degraded. The plugs 42*a,b* may be cut using a cutting tool (such as a mill or overshot), or an appropriately configured tool may be used to grab and pull the plugs from the perforations.

Note that any number of zones may be completed in any order in keeping with the principles of this disclosure. The zones 40*a-c* may be sections of a single earth formation, or they may be sections of separate formations.

Figure 4A:
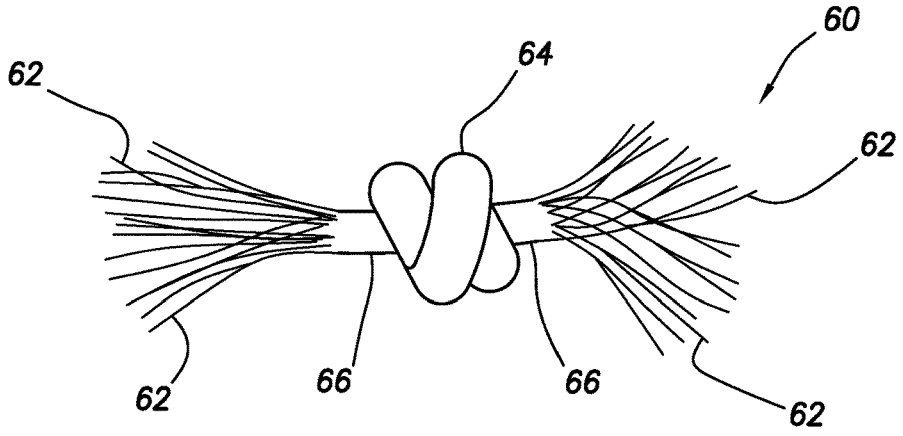
FIGS. 4A & B are enlarged scale representative elevational views of examples of a flow conveyed plugging device that may be used in the system and methods of FIGS. 1-3D, and which can embody the principles of this disclosure.

Referring additionally now to FIG. 4A, an example of a flow conveyed plugging device 60 that can incorporate the principles of this disclosure is representatively illustrated. The device 60 may be used for any of the plugs 42, 42*a,b* described above in the method examples of FIGS. 2A-3D, or the device may be used in other methods.

The device 60 example of FIG. 4A includes multiple fibers 62 extending outwardly from an enlarged body 64. As depicted in FIG. 4A, each of the fibers 62 has a lateral dimension (e.g., a thickness or diameter) that is substantially smaller than a size (e.g., a thickness or diameter) of the body 64.

The body 64 can be dimensioned so that it will effectively engage and seal off a particular opening in a well. For example, if it is desired for the device 60 to seal off a perforation in a well, the body 64 can be formed so that it is somewhat larger than a diameter of the perforation. If it is desired for multiple devices 60 to seal off multiple openings having a variety of dimensions (such as holes caused by corrosion of the casing 16), then the bodies 64 of the devices can be formed with a corresponding variety of sizes.

In the FIG. 4A example, the fibers 62 are joined together (e.g., by braiding, weaving, cabling, etc.) to form lines 66 that extend outwardly from the body 64. In this example, there are two such lines 66, but any number of lines (including one) may be used in other examples.

The lines 66 may be in the form of one or more ropes, in which case the fibers 62 could comprise frayed ends of the rope(s). In addition, the body 64 could be formed by one or more knots in the rope(s). In some examples, the body 64 can comprise a fabric or cloth, the body could be formed by one or more knots in the fabric or cloth, and the fibers 62 could extend from the fabric or cloth. The body 64 could be formed from a single sheet of material or from multiple strips of sheet material.

In the FIG. 4A example, the body 64 is formed by a double overhand knot in a rope, and ends of the rope are frayed, so that the fibers 62 are splayed outward. In this manner, the fibers 62 will cause significant fluid drag when the device 60 is deployed into a flow stream, so that the device will be effectively "carried" by, and "follow," the flow.

However, it should be clearly understood that other types of bodies and other types of fibers may be used in other examples. The body 64 could have other shapes, the body could be hollow or solid, and the body could be made up of one or multiple materials. The fibers 62 are not necessarily joined by lines 66, and the fibers are not necessarily formed by fraying ends of ropes or other lines.

The body 64 is not necessarily formed from the same material as the lines 66. The body 64 could comprise a relatively large solid object, with the lines 66 (such as, fibers, ropes, fabric, sheets, cloths, tubes, films, twine, strings, etc.) attached thereto. Thus, the scope of this disclosure is not limited to the construction, configuration or other details of the device 60 as described herein or depicted in the drawings.

Figure 4B:
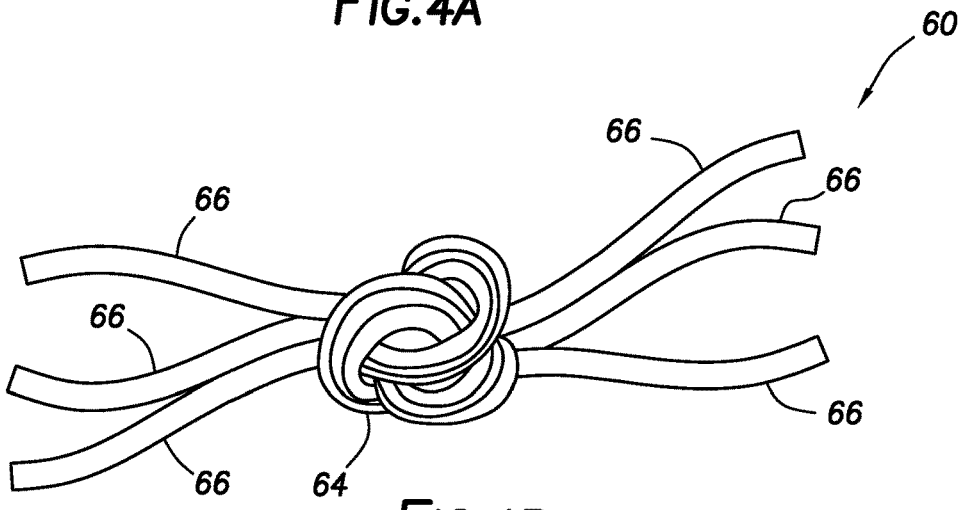

Referring additionally now to FIG. 4B, another example of the device 60 is representatively illustrated. In this example, the device 60 is formed using multiple braided lines 66 of the type known as "mason twine." The multiple lines 66 are knotted (such as, with a double or triple overhand knot or other type of knot) to form the body 64.

Ends of the lines 66 are not necessarily frayed in these examples, although the lines do comprise fibers (such as the fibers 62 described above).

Figure 5:
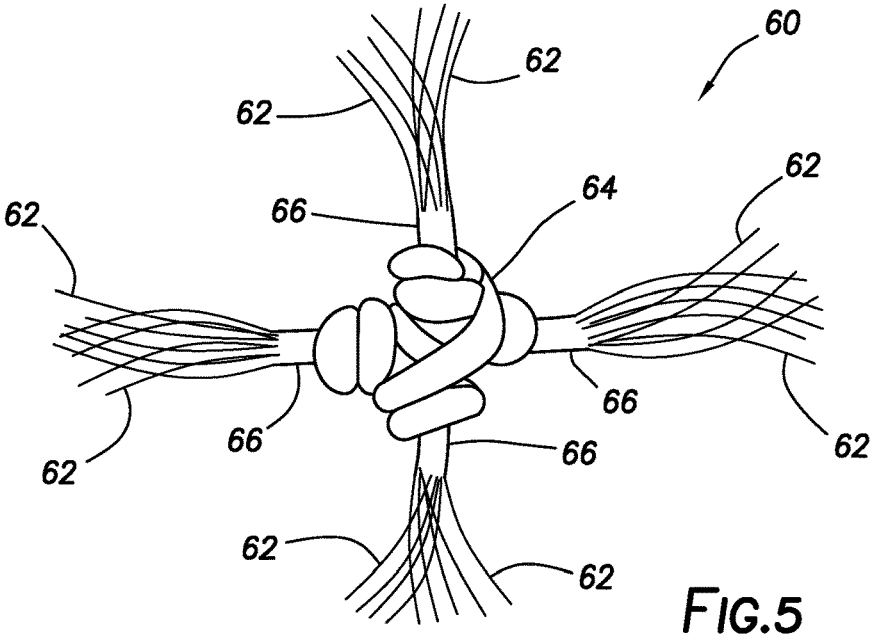
FIG. 5 is a representative elevational view of another example of the flow conveyed plugging device.

Referring additionally now to FIG. 5, another example of the device 60 is representatively illustrated. In this example, four sets of the fibers 62 are joined by a corresponding number of lines 66 to the body 64. The body 64 is formed by one or more knots in the lines 66.

FIG. 5 demonstrates that a variety of different configurations are possible for the device 60. Accordingly, the principles of this disclosure can be incorporated into other configurations not specifically described herein or depicted in the drawings. Such other configurations may include fibers joined to bodies without use of lines, bodies formed by techniques other than knotting, etc.

Figure 6B:
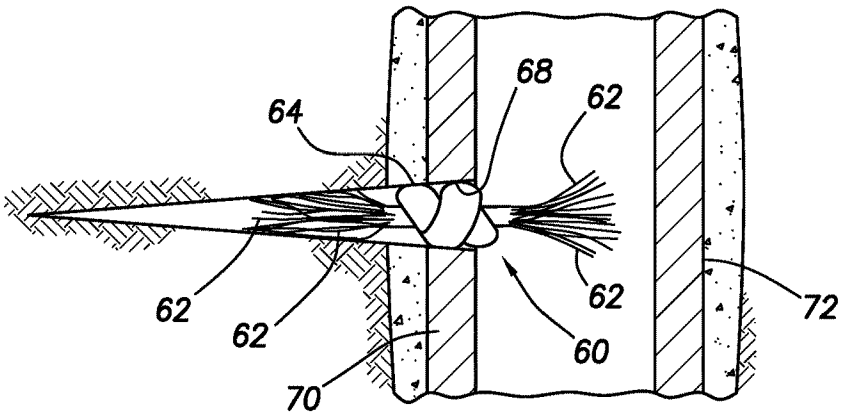
FIGS. 6A & B are representative partially cross-sectional views of the flow conveyed plugging device in a well, the device being conveyed by flow in FIG. 6A, and engaging a casing opening in FIG. 6B.
Figure 6A:
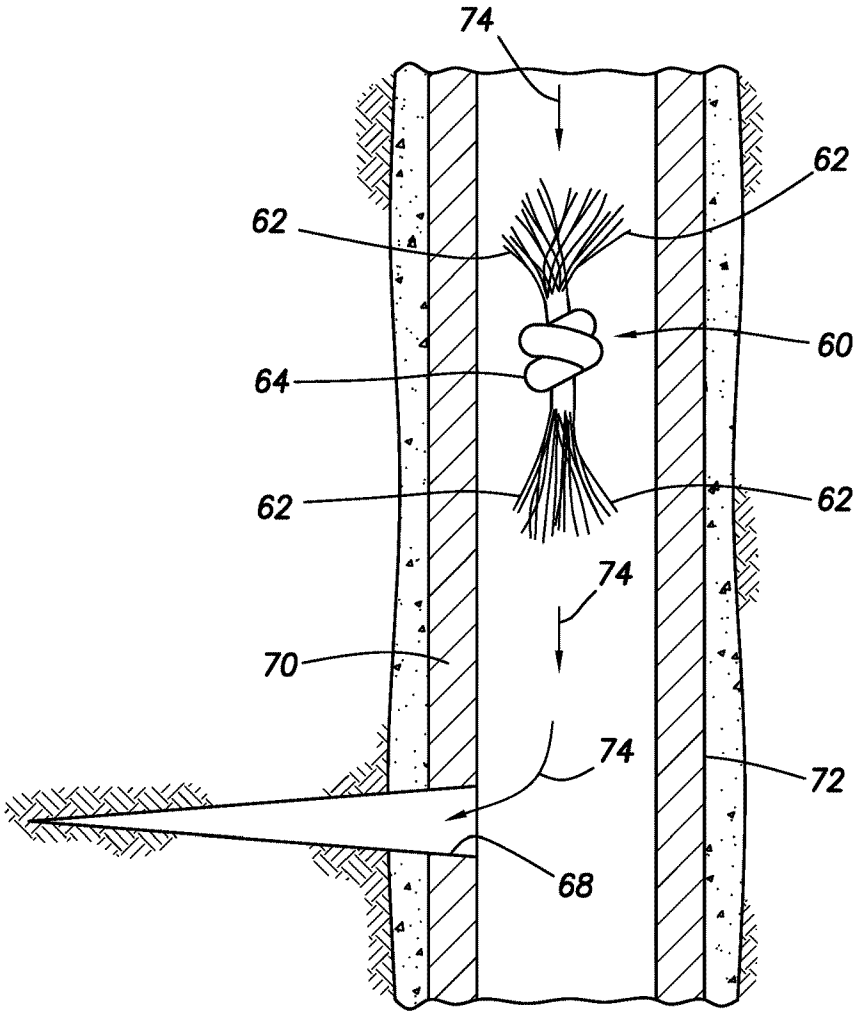

Referring additionally now to FIGS. 6A & B, an example of a use of the device 60 of FIG. 4 to seal off an opening 68 in a well is representatively illustrated. In this example, the opening 68 is a perforation formed through a sidewall 70 of a tubular string 72 (such as, a casing, liner, tubing, etc.). However, in other examples the opening 68 could be another type of opening, and may be formed in another type of structure.

The device 60 is deployed into the tubular string 72 and is conveyed through the tubular string by fluid flow 74. The lines 66 and fibers 62 of the device 60 enhance fluid drag on the device, so that the device is influenced to displace with the flow 74.

Since the flow 74 (or a portion thereof) exits the tubular string 72 via the opening 68, the device 60 will be influenced by the fluid drag to also exit the tubular string via the opening 68. As depicted in FIG. 6B, one set of the fibers 62/lines 66 first enters the opening 68, and the body 64 follows. However, the body 64 is appropriately dimensioned, so that it does not pass through the opening 68, but instead is lodged or wedged into the opening. In some examples, the body 64 may be received only partially in the opening 68, and in other examples the body may be entirely received in the opening.

The body 64 may completely or only partially block the flow 74 through the opening 68. If the body 64 only partially blocks the flow 74, any remaining fibers 62/lines 66 exposed to the flow in the tubular string 72 can be carried by that flow into any gaps between the body and the opening 68, so that a combination of the body and the fibers completely blocks flow through the opening.

In another example, the device 60 may partially block flow through the opening 68, and another material (such as, calcium carbonate, PLA or PGA particles) may be deployed and conveyed by the flow 74 into any gaps between the device and the opening, so that a combination of the device and the material completely blocks flow through the opening.

The device 60 may permanently prevent flow through the opening 68, or the device may degrade to eventually permit flow through the opening. If the device 60 degrades, it may be self-degrading, or it may be degraded in response to any of a variety of different stimuli. Any technique or means for degrading the device 60 (and any other material used in conjunction with the device to block flow through the opening 68) may be used in keeping with the scope of this disclosure.

If the device 60 is present in a well during or after an acidizing treatment, then at least the body 64 could be somewhat acid resistant. For example, a coating material on the body 64 could initially delay degradation of the body, but allow the body to degrade after a predetermined period of time. Alternatively, the device 60 could be mechanically removed after the acidizing treatment.

Figure 7:
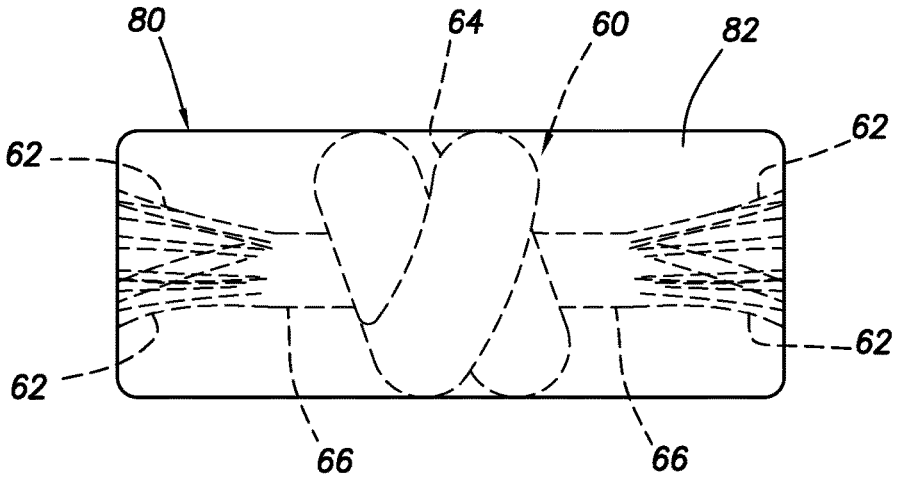
FIGS. 7-9 are representative elevational views of examples of the flow conveyed plugging device with a retainer.
Figure 8:
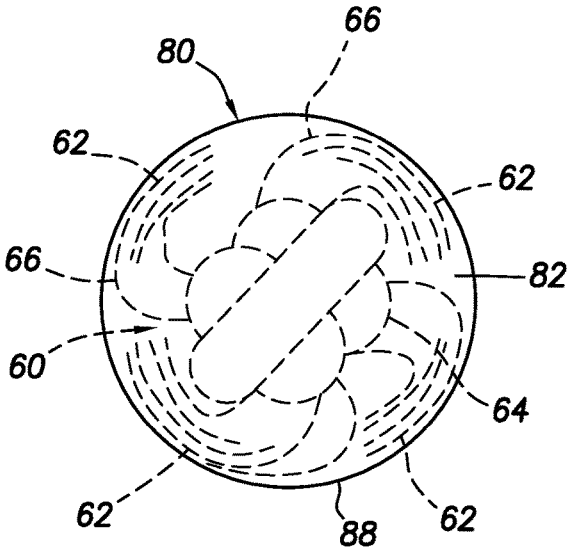
Figure 9:
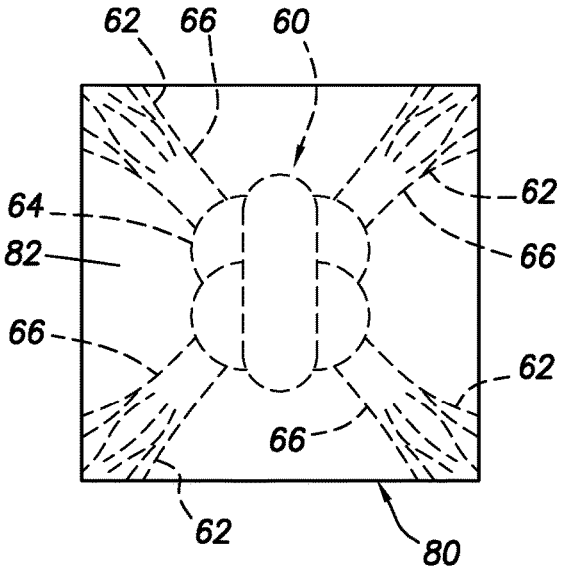

Referring additionally now to FIGS. 7-9, additional examples of the device 60 are representatively illustrated. In these examples, the device 60 is surrounded by, encapsulated in, molded in, or otherwise retained by, a retainer 80.

The retainer 80 aids in deployment of the device 60, particularly in situations where multiple devices are to be deployed simultaneously. In such situations, the retainer 80 for each device 60 prevents the fibers 62 and/or lines 66 from becoming entangled with the fibers and/or lines of other devices.

The retainer 80 could in some examples completely enclose the device 60. In other examples, the retainer 80 could be in the form of a binder that holds the fibers 62 and/or lines 66 together, so that they do not become entangled with those of other devices.

In some examples, the retainer 80 could have a cavity therein, with the device 60 (or only the fibers 62 and/or lines 66) being contained in the cavity. In other examples, the retainer 80 could be molded about the device 60 (or only the fibers 62 and/or lines 66).

During or after deployment of the device 60 into the well, the retainer 80 dissolves, disperses or otherwise degrades, so that the device is capable of sealing off an opening 68 in the well, as described above. For example, the retainer 80 can be made of a material 82 that degrades in a wellbore environment.

The retainer material 82 may degrade after deployment into the well, but before arrival of the device 60 at the opening 68 to be plugged. In other examples, the retainer material 82 may degrade at or after arrival of the device 60 at the opening 68 to be plugged. If the device 60 also comprises a degradable material, then preferably the retainer material 82 degrades prior to the device material.

The material 82 could, in some examples, melt at elevated wellbore temperatures. The material 82 could be chosen to have a melting point that is between a temperature at the earth's surface and a temperature at the opening 68, so that the material melts during transport from the surface to the downhole location of the opening.

The material 82 could, in some examples, dissolve when exposed to wellbore fluid. The material 82 could be chosen so that the material begins dissolving as soon as it is deployed into the wellbore 14 and contacts a certain fluid (such as, water, brine, hydrocarbon fluid, etc.) therein. In other examples, the fluid that initiates dissolving of the material 82 could have a certain pH range that causes the material to dissolve.

Note that it is not necessary for the material 82 to melt or dissolve in the well. Various other stimuli (such as, passage of time, elevated pressure, flow, turbulence, etc.) could cause the material 82 to disperse, degrade or otherwise cease to retain the device 60. The material 82 could degrade in response to any one, or a combination, of: passage of a predetermined period of time in the well, exposure to a predetermined temperature in the well, exposure to a predetermined fluid in the well, exposure to radiation in the well and exposure to a predetermined chemical composition in the well. Thus, the scope of this disclosure is not limited to any particular stimulus or technique for dispersing or degrading the material 82, or to any particular type of material.

In some examples, the material 82 can remain on the device 60, at least partially, when the device engages the opening 68. For example, the material 82 could continue to cover the body 64 (at least partially) when the body engages and seals off the opening 68. In such examples, the material 82 could advantageously comprise a relatively soft, viscous and/or resilient material, so that sealing between the device 60 and the opening 68 is enhanced.

Suitable relatively low melting point substances that may be used for the material 82 can include wax (e.g., paraffin wax, vegetable wax), ethylene-vinyl acetate copolymer (e.g., ELVAX™ available from DuPont), atactic polypropylene and eutectic alloys. Suitable relatively soft substances that may be used for the material 82 can include a soft silicone composition or a viscous liquid or gel.

Suitable dissolvable materials can include PLA, PGA, anhydrous boron compounds (such as anhydrous boric oxide and anhydrous sodium borate), polyvinyl alcohol, polyethylene oxide, salts and carbonates. The dissolution rate of a water-soluble polymer (e.g., polyvinyl alcohol, polyethylene oxide) can be increased by incorporating a water-soluble plasticizer (e.g., glycerin), or a rapidly-dissolving salt (e.g., sodium chloride, potassium chloride), or both a plasticizer and a salt.

In FIG. 7, the retainer 80 is in a cylindrical form. The device 60 is encapsulated in, or molded in, the retainer material 82. The fibers 62 and lines 66 are, thus, prevented from becoming entwined with the fibers and lines of any other devices 60.

In FIG. 8, the retainer 80 is in a spherical form. In addition, the device 60 is compacted, and its compacted shape is retained by the retainer material 82. A shape of the retainer 80 can be chosen as appropriate for a particular device 60 shape, in compacted or un-compacted form.

In FIG. 9, the retainer 80 is in a cubic form. Thus, any type of shape (polyhedron, spherical, cylindrical, etc.) may be used for the retainer 80, in keeping with the principles of this disclosure.

Figure 10:
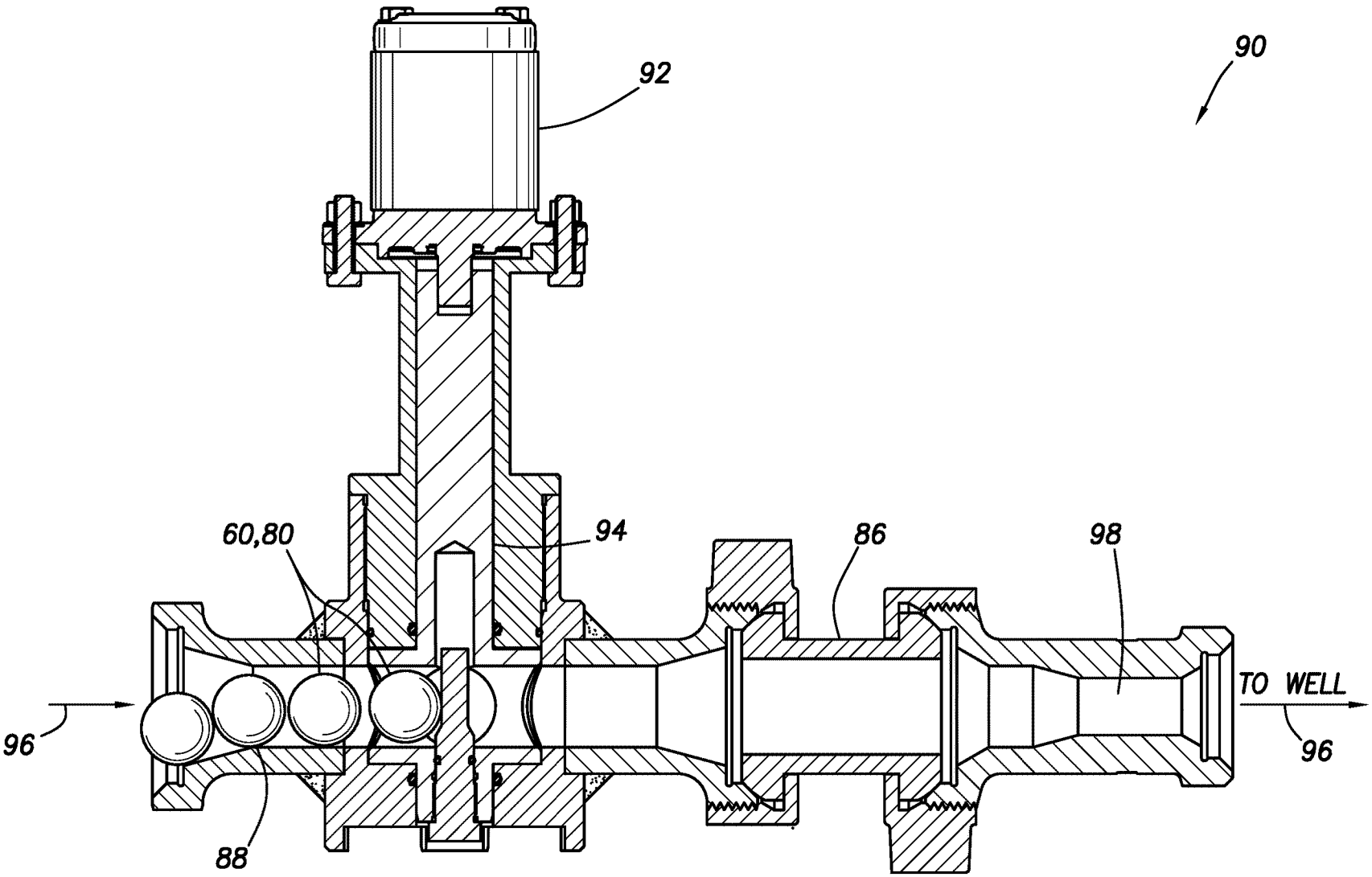
FIG. 10 is a representative cross-sectional view of an example of a deployment apparatus and method that can embody the principles of this disclosure.

Referring additionally now to FIG. 10, an example of a deployment apparatus 90 and an associated method are representatively illustrated. The apparatus 90 and method may be used with the system 10 and method described above, or they may be used with other systems and methods.

When used with the system 10, the apparatus 90 can be connected between the pump 34 and the casing valve 32 (see FIG. 1). Alternatively, the apparatus 90 can be "teed" into a pipe associated with the pump 34 and casing valve 32, or into a pipe associated with the pump 36 (for example, if the devices 60 are to be deployed via the tubular string 12). However configured, an output of the apparatus 90 is connected to the well, although the apparatus itself may be positioned a distance away from the well.

The apparatus 90 is used in this example to deploy the devices 60 into the well. The devices 60 may or may not be retained by the retainer 80 when they are deployed. However, in the FIG. 10 example, the devices 60 are depicted with the retainers 80, for convenience of deployment. The retainer material 82 is at least partially dispersed during the deployment method, so that the devices 60 are more readily conveyed by the flow 74.

In certain situations, it can be advantageous to provide spacing between the devices 60 during deployment, for example, in order to efficiently plug casing perforations. One reason for this is that the devices 60 will tend to first plug perforations that are receiving highest rates of flow.

In addition, if the devices 60 are deployed downhole too close together, some of them can become trapped between perforations, thereby wasting some of the devices. The excess "wasted" devices 60 might later interfere with other well operations.

To mitigate such problems, the devices 60 can be deployed with a selected spacing. The spacing may be, for example, on the order of the length of the perforation interval. The apparatus 90 is desirably capable of deploying the devices 60 with any selected spacing between the devices.

Each device 60 in this example has the retainer 80 in the form of a dissolvable coating material with a frangible coating 88 (see FIG. 8) thereon, to impart a desired geometric shape (spherical in this example), and to allow for convenient deployment. The dissolvable retainer material 82 could be detrimental to the operation of the device 60 if it increases a drag coefficient of the device. A high coefficient of drag can cause the devices 60 to be swept to a lower end of the perforation interval, instead of sealing uppermost perforations.

The frangible coating 88 is used to prevent the dissolvable coating from dissolving during a queue time prior to deployment. Using the apparatus 90, the frangible coating 88 can be desirably broken, opened or otherwise damaged during the deployment process, so that the dissolvable coating is then exposed to fluids that can cause the coating to dissolve.

Examples of suitable frangible coatings include cementitious materials (e.g., plaster of Paris) and various waxes (e.g., paraffin wax, carnauba wax, vegetable wax, machinable wax). The frangible nature of a wax coating can be optimized for particular conditions by blending a less brittle wax (e.g., paraffin wax) with a more brittle wax (e.g., carnauba wax) in a certain ratio selected for the particular conditions.

As depicted in FIG. 10, the apparatus 90 includes a rotary actuator 92 (such as, a hydraulic or electric servo motor, with or without a rotary encoder). The actuator 92 rotates a sequential release structure 94 that receives each device 60 in turn from a queue of the devices, and then releases each device one at a time into a conduit 86 that is connected to the tubular string 72 (or the casing 16 or tubing 20 of FIG. 1).

Note that it is not necessary for the actuator 92 to be a rotary actuator, since other types of actuators (such as, a linear actuator) may be used in other examples. In addition, it is not necessary for only a single device 60 to be deployed at a time. In other examples, the release structure 94 could be configured to release multiple devices at a time. Thus, the scope of this disclosure is not limited to any particular details of the apparatus 90 or the associated method as described herein or depicted in the drawings.

In the FIG. 10 example, a rate of deployment of the devices 60 is determined by an actuation speed of the actuator 92. As a speed of rotation of the structure 94 increases, a rate of release of the devices 60 from the structure accordingly increases. Thus, the deployment rate can be conveniently adjusted by adjusting an operational speed of the actuator 92. This adjustment could be automatic, in response to well conditions, stimulation treatment parameters, flow rate variations, etc.

As depicted in FIG. 10, a liquid flow 96 enters the apparatus 90 from the left and exits on the right (for example, at about 1 barrel per minute). Note that the flow 96 is allowed to pass through the apparatus 90 at any position of the release structure 94 (the release structure is configured to permit flow through the structure at any of its positions).

When the release structure 94 rotates, one or more of the devices 60 received in the structure rotates with the structure. When a device 60 is on a downstream side of the release structure 94, the flow 96 though the apparatus 90 carries the device to the right (as depicted in FIG. 10) and into a restriction 98.

The restriction 98 in this example is smaller than the diameter of the retainer 80. The flow 96 causes the device 60 to be forced through the restriction 98, and the frangible coating 88 is thereby damaged, opened or fractured to allow the inner dissolvable material of the retainer 80 to dissolve.

Other ways of opening, breaking or damaging a frangible coating may be used in keeping with the principles of this disclosure. For example, cutters or abrasive structures could contact an outside surface of a retainer 80 to penetrate, break or otherwise damage the frangible coating 88. Thus, this disclosure is not limited to any particular technique for damaging, breaking, penetrating or otherwise compromising a frangible coating.

Note that it is not necessary for the restriction 98 to open, break or damage a frangible coating. In some examples, a frangible coating may not be provided on the device 60. In those examples, the restriction 98 could initiate degradation of the retainer 80 (e.g., when the retainer material comprises paraffin wax). The restriction 98 could mechanically compress, damage, fracture, open, penetrate, cut, compromise or break the retainer 80, and thereby expose additional surface area of the retainer to degradation by exposure to heat, fluids, etc. in the well.

In some examples, the restriction 98 could be used to initiate degradation of the device 60. For example, the retainer 80 may not be used, or the retainer may be incorporated into the device. In those examples, the restriction 98 could have an interior dimension that is smaller than an external dimension of the device 60, or could have cutters or abrasive structures to contact an outside surface of the device and thereby damage, break, penetrate or otherwise compromise the device, so that it more readily degrades in the well.

Figure 11:
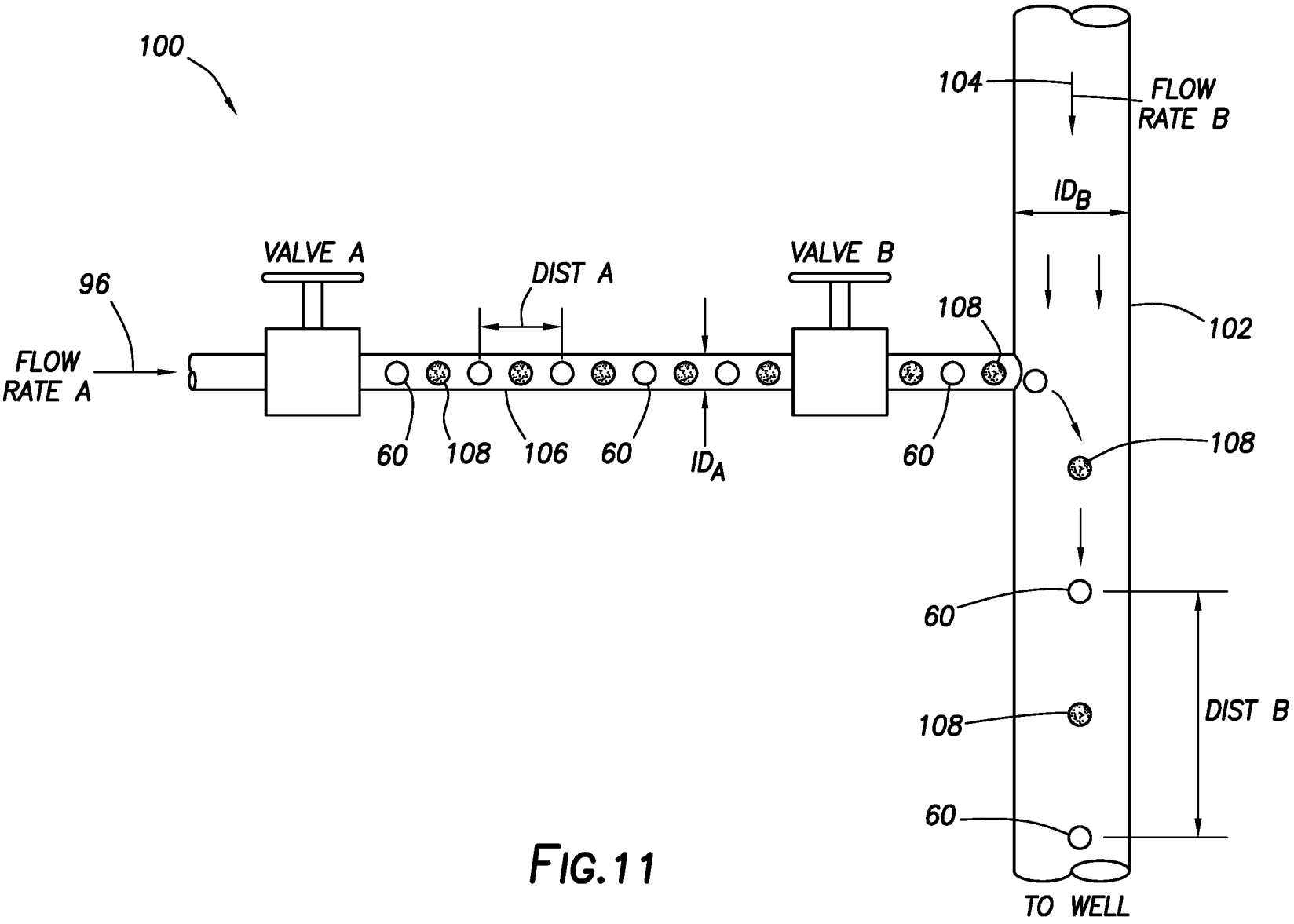
FIG. 11 is a representative schematic view of another example of a deployment apparatus and method that can embody the principles of this disclosure.

Referring additionally now to FIG. 11, another example of a deployment apparatus 100 and an associated method are representatively illustrated. The apparatus 100 and method may be used with the system 10 and method described above, or they may be used with other systems and methods.

In the FIG. 11 example, the devices 60 are deployed using two flow rates. Flow rate A through two valves (valves A & B) is combined with Flow rate B through a pipe 102 (such as casing 16 or tubular string 72) depicted as being vertical in FIG. 11 (the pipe may be horizontal or have any other orientation in actual practice).

The pipe 102 may receive flow via the pump 34 and casing valve 32, or the pipe may receive flow via the pump 36 if the devices 60 are to be deployed via the tubular string 12. In some examples, a separate pump (not shown) may be used to supply the flow 96 through the valves A & B.

Valve A is not absolutely necessary. When valve B is open the flow 96 causes the devices 60 to enter the vertical pipe 102. Flow 104 through the vertical pipe 102 in this example is substantially greater than the flow 96 through the valves A & B (that is, flow rate B>>flow rate A), although in other examples the flows may be substantially equal or otherwise related.

In situations where flow rate B>>flow rate A, the spacing (dist. B) between the devices 60 when they are deployed into the well can be calculated as follows: dist. B=dist. A*($ID_A^2/ID_B^2$)*(flow rate B/flow rate A), where dist. A is a spacing between the devices 60 prior to entering the pipe 102, $ID_A$ is an inner diameter of a pipe 106 connected to the pipe 102, and $ID_B$ is an inner diameter of the pipe 102 (such as, the casing 16 or tubular string 72). This assumes circular pipes 102, 106. Where corresponding passages are non-circular, the term $ID_A^2/ID_B^2$ can be replaced by an appropriate ratio of passage areas.

In situations where the flow rates are substantially equal, the spacing (dist. B) between the devices 60 when they are deployed into the well can be calculated as follows: dist. B=dist. A*($ID_A^2/ID_B^2$)*(flow rate B+flow rate A)/flow rate A.

The spacing between the plugging devices 60 in the well (dist. B) can be automatically controlled by varying at least one of the flow rates. For example, the spacing can be increased by increasing the flow rate B or decreasing the flow rate A. The flow rate(s) can be automatically adjusted in response to changes in well conditions, stimulation treatment parameters, flow rate variations, etc.

In some examples, flow rate A can have a practical minimum of about 1/2 barrel per minute. In some circumstances, the desired deployment spacing (dist. B) may be greater than what can be produced using a convenient spacing of the devices 60 and the flow rate A in the pipe 106.

The deployment spacing B may be increased by adding spacers 108 between the devices 60 in the pipe 106. The spacers 108 effectively increase the distance A between the devices 60 in the pipe 106 (and, thus, increase the value of dist. A in the equation above).

The spacers 108 may be dissolvable or otherwise dispersible, so that they dissolve or degrade when they are in the pipe 102 or thereafter. In some examples, the spacers 108 may be geometrically the same as, or similar to, the devices 60.

Note that the apparatus 100 may be used in combination with the restriction 98 of FIG. 10 (for example, with the restriction 98 connected downstream of the valve B but upstream of the pipe 102). In this manner, a frangible or other protective coating 88 on the devices 60 and/or spacers 108 can be opened, broken or otherwise damaged prior to the devices and spacers entering the pipe 102.

On a typical new well, where a fracturing operation is staged from bottom to top, as few as ten devices 60 may need to be released per stage. The number of devices 60 released should be accurate (e.g., within approximately +/−20%). If too few devices 60 are released, then fracturing fluid flow may not shift to the next stage. If too many devices 60 are released then the well may cease to receive significant flow, and equipment such as wireline perforating guns cannot be readily pumped through the well.

When too few devices 60 are pumped and the fracture pressure is found to be low, it is not typically practical to pump additional devices, because of the additional fluid required to start over. Devices 60 are usually displaced with a small amount of water followed by acid and then sand slurry. If additional devices 60 were to be released in the sand slurry, then there is a significant risk of sanding off the well (an accumulation of sand in a wellbore). When too many devices 60 are pumped, coiled tubing may need to be deployed to correct the issue, which adds significant cost.

The device 60 count on re-fracturing operations is typically not as critical as on new wells. Wells that are being re-fractured may have hundreds or thousands of open perforations. The danger of sanding off or plugging the well due to extra devices 60 is generally not an issue. Pumping too few devices 60 is also typically not an issue.

Re-fracturing of wells usually requires at least two device 60 sizes. To make operations less complicated, two or more different apparatuses 90 or 100 can be used to allow an operator freedom to choose which size and how many devices 60 are released at various points in the operation. Alternatively, a single apparatus 90, 100 could be configured to separately introduce different sizes of the devices 60 into the well.

Components of the apparatus 90, 100 exposed to fracturing pressures should be rated for relatively high pressure service (such as, 15000 psi or ~103 MPa). This high pressure makes penetrations from the wetted components to the outside environment difficult, and is usually limited to rotary shafts and short stroke hydraulic cylinders.

The apparatus 90, 100 is attached to a flow line (e.g., conduit 86 or pipe 102) that is connected to a wellhead. A dedicated pump can be used to push the devices 60 from the apparatus 90, 100 to the wellhead. This pump can be turned off when devices 60 are not being launched.

A sensor can be provided in the flow line for detecting and counting devices 60. The apparatus 90, 100 may be operated long enough to introduce into the well a required or desired number of devices 60, based on an output of the sensor.

The flow 96 may comprise one or more substances to prevent the devices 60 from entangling in the apparatus 90, 100. To prevent the devices 60 from forming a dense pack and tangling with each other, they can be slurried in a gel. Suitable gelling agents include cross-linked polyacrylate powder (e.g., Carbopol 941™), xanthan gum, and mixtures of locust bean gum and guar gum.

Alternatively, the devices 60 can be coated or impregnated with the gel and dried before use. The devices can then be stored and loaded into the apparatus 90, 100 dry. When subsequently exposed to water, the gelling agent rehydrates and forms a gel coating on the device 60.

For any apparatus 90,100 with a vertical queue that uses individual devices 60 (e.g., not a molded cylinder), it is advantageous for each device 60 to have a bulk density greater than that of water. A high density reduces a risk of the devices 60 being carried into a cap or valve at a top of the vertical queue when the apparatus 90, 100 is filled with water.

Densification can be achieved by impregnating a device 60 with a liquid that displaces trapped air. High density, water-miscible liquids that do not dissolve the dried gel coating (e.g., glycerin, ethylene glycol) are suitable for this purpose. The liquid can be forced into the device 60 either with high pressure, or preferably a cycle of reduced pressure followed by a return to atmospheric pressure.

Referring additionally now to FIGS. 12-27, additional examples of the deployment apparatus 100 are representatively illustrated. These deployment apparatus examples 100 may be used in the system 10 and methods described above, or they may be used with other systems and methods.

The deployment apparatus 100 examples described below are depicted as being used to deploy the plugging devices 60 into a well. The plugging devices 60 are for convenience not indicated as having the retainer 80 or coating 88 described above, but the retainer and/or coating may be used in keeping with the scope of this disclosure.

Figure 12:
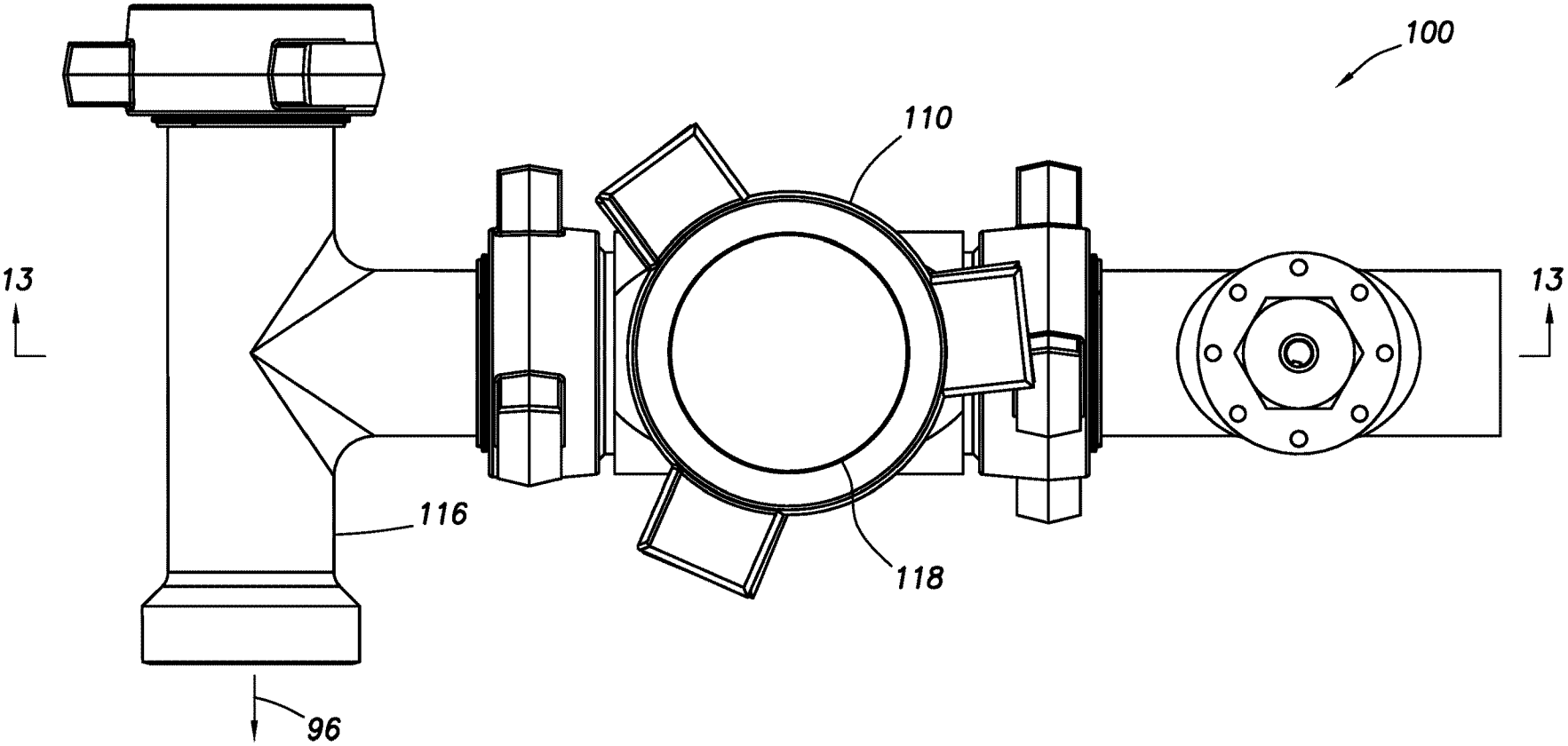
FIGS. 12-27 are representative views of additional examples of the deployment apparatus and method.
Figure 13:
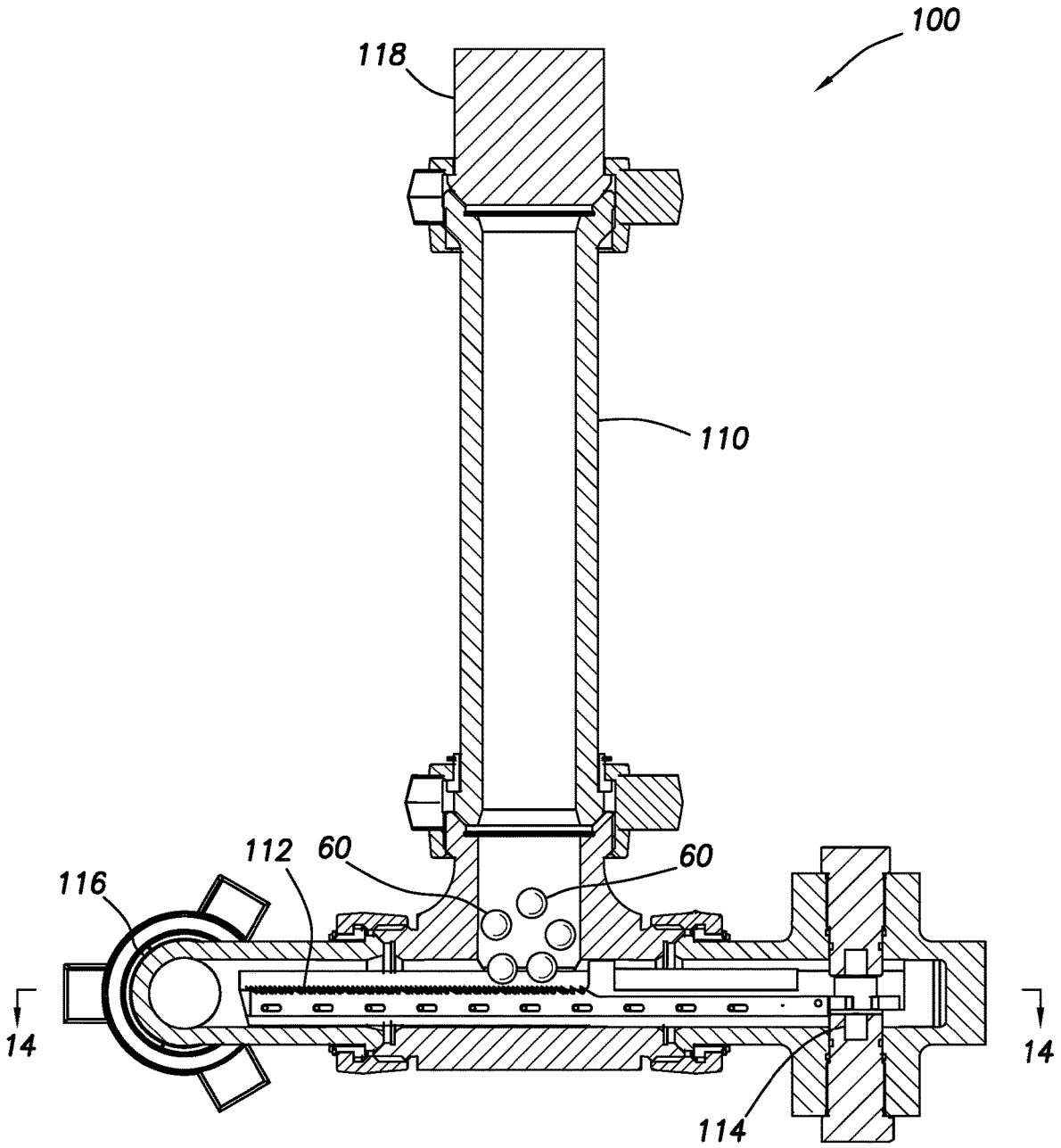
Figure 14:
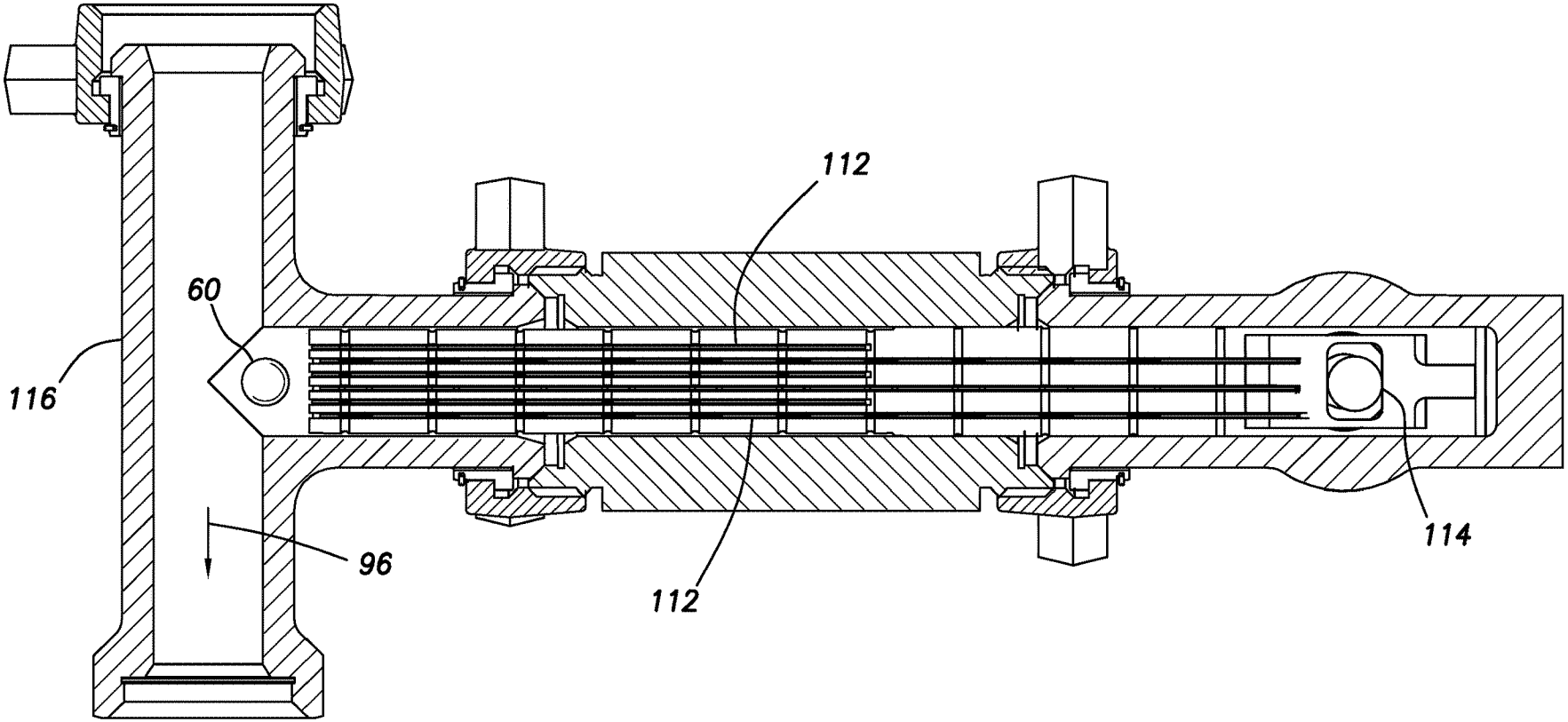

FIGS. 12-14 depict an example of the deployment apparatus 100, in which the devices 60 are transferred from a queue 110 to the well by means of "saw blades" 112 or wickers that act as pawls. There are two sets of saw blades 112 in this example—one set is stationary while the other set reciprocates. The blades 112 reciprocate due to the action of a shaft operated cam 114 as depicted in FIG. 13.

A motor (such as the actuator 92, see FIG. 10) or hydraulic cylinder/bell crank rotates the cam 114. A shaft of the actuator 92 does not have to rotate fully 360° (e.g., the shaft could partially rotate or reciprocate, if desired). Note that the actuator/shaft/cam mechanism could be replaced with a short stroke hydraulic cylinder directly moving the reciprocating blades 112.

Gravity causes the devices 60 to drop in the queue 110 to the teeth of the saw blades 112. The stationary and reciprocating blades 112 then hook onto the devices 60 and will not allow them to move to the right (as viewed in FIGS. 12-14).

The reciprocation of the blades 112 forces the devices 60 to the left on each leftward stroke, but the devices cannot displace back to the right when the reciprocating blades stroke to the right, due to the stationary blades. The devices 60 are eventually pushed into, for example, a tee or other connector 116 conducting the flow 96 near a leftward end of the saw blades 112, for introduction into the well.

Some re-fracturing operations may require 2000 or more devices 60, which might be more than a capacity of the queue 110. The apparatus of FIGS. 12-14 can be reloaded by removing a cap 118. A valve (such as valve A, see FIG. 11) may be used for convenience, instead of the cap 118.

Figure 15:
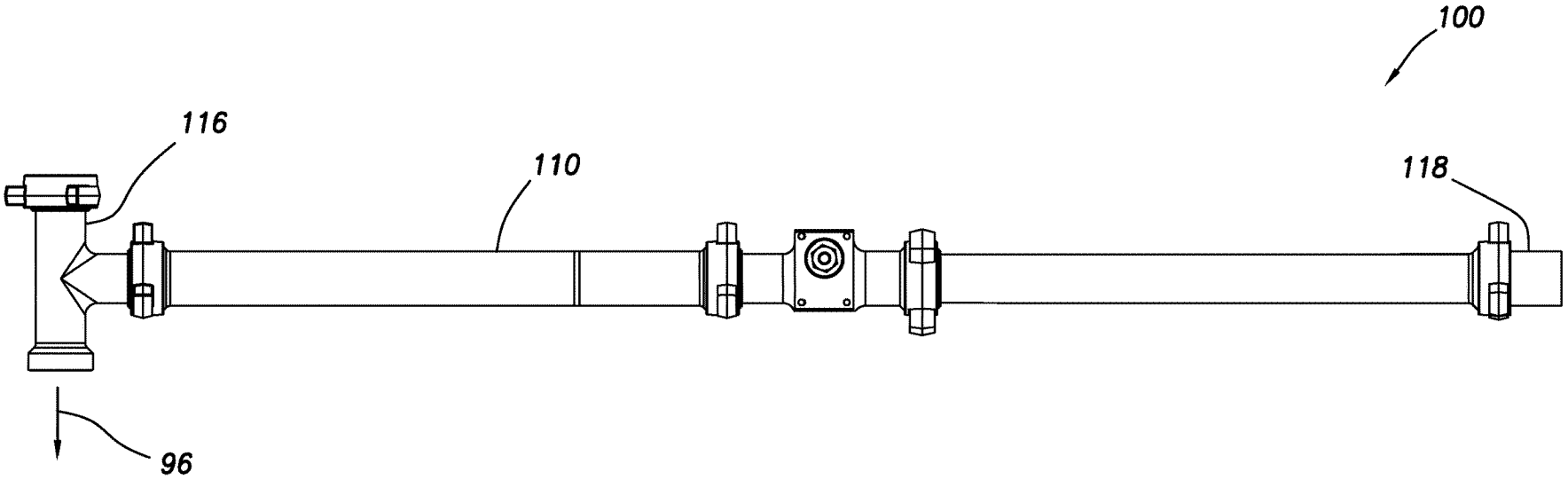
Figure 16:
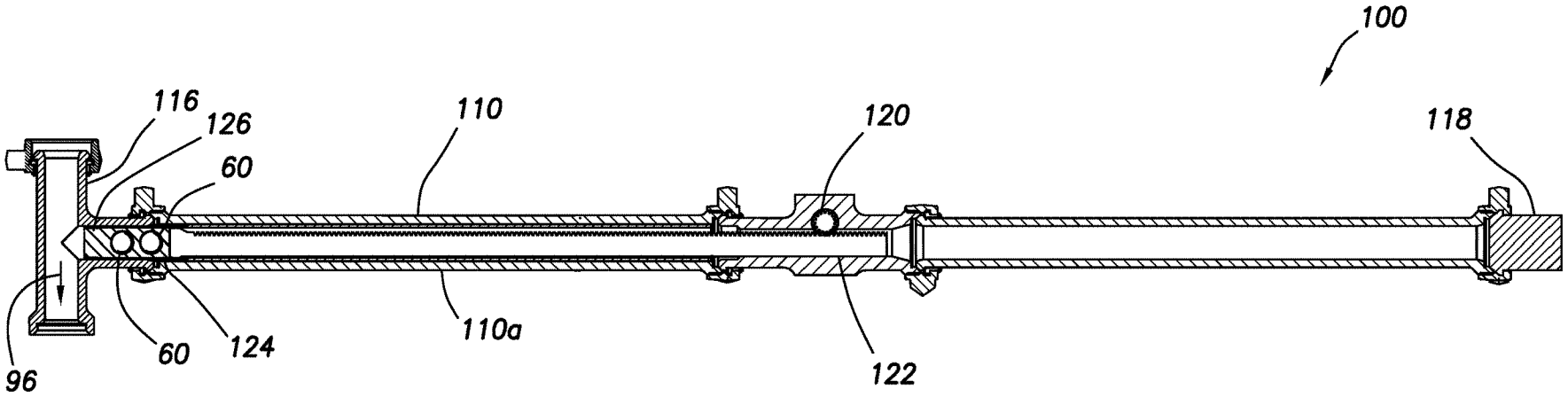

FIGS. 15 & 16 depict an example of the apparatus 100, in which the devices 60 are transferred from the queue 110 to the flow 96 through the connector 116 by action of a pinion or gear 120 and rack 122 operated piston that pushes a frangible/dissolvable solid cylinder 124 containing multiple devices 60. The gear 120 may be rotated by a motor or actuator (such as the actuator 92). A rotational speed of the gear 120 determines a rate of transfer of the cylinder 124 (and devices 60 therein) from the queue 110 to the flow 96 in the connector 116.

There is a collet-type restriction 126 at the end of the cylinder 124 containing the devices 60. The collets 126 apply friction to the cylinder 124, in order to prevent it from free movement into the flow 96.

There is a small gap between the cylinder 124 and a housing 110*a* that contains it to form the queue 110. This gap is used to equalize pressure on opposite ends of the cylinder 124, to prevent pressure from getting trapped behind the cylinder and accidentally pushing it into the flow 96. The apparatus 100 can be reloaded by replacing the cylinder 124, or by replacing the queue 110 (the housing 110*a* with the cylinder 124 therein).

The cylinder 124 is configured in this example to be used with a mechanism that controllably pushes the cylinder into the flow 96 that impinges on the cylinder. As the cylinder 124 extends into the flow 96, the cylinder breaks apart and releases the devices 60. The cylinder 124 preferably does not stick to the housing 110*a*, pipe or sleeve that contains it in the apparatus 100, or disintegrate or degrade before being pushed into the flow 96.

Once in the flow 96, structural components of the cylinder 124 should cleanly separate from the devices 60. Palm wax has high crystallinity, good stiffness, and high shrinkage upon crystallization; properties that are desirable for reliable injector operation. However, the wax could be too strong to reliably disintegrate in the flow 96. Also, the devices 60 may not release cleanly if cast directly in the wax. Some techniques to enhance operation of the device cylinder 124 can include:

1. Treat the device 60 with surfactant before casting or molding. Preferred surfactants include water-wetting, nonionic surfactants that are solid at ambient temperature, such as PEG 23 lauryl ether (Brij L23). The devices 60 can be dipped in molten surfactant, removed, and cooled. The treated devices 60 can subsequently be cast in palm wax to form the cylinder 124. Aqueous anionic, cationic, amphoteric, or zwitterionic surfactant solutions can also be used, but a drying step may be advantageous in some cases.

2. Wrap the devices 60 (individually or in groups) in cold-water-soluble polyvinyl alcohol film or bags. Stack the wrapped devices 60 in the cylindrical mold and cast in palm wax to form the cylinder 124.

3. Place the devices 60 in a polyvinyl alcohol tube and optionally fill the tube with a molten, water-soluble material, such as a nonionic surfactant or polyethylene glycol. Insert the tube in a cylindrical mold and cast palm wax in an annulus between the tube and mold to form the cylinder 124.

Palm wax can be modified to make it more friable in the flow 96 by emulsifying water in the molten wax. For example, a solution of 10% Brij L23 in palm wax can be emulsified with 10% water by weight of the wax solution. The resulting solid is more brittle than straight palm wax.

Other vegetable waxes (e.g., soy wax), vegetable wax/paraffin wax blends, carnauba wax/paraffin wax blends, vegetable wax/polyethylene glycol blends can also be used.

Plaster of Paris can be used to cast the cylinders 124, instead of wax. Properties can be modified by changing a water ratio of the plaster, or by incorporating wax or polyolefin beads in the plaster.

Figure 17:
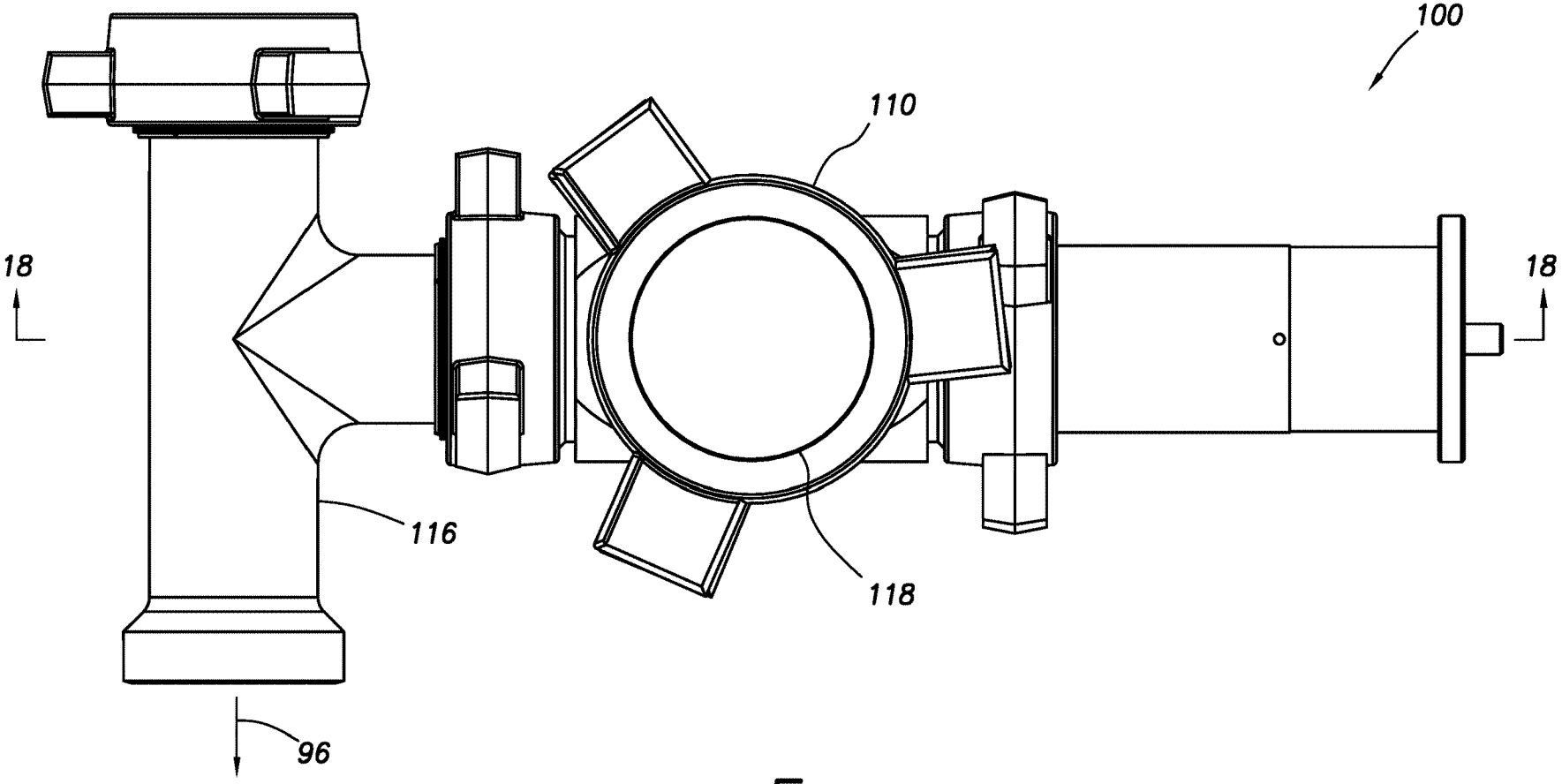
Figure 18:
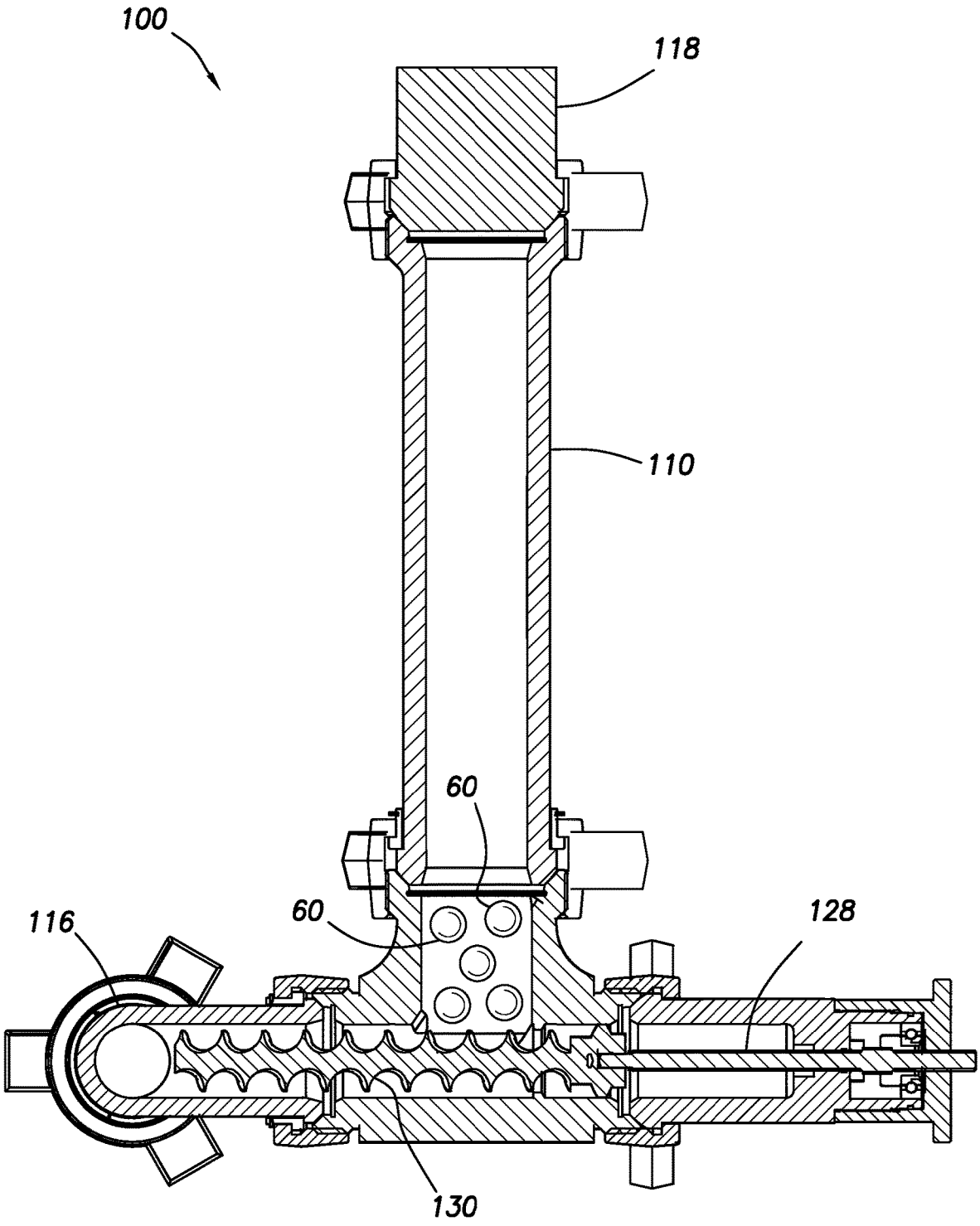

FIGS. 17 & 18 depict an example of the apparatus 100, in which the devices 60 are transferred from a queue 110 to the flow 96 by a shaft 128 operated auger 130. The shaft 128 and auger 130 may be rotated by a motor or actuator (such as the actuator 92).

The devices 60 can be loaded or stacked freely in the queue 110. As the auger 130 rotates, it gradually and controllably transfers the devices 60 from the queue 110 to the flow 96 in the connector 116. A rotational speed of the auger 130 determines a rate of transfer of the device 60 from the queue 110 to the flow 96.

Figure 31:
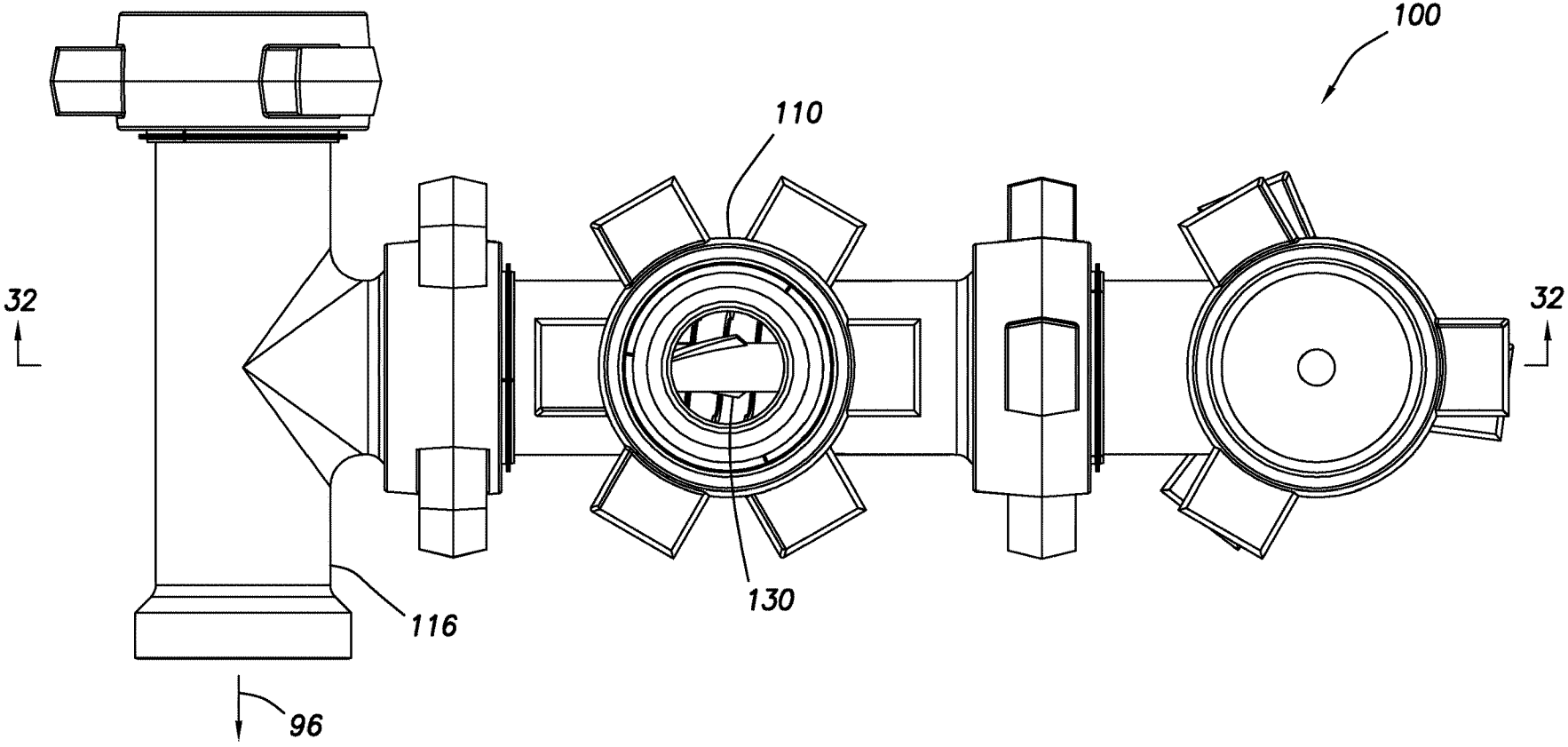
FIGS. 31-35 are representative views of additional examples of the deployment apparatus and method.
Figure 32:
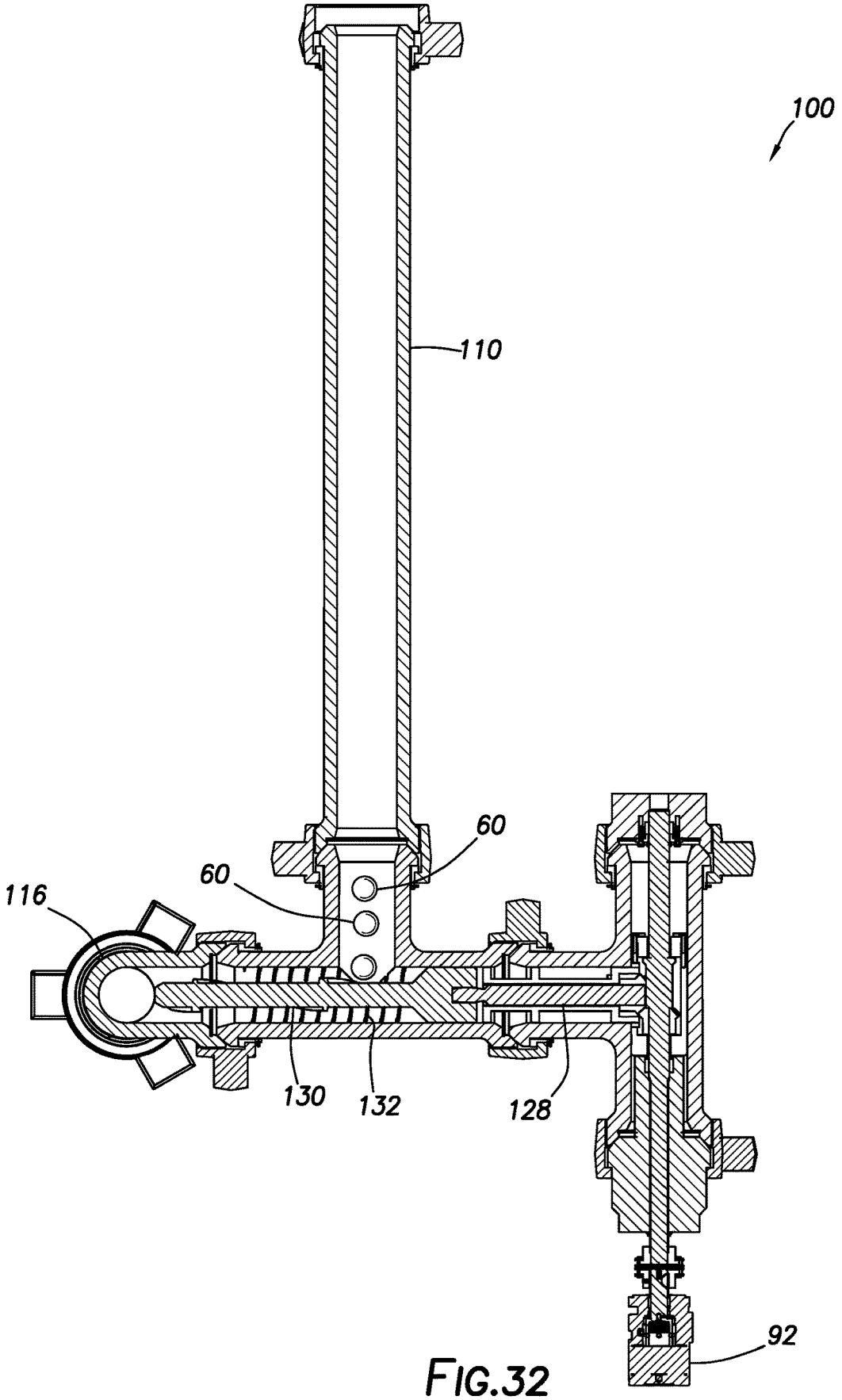
Figure 33:
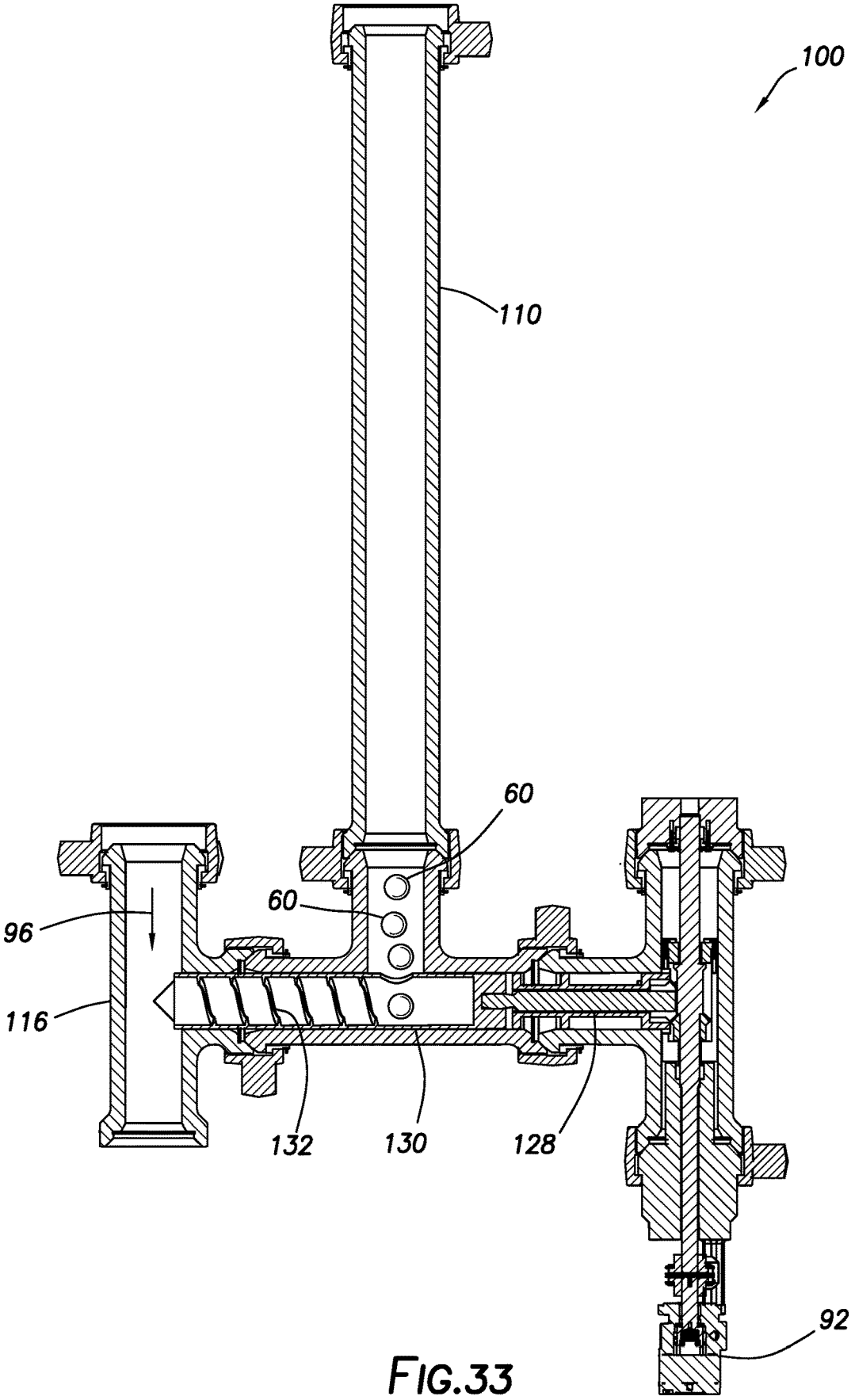

FIGS. 31-33 depict variations to the auger 130 in other examples of the apparatus 100, which are otherwise similar to the FIGS. 17 & 18 example. In the FIGS. 31 & 32 example, the auger 130 is rotated within an internal helical profile 132 to transfer the devices 60 from the queue 110 to the flow 96 in the connector 116. In the FIG. 33 example, the auger 130 has the helical profile 132 formed therein.

The augers 130 in the FIGS. 31-33 examples are depicted as being bevel gear-driven with no reduction. The gear drive allows the driven shaft 128 to be pressure balanced, which eliminates a significant thrust generated by internal pressure.

Figure 19:
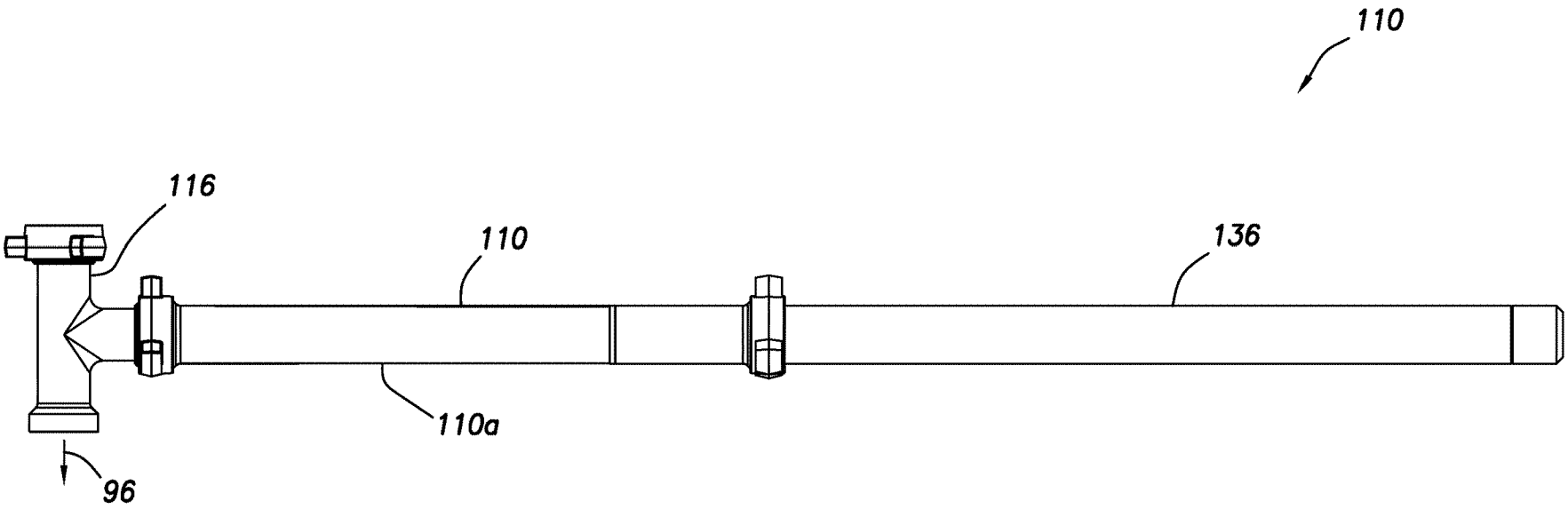
Figure 20:
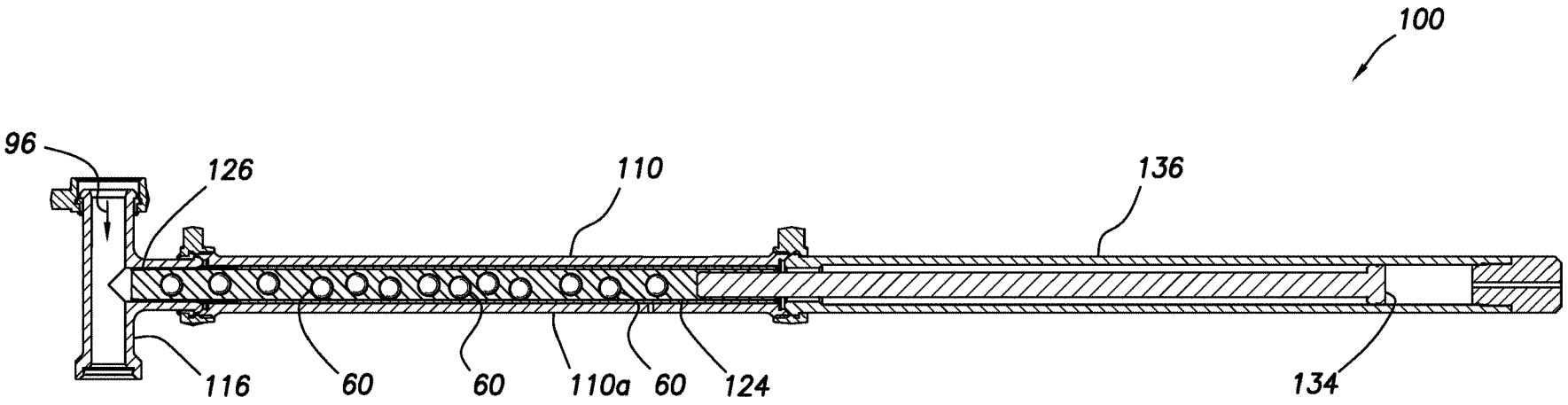

FIGS. 19 & 20 depict an example of the apparatus 100, in which the devices 60 are transferred from the queue 110 to the flow 96 by a high pressure hydraulic piston 134. This apparatus 100 example uses the same solid cylinder 124 of devices 60 and housing 110*a* as the FIGS. 15 & 16 example.

The piston 134 in the FIGS. 19 & 20 apparatus 100 will have well fracturing or injection pressure on one side (left side as viewed in FIG. 20) and applied hydraulic pressure on an opposite side (right side as viewed in FIG. 20). The hydraulic pressure is at least as high as the fracturing pressure, in order to push the cylinder 124 into the flow 96. The applied hydraulic pressure can be controlled to thereby control a rate of displacement of the devices 60 into the flow 96 in the connector 116.

Figure 21:
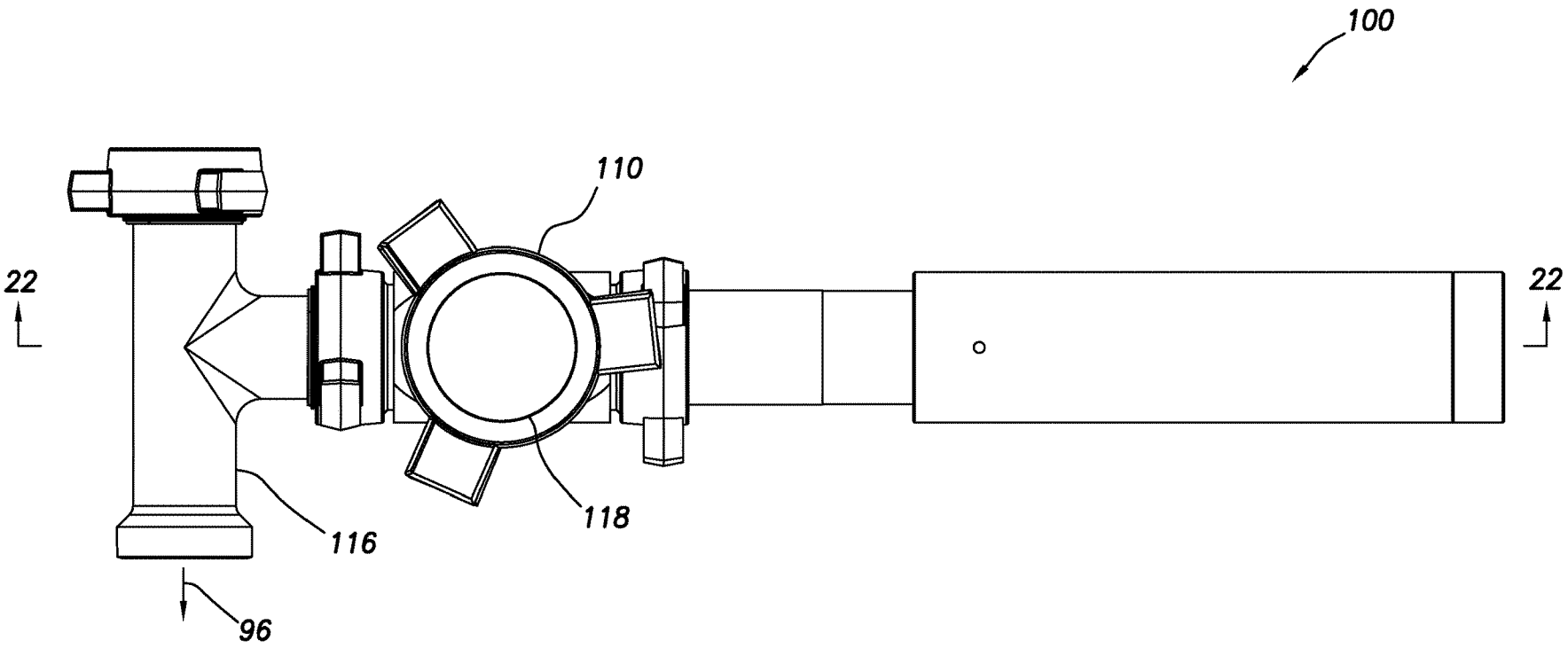
Figure 22:
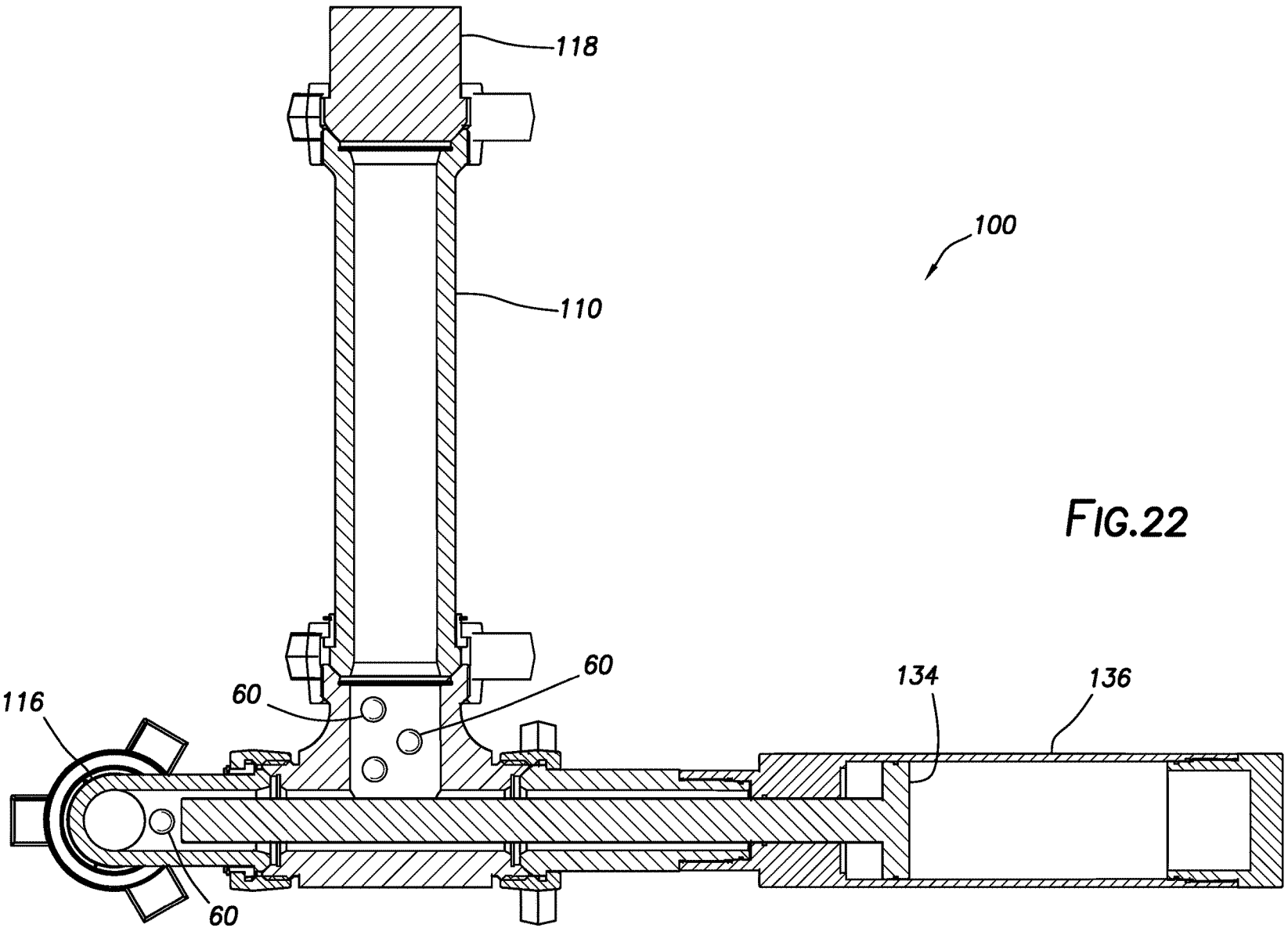

FIGS. 21 & 22 depict an example of the apparatus 100, in which the devices 60 are transferred from the queue 110 to the flow 96 by action of a double acting hydraulic cylinder 136 (with the piston 134 therein). The cylinder 136 may be sized such that the applied hydraulic pressure to displace the devices 60 to the flow 96 in the connector 116 will be in a normal range of commercially available hydraulic equipment.

The hydraulic cylinder 136 is stroked back and forth to gradually transfer the devices 60 from the queue 110 to the flow 96. A reciprocation speed of the piston 134 can be controlled to thereby control the rate of transfer of the devices 60 into the flow 96.

Figure 23:
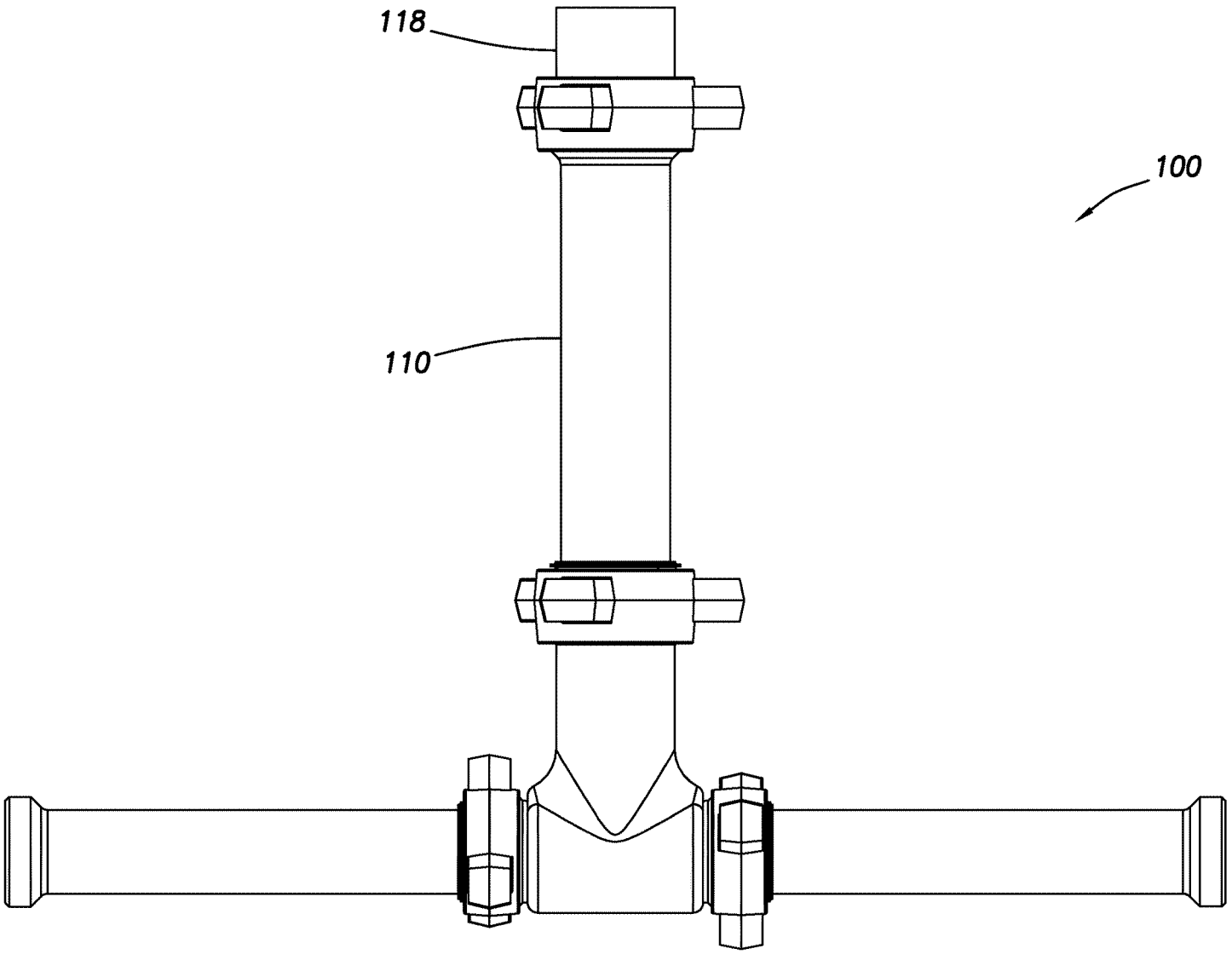
Figure 24:
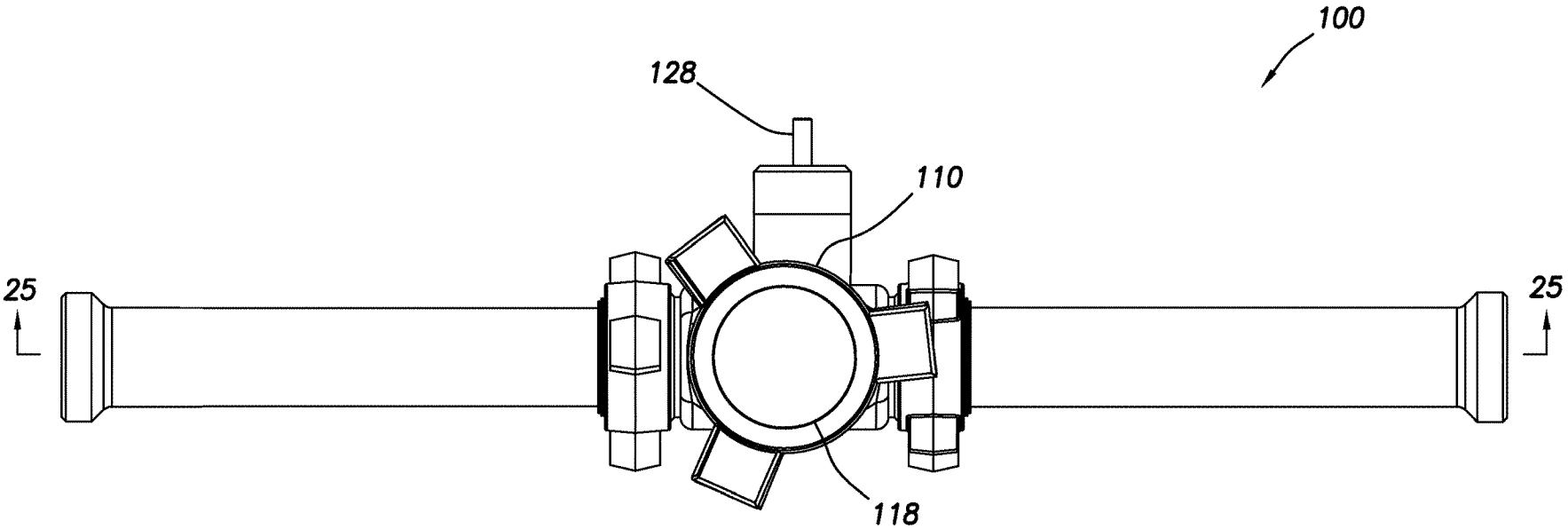
Figure 25:
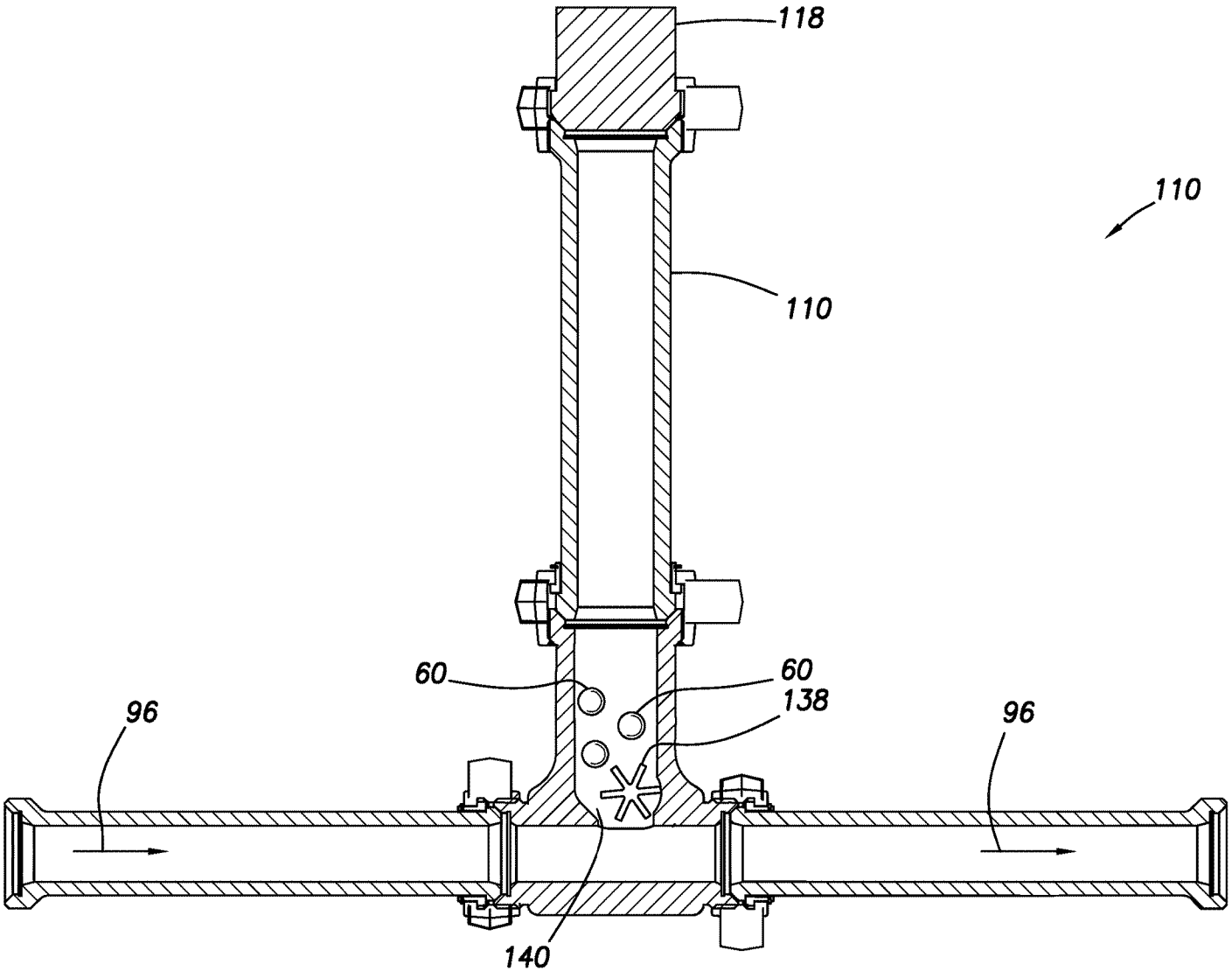

FIGS. 23-25 depict an example of the apparatus 100, in which the devices 60 are transferred from the queue 110 to the flow 96 by action of a shaft 128 driven impeller 138. The shaft 128 may be rotated by a motor or actuator (such as the actuator 92). A rotational speed of the shaft 128 may be controlled to thereby control a rate of transfer of the devices 60 from the queue 110 to the flow 96.

The impeller 138 can be rotated a full 360° or it can be operated back and forth through a smaller angle, such as that produced by a cylinder and bell crank. In this example, the impeller 138 drags devices 60 from the queue 110 through a narrow channel 140 into the flow 96.

The channel 140 is small enough that the devices 60 cannot free fall past the impeller 138. The channel 140 may serve as the restriction 98 (see FIG. 10) to break or pierce a coating 88 and/or retainer 80 on the devices 60.

Figure 26:
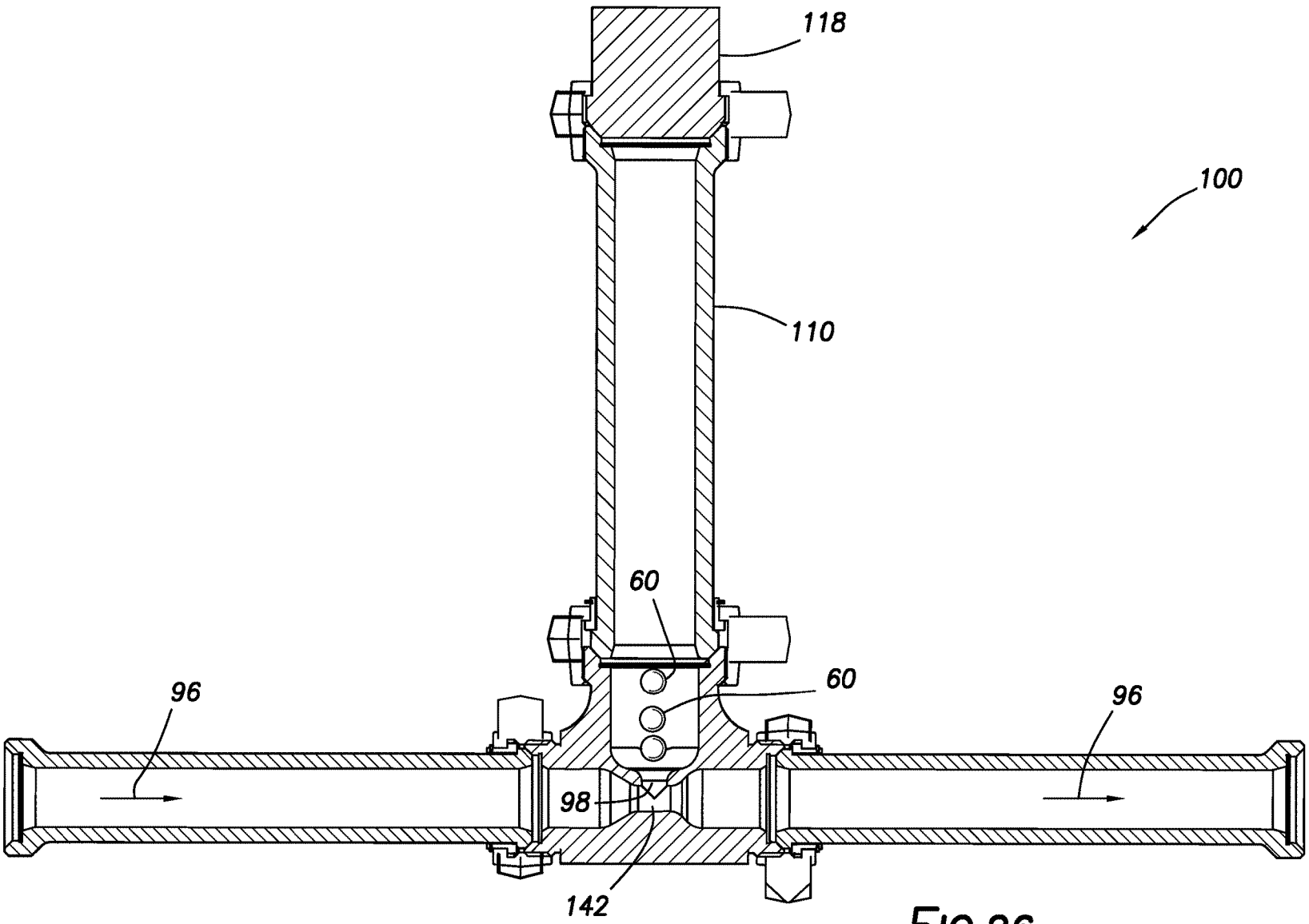
Figure 27:
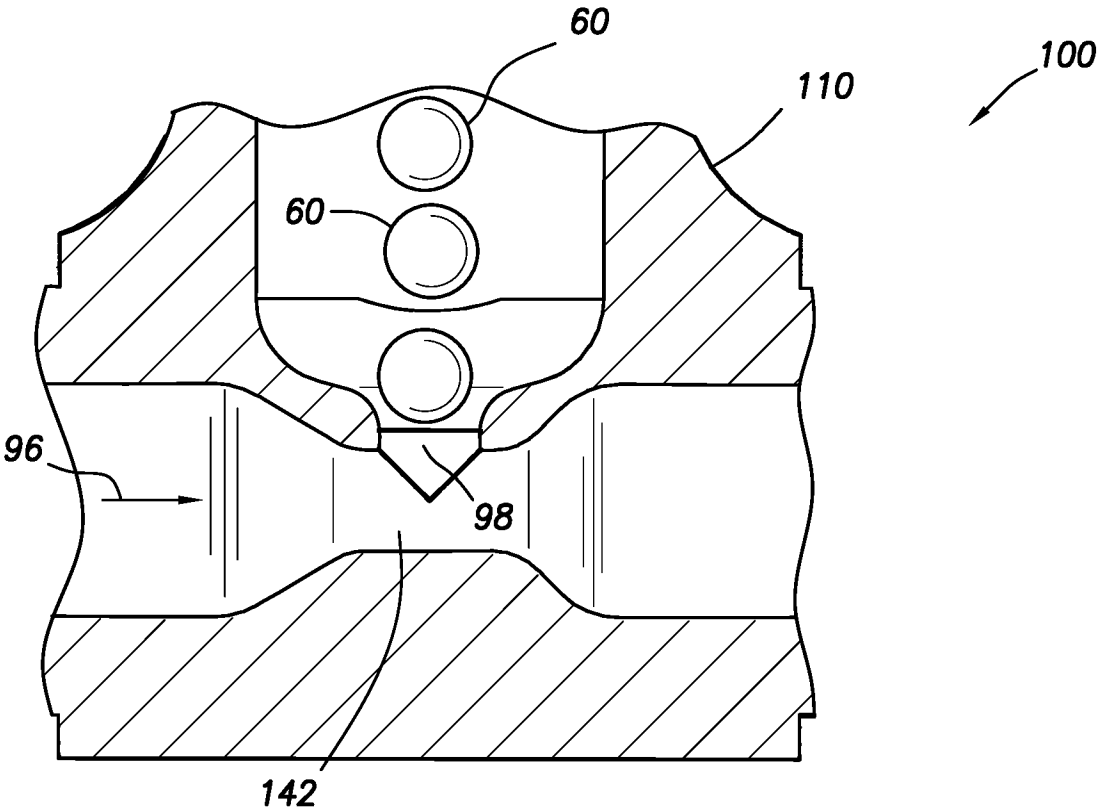

FIGS. 26 & 27 depict an example of the apparatus 100, in which a venturi 142 is used to pull the devices 60 from the queue 110 into the flow 96 due to a lowered pressure generated by the flow through the venturi. A pump connected upstream of the apparatus 100 can be used to control the number of devices 60 displaced (e.g., an increased flow rate results in reduced pressure at the venturi 142, which draws in devices 60 at a faster rate, and vice versa).

Figure 28:
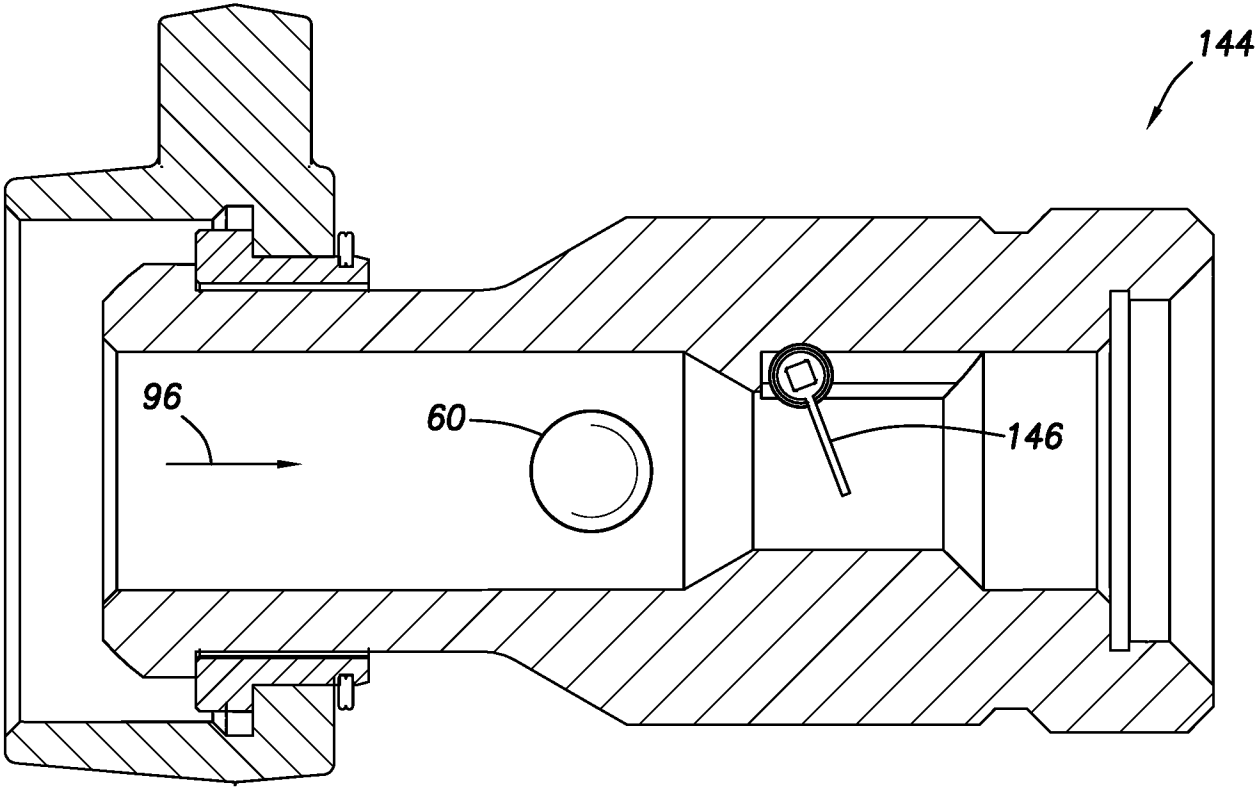
FIGS. 28-30 are representative cross-sectional views of plugging device detector examples that may be used with the deployment apparatus and method.
Figure 29:
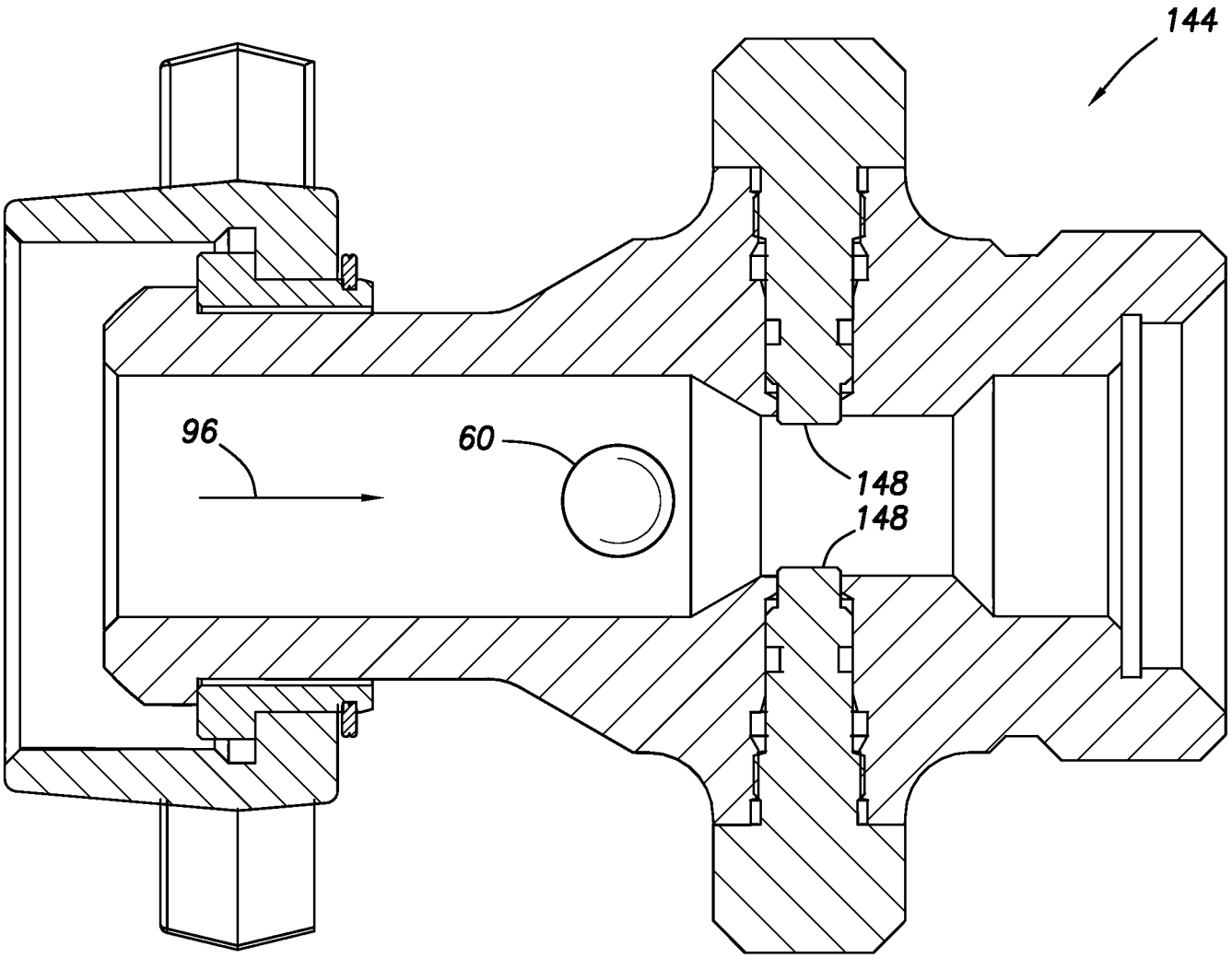
Figure 30:
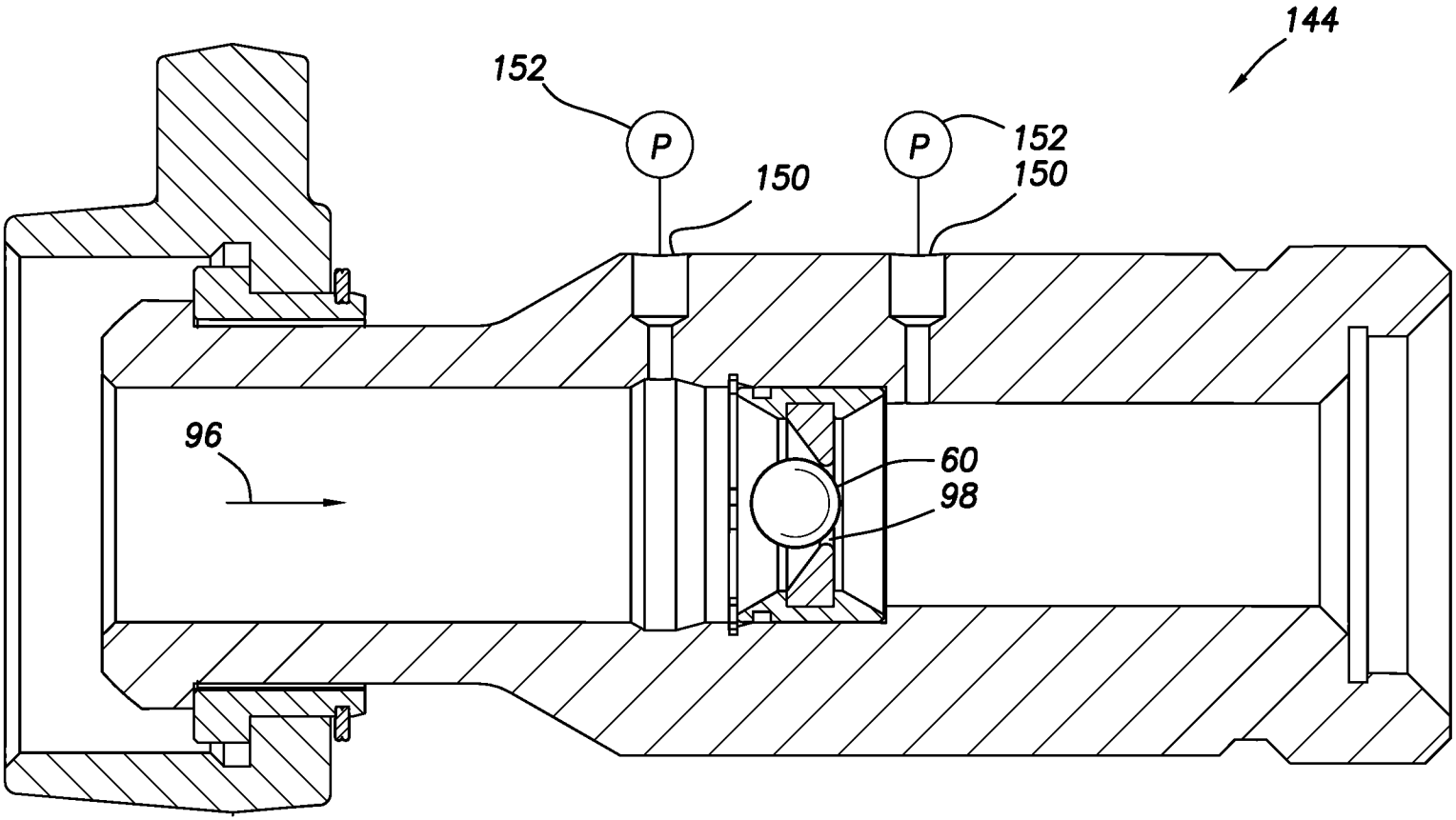

FIGS. 28-30 depict examples of plugging device detectors 144 that may be used to detect and count devices 60 that have been released into the flow 96. The device detectors 144 may be connected between the apparatus 90 or 100 and a wellhead, or may be incorporated into the apparatus (such as, in the conduit 86 or restriction 98 of the FIG. 10 apparatus 90). A count signal from the detector 144 may be used to control operation of the apparatus 90 or 100.

FIG. 28 depicts an example of the device detector 144 that uses a spring return mechanical lever 146 to detect a device 60 in the flow 96. The lever 146 has a relatively small cross section, so that fluid flow 96 alone cannot shift the lever. A flow area at the lever 146 is reduced, so that a device 60 cannot displace past the lever without moving the lever. A switch or transducer is used to detect when the lever 146 is moved by passage of a device 60.

FIG. 29 depicts an example of the device detector 144 that uses transducers 148 to measure sound or light transmitted across the flow 96, in order to determine when a device 60 passes between the transducers. An acoustic transducer 148 may be passive and not require sound transmission by another transducer.

FIG. 30 depicts an example of the device detector 144 that uses a restriction 98 in the flow 96 to create a pressure differential between two pressure ports 150 upstream and downstream of the restriction when a device 60 temporarily plugs the restriction. Pressure sensors 152 (or a single pressure differential sensor) can be connected to the ports 150. The restriction 98 can be made from a material or spring that will allow the device 60 to pass through the restriction when the pressure differential reaches a sufficient level.

Figure 34:
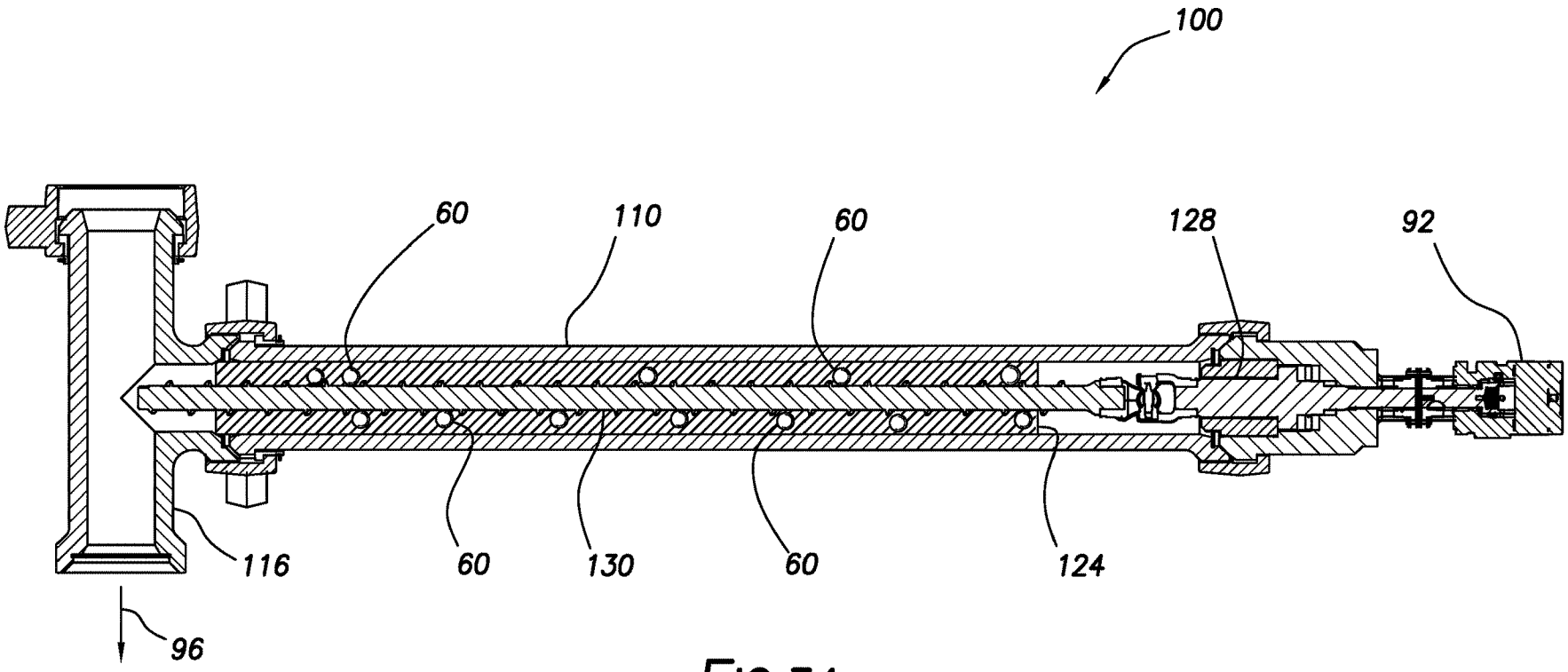

FIG. 34 depicts an example of the apparatus 100, in which the devices 60 are transferred from the queue 110 to the flow 96 by action of a motor driven auger 130. The devices 60 are included in (e.g., molded in, cast in, enclosed in, etc.) a cylinder 124, similar to the examples of FIGS. 15, 16, 19 & 20. However, in the FIG. 34 example, the auger 130 extends through a longitudinal axis of the cylinder 124, so that as the auger rotates, the cylinder (and the devices 60 therein) are advanced toward the flow 96 (to the left as viewed in FIG. 34).

Figure 35:
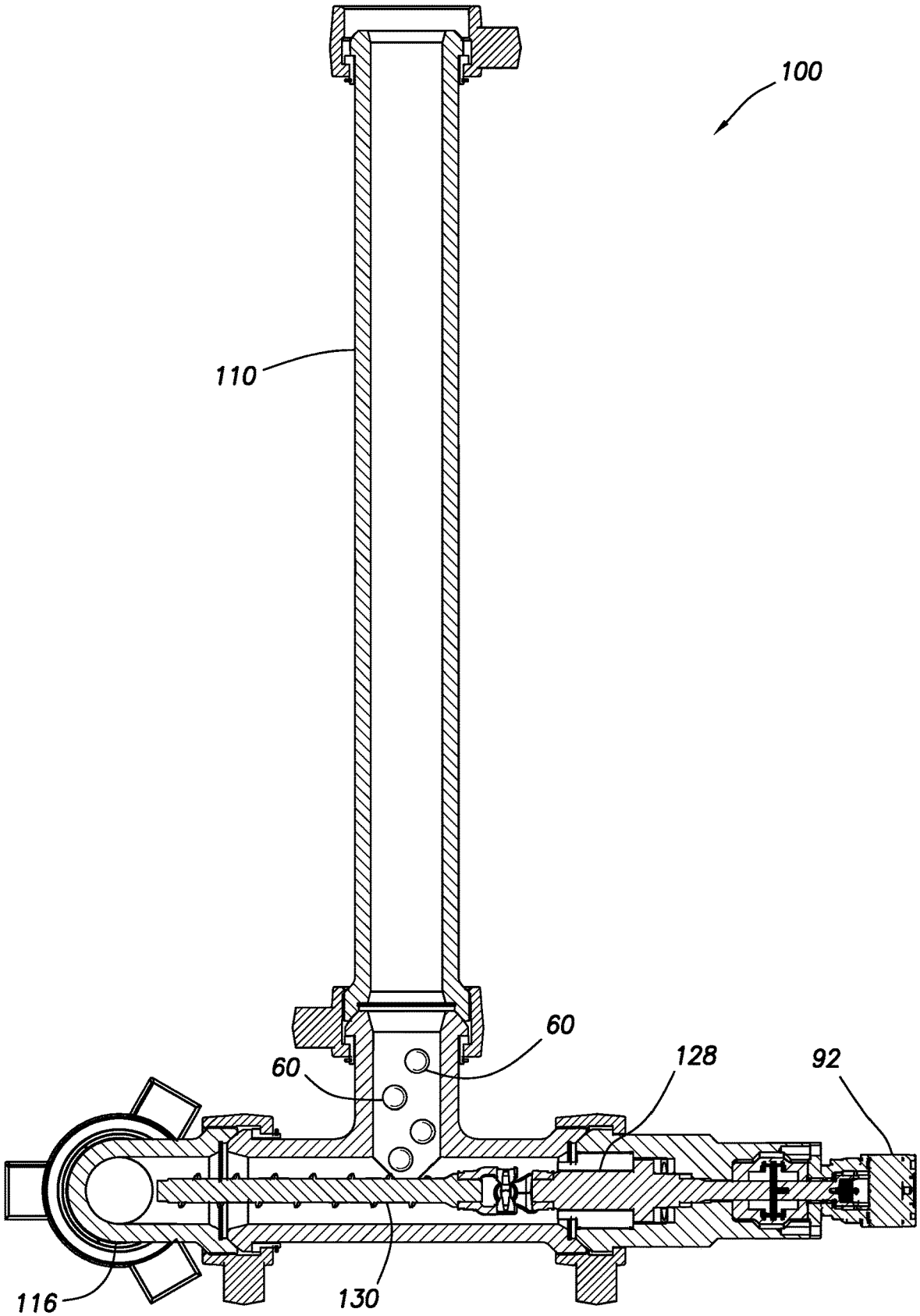

The example of FIG. 35 is similar to the example of FIG. 34, except that the devices 60 are delivered to the auger 130 via a vertical queue 110. The vertical queue 110 can be re-loaded with devices 60 as needed.

FIGS. 36-41 depict additional examples of device detectors 144 for detecting when and how many devices 60 are delivered to the flow 96. The device detectors 144 may be positioned at an outlet end of the apparatus 90 or 100, or otherwise between the apparatus and a conduit extending to the well.

Figure 36:
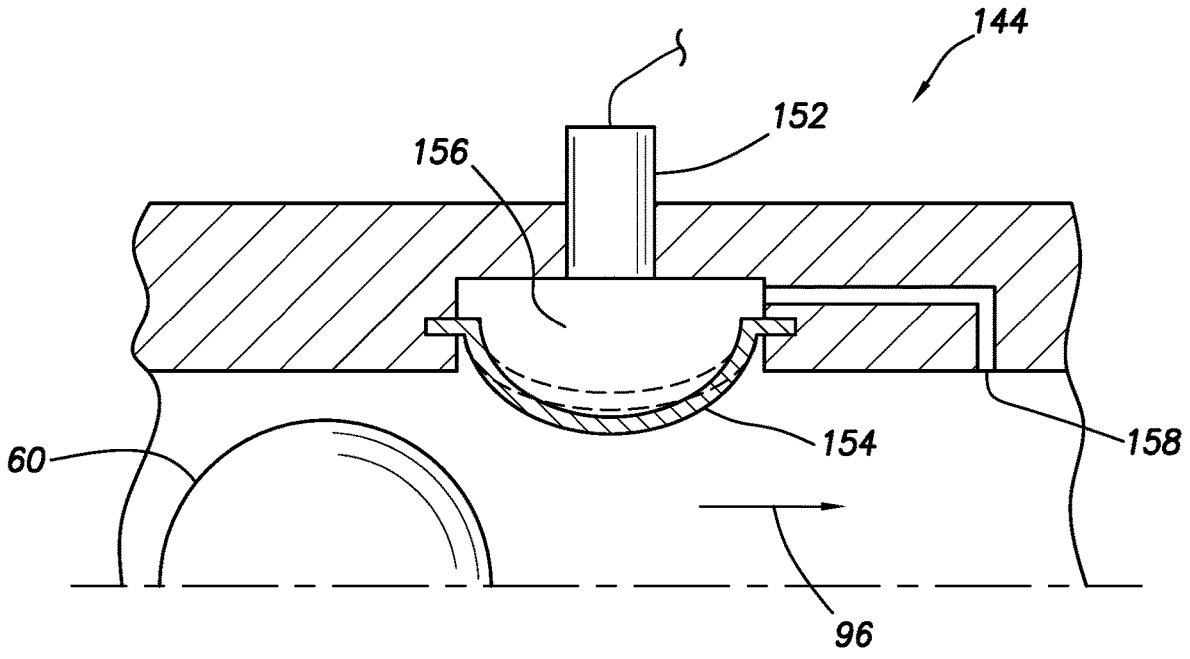
FIGS. 36-41 are representative cross-sectional views of additional examples of the plugging device detector.

FIG. 36 depicts an example of the device detector 144 with an internal diaphragm 154 exposed to the flow 96 downstream of the apparatus 90 or 100. As a device 60 impinges on the diaphragm 154, the diaphragm deflects outward toward a chamber 156, thereby increasing a pressure within the chamber.

The pressure increase is detected by a pressure transducer or pressure sensor 152 as an indication of the device 60 passing through the detector 144. An equalization hole or port 158 permits pressure in the chamber 156 to equalize with internal pressure, although a transient pressure pulse can still be detected by the pressure transducer 152 due to the device 60 passing through the detector 144.

Figure 37:
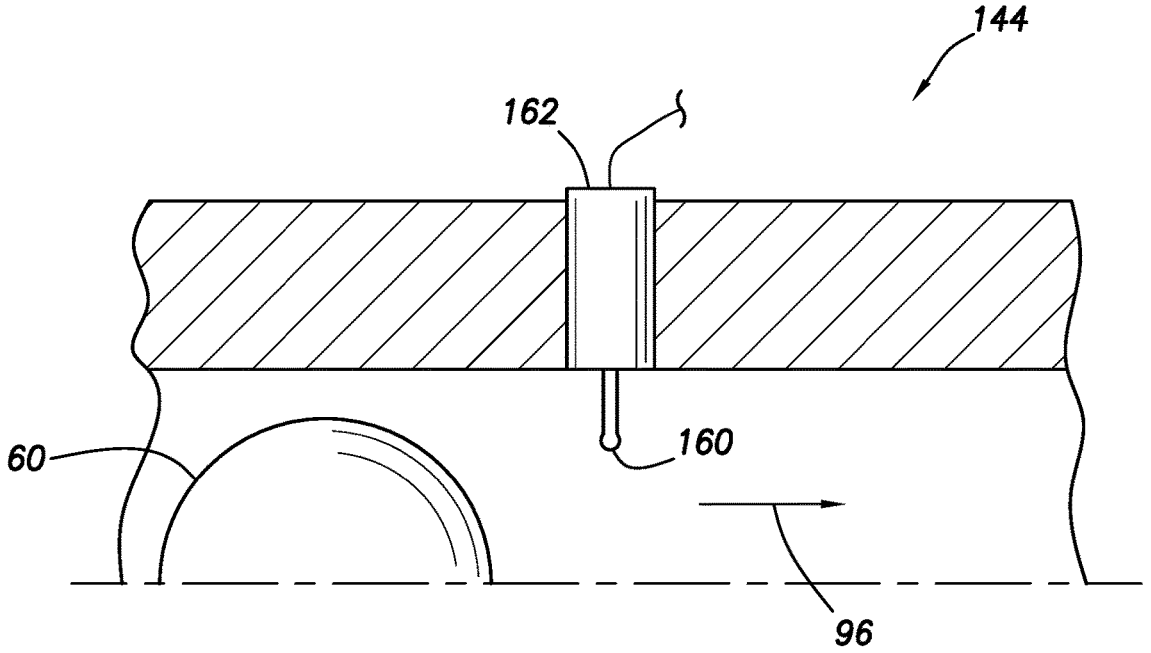

FIG. 37 depicts an example of a device detector 144 with a probe 160 extending inward, so that a passing device 60 will contact the probe. A vibration sensor 162 (such as an accelerometer, acoustic sensor or other type of vibration sensor) detects movement of the probe 160 due to the passing device 60.

Figure 38:
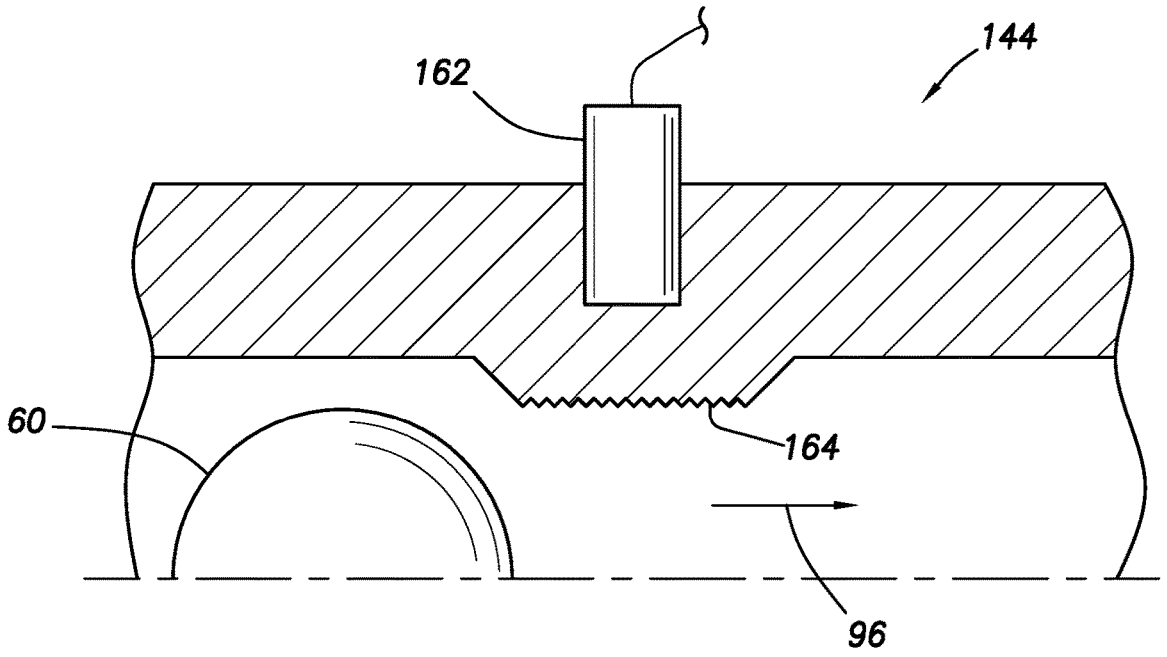

FIG. 38 depicts an example of a device detector 144 with an internal surface 164 that will be contacted by a passing device 60. The internal surface 164 could be stationary, or could be flexible or resilient (such as a collet, etc.). Vibrations produced by the device 60 contacting the surface 164 are detected by a vibration sensor 162. In this example, the vibration sensor 162 is not itself in contact with the flow 96.

Figure 39:
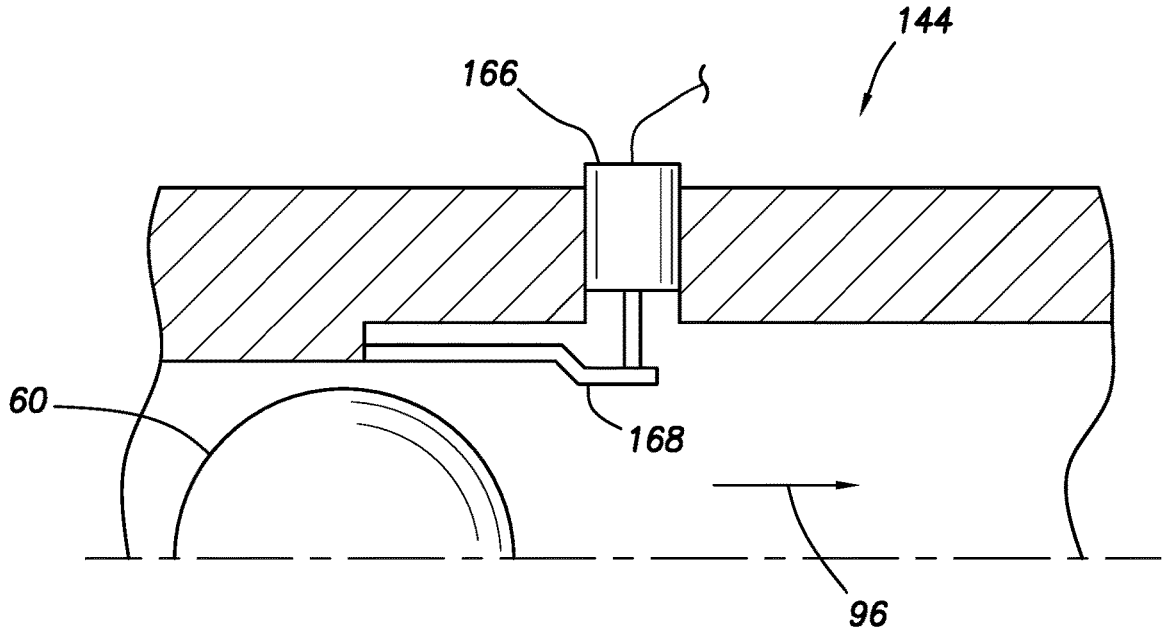

FIG. 39 depicts an example of a device detector 144 with a linear displacement sensor 166. A component 168 is contacted by the device 60 as it passes through the detector 144, thereby causing the component to displace linearly with the flow 96. The displacement of the component 168 is detected by the sensor 166 as an indication of the device 60 passing through the detector 144.

Figure 40:
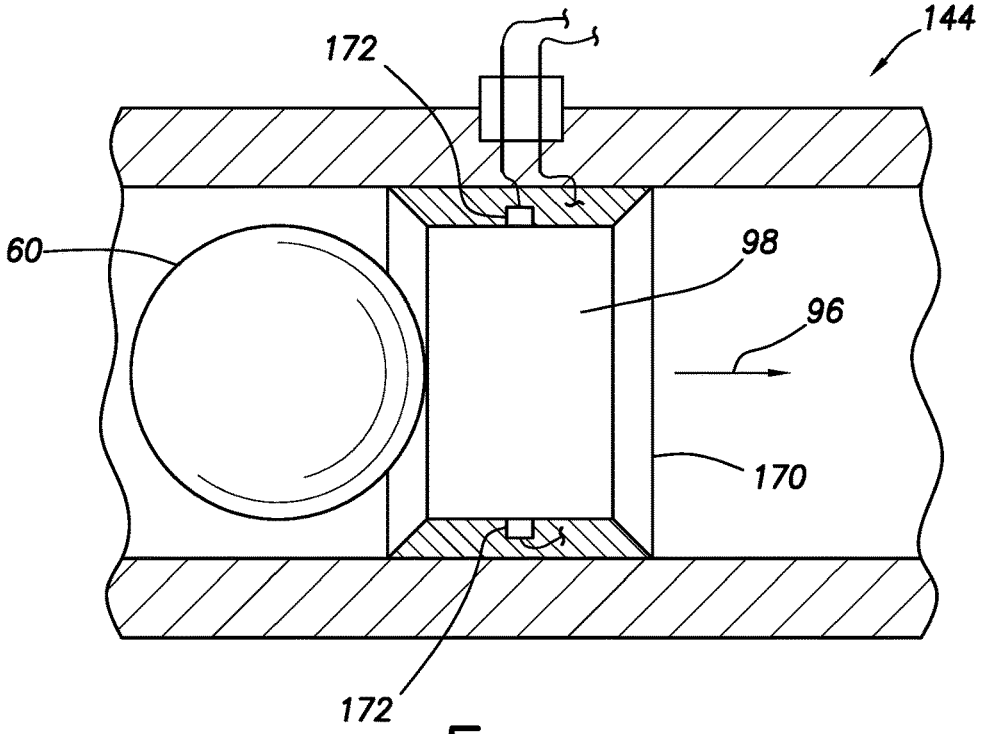

FIG. 40 depicts an example of a conductivity-based device detector 144. Electrical conductivity can be used to detect devices 60 that are less electrically conductive than the carrier fluid flow 96. An electrically insulating, reduced-diameter sleeve 170 holds two electrodes 172 on opposite sides of the flow path. A baseline conductivity is established with the fluid 96. As the device 60 is forced through the restriction 98, its passage is observed as a drop in electrical conductivity.

The reduced diameter restriction 98 provides at least two benefits in this example. The device 60 occupies a larger fraction of the volume between the electrodes 172, increasing the change in conductivity as the device 60 contacts and passes the electrodes. Also, with the smaller diameter, the likelihood of two devices 60 passing the electrodes 172 at the same time is reduced.

In order to withstand erosion from sand, proppant or other abrasive material, the insulating sleeve 170 can be made from a ceramic material, such as alumina. The electrodes 172 can also be fabricated from erosion-resistant materials, such as nickel- or cobalt-cemented tungsten carbide.

Figure 41:
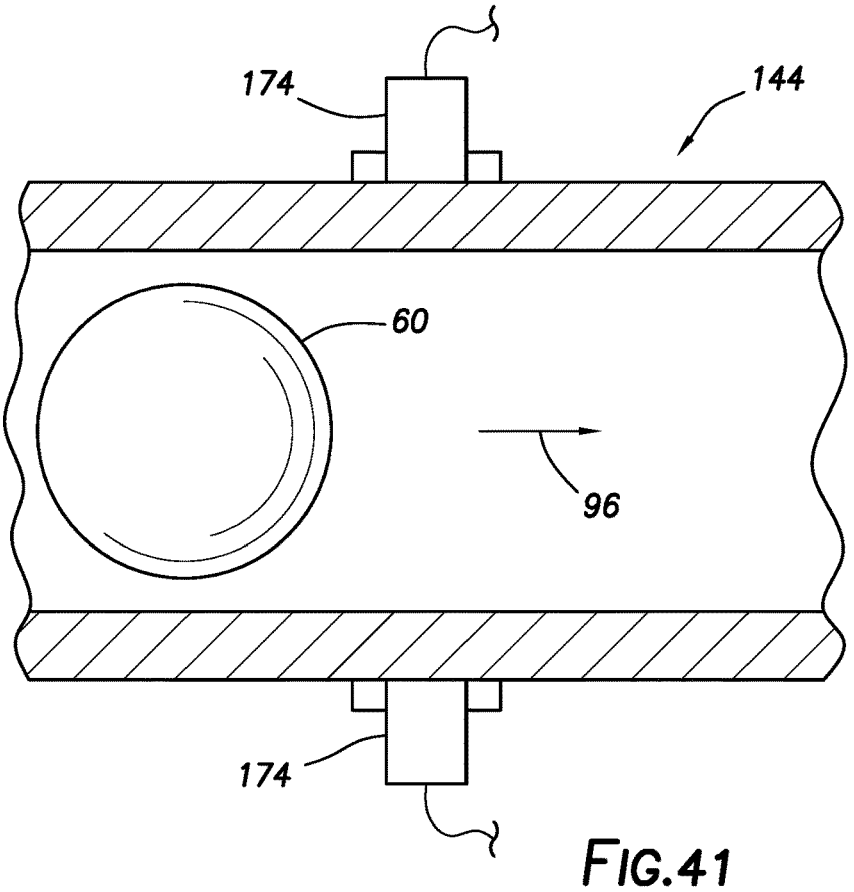

FIG. 41 depicts an example of an ultrasound-based device detector 144. Ultrasound can be used to detect the devices 60, with an ultrasonic transmitter and receiver (or transducer) pair 174 in transmission mode. Alternatively, a single transducer 174 can be used in reflection mode to detect the devices 60.

Figure 42:
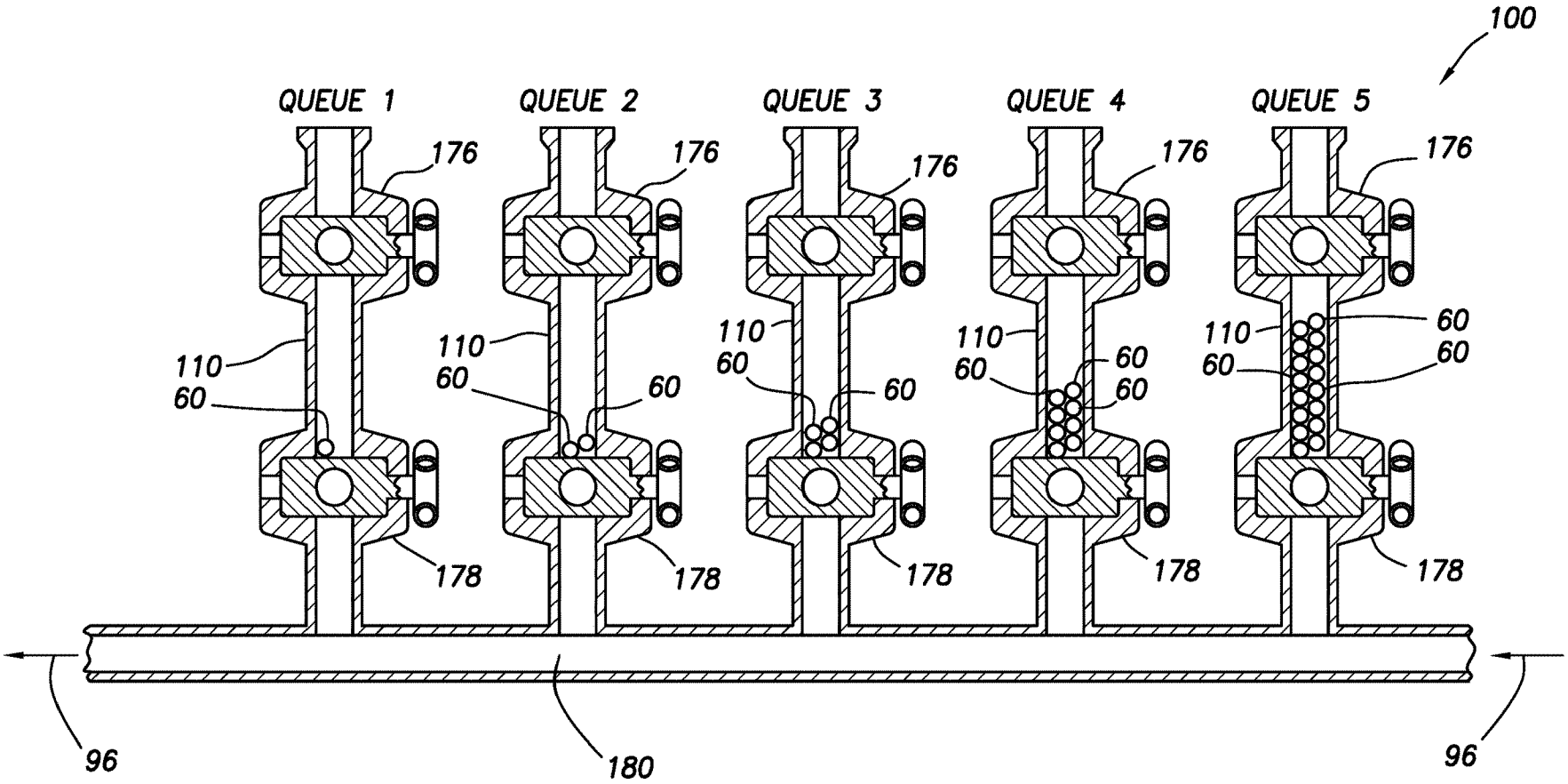
FIG. 42 is a representative cross-sectional view of another example of the deployment apparatus and method.

FIG. 42 depicts an example of a deployment apparatus 100 that comprises five queues 110. Each queue 110 comprises a manual plug valve 176 with a hydraulic or otherwise quick actuating plug valve 178 connected below. The queues 110 are connected along a treating line 180 (such as the conduit 86 or pipe 102) leading to a wellhead. It is typical in fracturing operations to have several treating lines leading to the wellhead.

The manual valve 176 is used on top for installing devices 60 in each queue 110. For example, the devices 60 may be loaded into the queues 110 between stages while pumps are not running. The valves 176 are used in this example (instead of a cap 118) for loading the devices 60, because fracturing procedures require pressure testing of any threaded connected every time it is made up, but a valve must be tested only one time, and can be opened and closed without requiring a new pressure test.

The lower valve 178 of each queue 110 can be operated remotely. The remotely operable valves 178 are used in this example, because the queues 110 may be located in a "red zone" which is considered an unsafe location for personnel during pumping of a fracturing stage.

It is desirable in some examples for the hydraulic valves 178 to leak somewhat, so that the valves are pressure balanced and can be opened easily even though the line 180 is pressurized. Note that some conventional hydraulic valves 178 may not be opened with high differential pressure across the valve. Other types of valves, such as a pin or flapper, could be used to releasably retain the devices 60 below the manual valve 176 and above the treatment conduit 180.

Gravity displaces the devices 60 into the treatment conduit 180 when a valve 178 is opened. The devices 60 are preferably heavier (denser) than the treatment fluid. Spacing of the devices 60 is accomplished by relatively slow displacement of the devices 60 into the high velocity treatment conduit 180.

It is possible to coat or surround the devices 60 with chemicals to change the rate of deployment. It may be desirable to cast the devices 60 in a cylinder 124 comprising an erodible material, in order to slow the deployment rate of the devices to the erosion rate of the cylinder.

One advantage of the FIG. 42 deployment apparatus 100 example is that it does not require an additional pump to deploy the devices 60. In addition, the FIG. 42 apparatus 100 can deploy an exact number of devices 60 without the need for a device detector 144 (although a device detector may be used to confirm the number of devices deployed).

The number of devices 60 deployed can be critical in some well operations where one plugging device too few may cause the treatment pressure to be too low to break down a zone 40. One plugging device 60 too many in some examples may cause the pressure to exceed casing 16 or equipment limitations.

Different numbers of devices 60 may be deployed on respective different stages of a fracturing operation. A decision on the number of devices 60 to deploy may not be known until after the fracturing operation is started on a particular stage. Since the location of the queues 110 may be in the "red zone," it may not be considered safe for personnel to load the queues during a fracturing operation.

In the FIG. 42 example, different numbers of devices 60 are loaded into the respective different queues 110. In this manner, selected queues 110 can be opened (e.g., by opening their respective valves 178) to thereby deploy a desired number of devices into the treatment conduit 180.

The number of plugging devices 60 in each queue 110 in the FIG. 42 example is determined as follows: Queue n devices=$2^{n-1}$. Thus, queue 1 has 1 device, queue 2 has 2 devices, queue 3 has 4 devices, queue 4 has 8 devices, and queue 5 has 16 devices.

By opening a certain combination of queue valves 178, an exact desired number of devices 60 can be deployed from 1 up to $2^n-1$ where n is the number of queues. Five queues can contain 31 plugging devices total in this example, which is enough for most fracturing stages. Of course, different numbers of queues 110 may be used in other examples.

For example, if it is desired to deploy three of the plugging devices 60, queues 1 & 2 (with respective one and two devices therein) can be opened to allow the corresponding devices to displace into the conduit 180. If it is desired to deploy twenty of the plugging devices 60, queues 3 & 5 (with respective four and sixteen devices therein) can be opened to allow the corresponding devices to displace into the conduit 180. Any desired whole number of plugging devices 60 (up to a total of 31) may be deployed using the FIG. 42 apparatus 100 having five of the queues 110.

FIG. 42 depicts the devices 60 contained loose in the queues 110 between two valves 176, 178. In other examples, it may be desirable to place the devices 60 in a sack or other container in each of the queues 110. The container may be opened mechanically or by flow or by dissolution, etc.

In cases where gravity feeding of devices 60 into a flow stream results in insufficient spacing of the devices, it may be desirable to slow the introduction of the devices into the flow 96. In one example, a desired number of devices 60 may be encased in a cylinder 124 (see FIGS. 16 & 20) of material that is denser than the fluid into which the devices will be deployed. The material may be degradable in the flowing fluid. Degradation can be physical (e.g., broken apart by the flow stream), or chemical (e.g., hydrolysis, dissolution), or a combination of physical and chemical processes.

When a valve 178 is opened, gravity will pull the cylinder 124 into the flow stream. The fluid forces acting on the cylinder 124 may break up the cylinder as it enters the flow stream, thus releasing the devices 60. Alternatively, the fluid may dissolve or hydrolyze one or more components of the cylinder 124 composition to release the devices 60.

The cylinder 124 length in this example should be greater than an inner diameter of the treatment conduit 180 to prevent entry of the entire cylinder in the absence of cylinder degradation. As the cylinder 124 degrades from the bottom where it is exposed to flow, the cylinder progressively feeds into the flow 96, which provides the delay to achieve the desired spacing between the devices 60.

Wax cylinders 124, such as those described above, can be used with certain modifications. The cylinder 124 density can be increased with a dense, solid material, such as granular sodium chloride or sand. Plaster of Paris cylinders 124 are also suitable for this purpose.

Plugging devices 60 can be cast in salt cylinders 124, using a mixture of granular salt and a binder (e.g., phosphorus oxychloride (see U.S. Pat. No. 2,599,436), clay, or water-soluble polymer).

Plugging devices 60 can be cast in polyethylene glycol. Degradation characteristics and density can be altered by incorporating other materials, such as salt or glycerin.

Plugging devices 60 can be encapsulated in cylinders 124 of aqueous gel. Gels can be prepared from polymer solutions that are crosslinked in a mold after adding a desired number of devices. Density can be increased by using brine (e.g., sodium chloride, calcium chloride, sodium bromide, calcium bromide) to prepare the polymer solution. Water-soluble polymers can be synthetic (e.g., polyacrylamide, polyvinyl alcohol, polyacrylic acid, homopolymers or copolymers), or natural (e.g., carrageenan, guar gum, xanthan gum, gelatin). Crosslinking can be achieved with metals (e.g., titanium, zirconium, boron, calcium), or organic compounds (e.g., aldehydes, hexamethylenetetramine).

Gels can also be prepared from monomer solutions (e.g., acrylamide, 2-hydroxyethyl acrylate, acrylic acid) containing multifunctional crosslinking monomers (e.g., N,N'-methylenebisacrylamide, triethylene glycol diacrylate, pentaerythritol acrylate esters) that are polymerized in the mold with a free-radical initiator.

It may now be fully appreciated that the above disclosure provides significant advancements to the art of controlling flow in subterranean wells. In some examples described above, the device 60 may be used to block flow through openings in a well, with the device being uniquely configured so that its conveyance with the flow is enhanced. A deployment apparatus 90, 100 can be used to deploy the devices 60 into the well, so that a desired number and spacing between the devices is achieved.

A system 10 for use with a subterranean well can include a deployment apparatus 100 configured to deploy one or more plugging devices 60 into a fluid flow 96, whereby the plugging devices 60 are conveyed into the well by the fluid flow 96, and in which the deployment apparatus 100 comprises multiple queues 110, different numbers of the plugging devices 60 being contained in respective different ones of the queues 110.

The total number of the plugging devices 60 contained in the queues 110 may be equal to $2^n-1$, where n is a total number of the queues 110. The queues 110 may be sequentially numbered (1, 2, 3, . . . , n), where n is the sequential number of a respective one of the queues 110. The number of plugging devices 60 in the respective one of the queues may be equal to $2^{n-1}$.

Each queue 110 may be positioned between two valves 176, 178, at least one of the valves 178 being remotely actuated. A selected combination of the queues 110 may be opened to thereby release a desired total number of the plugging devices 60 into the well.

The plugging devices 60 in each queue 110 may be contained in a degradable cylinder 124. Each of the plugging devices 60 may be retained by a respective degradable retainer 80.

Each of the plugging devices 60 may include at least one of the group consisting of lines 66 and fibers 62, which extend outwardly from a body 64. The body 64 may be degradable in the well. The lines 66 or the fibers 62 may be degradable in the well.

A method of deploying plugging devices 60 into a subterranean well can include connecting multiple queues 110 of the plugging devices 60 to a conduit 180, and deploying the plugging devices 60 from a selected combination of the queues 110 into the conduit 180.

The method may include providing each of the plugging devices 60 with a body 64 and one or more lines 66 extending outwardly from the body 64. The method may include degrading at least one of the body 64 and the lines 66 in the well.

The method may include providing each of the plugging devices 60 with a body 64 and one or more fibers 62 extending outwardly from the body 64. The method may include degrading at least one of the body 64 and the fibers 62 in the well.

The method may include engaging the plugging devices 60 with respective openings 68 in the well, each of the plugging devices 60 including a body 64 that engages and prevents flow through a respective one of the openings 68, but is too large to pass through the respective one of the openings 68.

The method may include retaining each of the plugging devices 60 with a retainer 80 that is degradable in the well.

The method may include encasing the plugging devices 60 in each of the queues 110 in a cylinder 124. The deploying step may include degrading the cylinders 124 of the selected combination of the queues 110.

A system 10 for use with a subterranean well can include a deployment apparatus 100 configured to deploy one or more plugging devices 60 into a fluid flow 96, whereby the plugging devices 60 are conveyed through a conduit 86, 102, 180 into the well by the fluid flow 96, and each of the plugging devices 60 comprising a body 64 and at least one of lines 66 and fibers 62 extending outwardly from the body 64.

The plugging devices 60 may be transferred from a queue 110 to the fluid flow 96 by a gear 120 engaged with a rack 122. The rack 122 may displace a degradable cylinder 124 containing the plugging devices 60.

The plugging devices 60 may be treated with surfactant. The plugging devices 60 may be wrapped in a water-soluble polyvinyl alcohol. The cylinder 124 may comprise a palm wax or Plaster of Paris.

The plugging devices 60 may be transferred from a queue 110 to the fluid flow 96 by an auger 130, by a piston 134, by a hydraulic cylinder 136, or by an impeller 138. The plugging devices 60 may be transferred from a queue 110 to the fluid flow 96 by a reduced pressure generated by a venturi 142.

The plugging devices 60 may be transferred from a queue 110 to the fluid flow 96, and a device detector 144 may detect the plugging devices 60 that have been deployed into the fluid flow 96.

The device detector 144 may comprise a mechanical lever 146 deflected by the plugging devices 60.

One or more transducers 148 may measure sound or light transmitted across the fluid flow 96.

The device detector 144 may include a restriction 98 that creates a pressure differential between two pressure ports 150 when one of the deployed plugging devices 60 blocks the restriction 98.

The device detector 144 may include a vibration sensor 162.

The device detector 144 may include a pressure sensor 152 that senses a transient pressure pulse in a chamber 156 due to contact between each of the deployed plugging devices 60 and a flexible barrier (such as the diaphragm 154).

The device detector 144 may include a displacement sensor 166.

The device detector 144 may include at least one electrode 172 that contacts each of the deployed plugging devices 60.

The device detector 144 may include at least one ultrasonic transducer 174.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for use with a subterranean well, the system comprising:

a deployment apparatus configured to deploy one or more plugging devices into a fluid flow, whereby the plugging devices are conveyed into the well by the fluid flow, in which the deployment apparatus comprises multiple queues, in which the queues are sequentially numbered (1, 2, 3, . . . , N), where N is a total number of the queues, in which a number of the plugging devices in a respective one of the queues is equal to $2^{n-1}$, where n is the sequential number of the respective one of the queues, whereby the deployment apparatus is configured to deploy any desired quantity of the plugging devices up to $2^N-1$ by opening a selected combination of the queues, and in which the selected combination of the queues is opened by opening a respective valve for each queue of the selected combination of the queues, whereby all of the plugging devices in the selected combination of the queues are deployed.

2. The system of claim 1, in which a total number of the plugging devices contained in the queues is equal to $2^N-1$.

3. The system of claim 1, in which the respective valve for each queue is capable of being remotely actuated.

4. The system of claim 1, in which the selected combination of the queues is opened to thereby release the desired quantity of the plugging devices into the well.

5. The system of claim 1, in which the plugging devices in each queue are contained in a degradable cylinder.

6. The system of claim 1, in which each of the plugging devices is retained by a respective degradable retainer.

7. The system of claim 1, in which each of the plugging devices comprises at least one of the group consisting of lines and fibers, which extend outwardly from a body.

8. The system of claim 7, in which the body is degradable in the well.

9. The system of claim 7, in which the at least one of the group consisting of the lines and the fibers is degradable in the well.

* * * * *